US006471345B2

(12) United States Patent
Yoshino et al.

(10) Patent No.: US 6,471,345 B2
(45) Date of Patent: Oct. 29, 2002

(54) INKS-AND-PRINTING-MEDIA-INTEGRAL-TYPE PACK, PRINTING LIQUID AND SHEETS CONTAINER, SHEET SUPPLYING DEVICE, AND PRINTING APPARATUS COMPRISING THE SAME

(75) Inventors: Hiroshi Yoshino, Kawasaki; Tadayoshi Inamoto, Hachioji; Yoshiaki Kaburagi, Kawasaki; Hiroyuki Saito, Machida; Ako Takemura, Saitama; Akira Kuribayashi, Kawasaki; Mariko Suzuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/773,501

(22) Filed: Feb. 2, 2001

(65) Prior Publication Data

US 2001/0033314 A1 Oct. 25, 2001

(30) Foreign Application Priority Data

Feb. 3, 2000 (JP) ..... 2000-026109
Feb. 3, 2000 (JP) ..... 2000-026112
Feb. 3, 2000 (JP) ..... 2000-026115
Feb. 3, 2000 (JP) ..... 2000-026117

(51) Int. Cl.[7] ..... B41J 2/175
(52) U.S. Cl. ..... 347/86
(58) Field of Search ..... 347/2, 84, 85, 347/86, 87, 176, 104

(56) References Cited

U.S. PATENT DOCUMENTS 6,069,642 A * 5/2000 Isobe ..... 347/176
6,149,256 A * 11/2000 McIntyre et al. ..... 347/2
6,208,828 B1 * 3/2001 Awai et al. ..... 399/361

FOREIGN PATENT DOCUMENTS

JP 59-190857 * 10/1984 ..... 347/86
JP 11-254700 9/1999

* cited by examiner

*Primary Examiner*—Anh T. N. Vo
(74) *Attorney, Agent, or Firm*—Fitzpatrick, Cella, Harper & Scinto

(57) ABSTRACT

A pack integrally housing inks and printing media has an ink housing section 211 arranged so as to overlap part of a printing media housing section 210. The ink housing section 211 is configured to rotationally move around a rotational moving shaft 212*e* so as to be opened and closed relative to the printing media housing section 210. On the other hand, the printing media housing section 210 has an opening 215 formed in a lower part thereof and in which part of housed printing media appears, thereby enabling the pack to come into contact with a sheet feeding roller of the printer when the pack is installed in a printer. Additionally, while not installed in the printer, the pack is covered with the opening and closing ink housing section 211, thereby enabling the printing media to be protected from dusts or the like.

6 Claims, 29 Drawing Sheets

INKS-AND-PRINTING-MEDIA-INTEGRAL-TYPE PACK, PRINTING LIQUID AND SHEETS CONTAINER, SHEET SUPPLYING DEVICE, AND PRINTING APPARATUS COMPRISING THE SAME

This application is based on Patent Application Nos. 2000-26109 filed Feb. 3, 2000, 2000-26112 filed Feb. 3, 2000, 2000-26115 filed Feb. 3, 2000, and 2000-26117 filed Feb. 3, 2000, in Japan, the content of which is incorporated hereinto by reference.

BACKGROUND OF THE INVENTION

Field of the Invention

The present invention relates to an inks-and-printing-media-integral-type pack, a printing liquids and sheets container for accommodating sheets and printing liquids, a sheet supplying device for sequentially supplying sheets from the printing liquids and sheets container, and a printing apparatus comprising the same.

The ink jet printing system is carried out by causing fine droplets of inks to fly and adhere to a printing medium such as paper based on various operational principles, to print images, characters, or the like, thereby enabling printing with low noise at a high speed. The ink jet printing system has advantages such as facilitation of multicolor printing and is characterized by a high degree of freedom for recordable patterns, elimination of the necessity of development or fixation, and others. Thus, printing apparatuses based on this system method have been rapidly spread in various fields including that of data processing to accommodate various images and print media.

In addition, images formed by means of the multicolor ink jet printing system can easily stand comparison with multicolor printing based on the plate making system or photographic printing based on the color photographing system. The multicolor ink jet printing system enables images to be produced more inexpensively than normal multicolor printing or photographic printing if a small number of copies are particularly to be printed and is thus widely used in the field of full-color image printing.

To accommodate wider applications of the ink jet printing system and enable the recent improvement of printing characteristics such as an increased printing speed, an improved definition, and full color printing, efforts are being made to improve the printing apparatus and method. Characteristics required to achieve wider applications of the ink jet printing system and improve the printing characteristics include, for example, a high density of printed ink dots, bright and clear color tones, fast ink absorption, prevention of outflow or bleeding of inks despite overlapping ink dots, and spread of ink dots with appropriate bleeding.

It is known that these characteristics are realized not only by the printing apparatus and method but also by improving inks or printing media used for printing.

For example, it is known that a coated paper is used as a printing medium due to ink absorptivity and fixability achieved thereby The coated paper comprises, for example, a silicon pigment such as silica, or an absorbing polymer including a resin such as colloidal silica, polyvinyl pyrrolidone, polyvinyl alcohol, polyethylene oxide-isocyanate crosslinked material, or an acrylic polymer having a carboxyl group, or an aluminum-based pigment such as alumina hydrated compound or aluminum oxide, which is each coated on a paper, a film, a cloth, or the like together with an aqueous binder or the like. On the other hand, inks have their permeability adjusted by means of a surface-active agent or the like contained therein.

To accommodate the improvement of the printing characteristics, however, an optimal combination of printing media and inks which can realize these characteristics is more preferably selected by individually selecting printing media or inks depending on each of the characteristics. This is because the inks and the printing media show each of the characteristics through their mutual relationship.

In this case, to specifically realize the optical combination of the printing media and the inks in an inkjet printing apparatus, configurations and operations are required which replace or install the printing media or the inks depending on a combination of printing media and inks. Additionally, an operation is required for setting printing conditions on, for example, a host computer; for example, a printing mode must be set depending on such a combination. That is, it is cumbersome to carry out the above operations or setting operations each time the combination is switched. It is also difficult for a user to obtain the optimal combination.

In connection with this, for example, Japanese Patent Application Laid-Open No. Heisei 11-254700 proposes a media cartridge removably mounted in a printing apparatus and acting as a portable container comprising a cassette section in which sheets are loaded as printing media and a combination of any ink tank or a corresponding waste ink tank for accommodating a waste ink, the cassette section and the combination being integrated together. The printing apparatus then recognizes the media cartridge, which can be arbitrarily installed therein and removed therefrom, to automatically set a printing mode set depending on the printing media and the ink so that appropriate printing control can be provided depending on the combination of the printing media and the ink, using easy operations.

In a printing apparatus in which such a media cartridge is installed, a sheet supplying device provided in the printing apparatus main body discharges in turn each sheet such as paper or a textile outward from the media cartridge toward a position under an ink jet printing head for executing a printing operation.

The sheet supplying device includes a roller that comes into contact with a surface of the sheet at a predetermined pressure to transmit the sheet based on a friction force applied between the sheet and the roller. An outer peripheral portion of the roller is formed of a material such as natural rubber, silicon rubber, or artificial leather, for example, which has a relatively large friction coefficient and a wear resistance.

(1) Although, however, the above publication describes the media cartridge comprising the cassette for housing printing media and the ink tanks, the cassette and the ink tanks being integrated together, it describes no specific configuration that takes into account the size reduction of the apparatus or the handling and application of the cartridge in configuring a printing apparatus employing the cartridge.

It neither takes the materials or compositions of both printing media and inks into consideration nor suggests combinations that can achieve the above described desired printing characteristics based on such materials or compositions. That is, in the above publication, if for a paper cartridge, paper is set as printing media, corresponding inks are set to comprise a process liquid and black, yellow, magenta, and cyan inks. On the other hand, if coat paper, glossy paper, or OHP sheets are set as printing media, the corresponding inks are set to comprise the above inks excluding the process liquid. These settings take into account the fact that the above coat paper or the like having an ink receiving layer coated thereon has reduced image quality if the process liquid, which insolubilizes the inks, is used. Further, the above publication describes a setting for dark black, light black, dark yellow, light yellow, dark magenta, light magenta, dark cyan, and light cyan provided when a photographic-image-quality mode is set.

Thus, the above publication discloses the integral cartridge comprising a combination of inks selected, depending on the printing media or printing mode, from several types of inks that are easily distinguished from one another by a user. On the other hand, due to, for example, dye affinity, appropriate compositions of inks vary depending on the material or composition of printing media though the latter all appear the same to the user; thus, optimal combinations exist in this sense. In this case, it is almost impossible for the user to select such combinations.

Another problem results from the fact that many known ink jet printing apparatuses have more or less specified printing characteristics. Thus, in this case, it is relatively difficult to meet the above described requirements for the various printing characteristics.

For example, with respect to the characteristics of the printing head, the life in itself which serve to determine the printing characteristics.

If the printing head is very frequently used, its durability must be increased. Similarly, the required characteristic of the inks includes their easy removal from the nozzles by means of a recovery operation or the like even in a case where recording is not carried out for a somewhat long time or the unlikelihood of variations in their compositions or colors. Since the characteristics of the ink jet recording apparatus is restricted by the above factors, an attempt to provide an ink jet printing apparatus with all the characteristics tends to result in the increased size or costs of the apparatus. Thus, ink jet printer makers or the like manufacture and sell printers that have their characteristics adapted, for example, to users who very frequently use them, to those who require high-grade and -quality images, or to those who use them in a low or high-temperature environment, that is, the capabilities of these printers are limited to within certain ranges to meet such demands. Thus, if a user having an ink jet printer with a characteristic A is to execute printing with another characteristic B and when the user sets a special mode to adapt the printer to the characteristic B, this adaptation is limited. Consequently, to accommodate the characteristic B, the user has no other choice but to purchase another printer with that characteristics.

The present invention is adapted to solve these problems, and it is a first object thereof to provide an inks-and-printing-media-integral-type pack that enables printing with various characteristics to be accomplished using a simple configuration, that is configured taking the size of the apparatus into consideration, and that can be handled easily, as well as a printing apparatus comprising the inks-and-printing-media-integral-type pack.

(2) In addition, (a) for a form of an ink jet printer in which a media cartridge is installed in and removed from a recording apparatus, when the media cartridge is not installed for convenience and easier handling thereof, it is desirable that printing be executed on those other than the sheets housed in the media cartridge.

(b) the media cartridge desirably internally has a closed space in order to prevent sheets housed therein from being modified, and (c) various sheets accommodated in the media cartridge may have different degrees of rigidity but it is difficult to appropriately change, depending on the rigidity of the sheet, a separating means operating in the sheet supplying device to reliably sequentially separate sheets one by one, so that the separating means is fixed to a single type of sheets. Consequently, there is a limit to the function of reliably separating various sheets one by one for sheet-by-sheet feeding.

In view of these points, it is a second object of the present invention to provide a printing liquids and sheets container for accommodating sheets and printing liquids, a sheet supplying device for sequentially supplying the sheets from the printing liquids and sheets container, and a printing apparatus comprising the same, wherein they can be conveniently and easily operated and enable sheets to be optimally and stably separated one by one depending on the rigidity of various sheets.

(3) Furthermore, the surfaces of various sheets accommodated in the media cartridge have different friction characteristics and it is difficult to appropriately change the type of a roller of the sheet supplying device depending on the friction characteristic of the sheet surface, so that an outer peripheral portion of the roller is formed of a single fixed type of material. Consequently, the roller may not optimally and stably supply the sheets depending on the characteristics of the surfaces of the various sheets.

In addition, the roller is made of a material having a high wear resistance but has a predetermined lifetime. Thus, if the lifetime is over, it is necessary that the roller can be easily replaced with a new one.

In view of these points, it is a third object of the present invention to provide a printing liquids and sheets container, a sheet supplying device, and a printing apparatus comprising the same which enable sheets to be optimally and stably supplied depending on the characteristics of the surfaces of the various sheets and which also enable the roller to be easily replaced with a new one.

(4) The only information held by the media cartridge disclosed in the above publication is ID (identification data) data, which are required to allow the cartridge to be recognized by the printing apparatus. Thus, if a new combination of inks and printing media is developed after the printing apparatus has been put on the market, then printing cannot be controlled using printing control parameters optimal for the combination unless programs in the printing apparatus are changed. Consequently, for example, makers cannot conventionally sell new media cartridges comprising such a new combination of inks and printing media.

Additionally, the printing apparatus cannot determine how many printing media remain in the media cartridge, so that the user can neither recognize the number of remaining printing media. This is a disadvantage of the user interface.

The present invention is adapted to solve the above problems, and it is a fourth object of the present invention to provide an inks-and-printing media-integral-type pack wherein various effective information for a printing apparatus or the like as required as well as and a printing apparatus comprising the pack.

SUMMARY OF THE INVENTION

To attain the above described first object, the present invention provides an integral-type pack housing inks and printing media, characterized in that the pack comprises a first portion and a second portion covering part of the first portion, the first and second portions each forming the pack, an opening and closing mechanism for opening and closing the second portion relative to the part of the first portion, and an opening portion formed in the part of the first section covered by the second portion and in which the printing media appears when the latter are housed in the first portion, and in that the if the opening and closing mechanism opens the second portion, a conveying force output from a conveying mechanism forming section for conveying the printing media acts directly or indirectly on the printing media through the opening portion.

Additionally, the present invention provides an integral-type pack housing inks and printing media, characterized in that the pack comprises a first portion and a second portion covering part of the first portion, the first and second portions each forming the pack, an opening and closing mechanism for opening and closing the second portion relative to the part of the first portion, and an opening portion formed in the part of the first section covered by the second portion and in which the printing media appears when the latter are housed in the first portion.

Preferably, the present invention is characterized in that the second portion can house inks.

In another embodiment, there is provided an ink jet printing apparatus that uses a printing head for ejecting an ink to eject the ink from the printing head to printing media for printing, the apparatus being characterized by comprising installation means for removably installing an integral-type pack comprising a first portion and a second portion covering part of the first portion, the first and second portions each forming the pack, an opening and closing mechanism for opening and closing the second portion relative to the part of the first portion, and an opening portion formed in the part of the first section covered by the second portion and in which the printing media appears when the latter are housed in the first portion, the installation means opening the second portion in response to the installation operation, and sheet feeding means that can at least partly contact with the printing media appearing in the opening portion in the first portion when the installation means installs the pack.

Preferably, the present invention is characterized in that the second portion can house inks.

According to the above configuration, the integral-type pack housing the inks and the printing media is divided into the first and second portions, the first portion houses the printing media, while the second portion houses the inks, and the second portion can be opened and closed relative to the part of the first portion.

Accordingly, the pack can be formed such that the second portion housing the inks overlap the part of the first portion housing the printing media.

In addition, since the pack has the opening portion in which the printing media housed in the part of the first portion appear, when the pack is installed in an ink jet printing apparatus, the second portion is opened to uncover the opening portion, while allowing the printing media from the opening portion to come in contact with the sheet feeding means.

Further, since the second portion can be opened and closed relative to the first portion, the pack can be configured such that the second portion can be opened in response to an operation of installing the pack.

To attain the above described second object, a printing liquids and sheets container according to the present invention is characterized in that the container comprises a case main body section removably disposed in a conveying mechanism forming section for conveying sheets to a printing section that performs a printing operation on printing surfaces of the sheets using printing liquids, a sheet accommodating section formed in the case main body section to accommodate the sheets, and a liquid accommodating section formed in the case main body section to accommodate the liquids, and in that the sheets taken out from the sheet accommodating section are discharged when a conveying force output from the conveying mechanism forming section acts on the sheets through a sheet discharging opening portion formed in the case main body section.

Additionally, a sheet supplying device according to the present invention comprises a portable container comprising an accommodation section removably disposed in a conveying mechanism forming section for conveying sheets to a printing section that performs a printing operation on printing surfaces of the sheets using printing liquids, the accommodation section housing the sheets and the liquids, and a sheet discharging opening portion through which the sheets are discharged from the accommodation section; a feeding roller disposed in the conveying mechanism forming section for taking out the sheets through the sheet discharging opening portion and discharging them; and drive means for driving the feeding roller if the portable container is installed in the conveying mechanism forming section.

Furthermore, a printing apparatus comprising a sheet supplying device according to the present invention comprises the above described sheet supplying device, a conveying mechanism forming section having a portable container removably disposed therein, for conveying a sheet discharged from the portable container to a printing section for performing a printing operation on printing surfaces of the sheets, and a control section for controlling operations of the sheet supplying device, the conveying mechanism forming section, and the printing section.

To attain the above described third embodiment, a printing liquids and sheets container according to the present invention comprises a portable container comprising an accommodation section removably disposed in a conveying mechanism forming section for conveying sheets to a printing section that performs a printing operation on printing surfaces of the sheets using printing liquids, the accommodation section housing the sheets and the liquids, and a sheet discharging opening portion through which the sheets are discharged from the accommodation section; and a feeding roller disposed in the conveying mechanism forming section depending on a type of sheets, for taking out and discharging the sheets through the sheet discharging opening portion.

A sheet supplying device according to the present invention comprises a portable container comprising an accommodation section removably disposed in a conveying mechanism forming section for conveying sheets to a printing section that performs a printing operation on printing surfaces of the sheets using printing liquids, the accommodation section housing the sheets and the liquids, and a sheet discharging opening portion through which the sheets are discharged from the accommodation section; a feeding roller disposed in the conveying mechanism forming section depending on a type of sheets, for taking out the sheets through the sheet discharging opening portion and discharging them; and drive means for driving the feeding roller if the portable container is installed in the conveying mechanism forming section. A printing apparatus comprising a sheet supplying device according to the present invention comprises the above described sheet supplying device, a conveying mechanism forming section having a portable container removably disposed therein, for conveying a sheet discharged from the portable container to a printing section for performing a printing operation on printing surfaces of the sheets, and a control section for controlling operations of the sheet supplying device, the conveying mechanism forming section, and the printing section.

To accomplish the above described fourth object, the present invention provides an inks-and-printing media-integral-type pack that can accommodate inks and printing media used in a printing apparatus, the pack being characterized by comprising storage means that enables information on the pack to be rewritten.

The present invention provides a printing apparatus that uses an inks-and-printing media-integral-type pack accommodating inks and printing media and that can record images using the inks and printing media supplied from the ink-and-printing media-integral-type pack, the printing apparatus being characterized in that as the above inks-and-printing media-integral-type pack, the ink-sand-printing media-integral-type pack of the present invention can be used.

As is apparent from the above description, according to the present invention, the integral-type pack housing the inks and the printing media is divided into the first and second portions, the first portion houses the printing media, while the second portion houses the inks, and the second portion can be opened and closed relative to the part of the first portion. Accordingly, the pack can be formed such that the second portion housing the inks overlap the part of the first portion housing the printing media.

In addition, since the pack has the opening portion in which the printing media housed in the part of the first portion appear, when the pack is installed in an ink jet printing apparatus, the second portion is opened to uncover the opening portion, while allowing the printing media from the opening portion to come in contact with the sheet feeding means.

Further, since the second portion can be opened and closed relative to the first portion, the pack can be configured such that the second portion can be opened in response to an operation of installing the pack.

As a result, printing can be achieved with a simple configuration in such a manner as to exhibit various printing characteristics, and in particular, there are provided an inks-and-printing media-integral-type pack that takes the size of the apparatus into account and that can be handled easily, as well as an ink jet printing apparatus that allows this integral-type pack to be installed therein.

According to the present invention, sheets taken out from the sheet accommodating section are discharged by causing the conveying force output from the conveying mechanism forming section to act on the sheets through the sheet discharging opening portion formed in a case main body section. Consequently, the sheets are discharged while the printing liquids and sheets container remains installed. Therefore, the present invention provides improved convenience.

Additionally, the present invention further comprises a cover member disposed in the case main body section so as to be opened and closed relative to the sheet discharging opening portion, the cover member selectively covering the sheet discharging opening portion, and the cover member further comprises a guide member guided while engaging with an engagement section in response to an operation of installing the case main body section, the engagement section being separated from a portion of the conveying mechanism forming section in which a sheet accommodating section of the case main body section is arranged, so that the cover member is automatically shifted from a closed state to an open state relative to the sheet discharging opening portion by means of cooperation between the guide member and the engagement section, thereby accomplishing easier handling.

Further, sheet separating means is provided at an end portion of a sheet discharging section of the sheet accommodating section to sequentially discharge sheets discharged from the sheet accommodating section after separating them sheet by sheet, and a separating surface acting as the sheet separating means is set depending on rigidity of the sheets housed in the sheet accommodating section. Consequently, the sheets can be optimally and stably separated one by one depending on the rigidity of the various sheets.

According to the present invention, the feeding roller is disposed in the portable container depending on the type of the sheets, for discharging them through the opening portion. As a result, the sheets can be optimally and stably supplied depending on characteristics of surfaces of the various sheets and the roller can be easily replaced with a new one.

According to the present invention, the inks-and-printing media-integral-type pack comprises the storage means that enables information on the pack to be rewritten. Therefore, various information can be stored in the pack as required so as to be effectively used for the pack, the printing apparatus, or the like.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below in detail with reference to the drawings.

Figure 1:
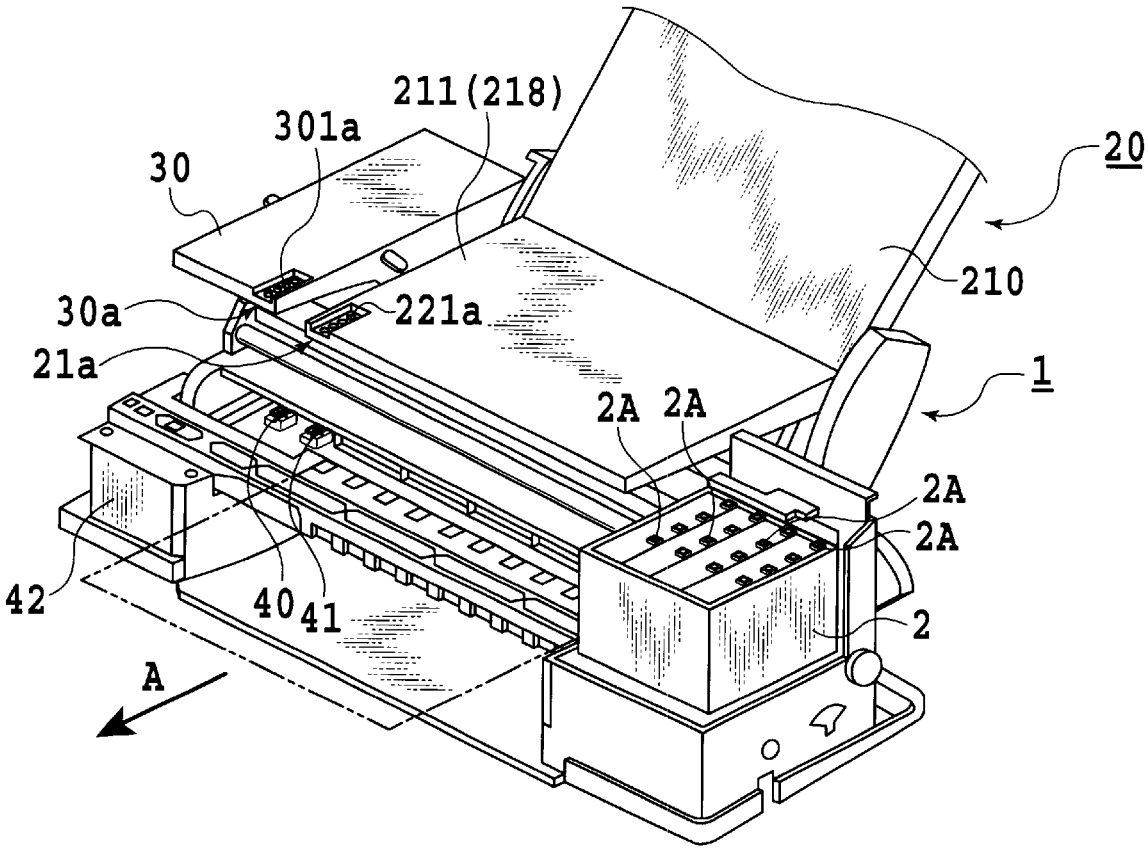
FIG. 1 is a schematic perspective view showing the entire configuration of an ink jet printer to which an example of a sheet supplying device and a printing apparatus comprising the same according to the present invention is applied.
Figure 2:
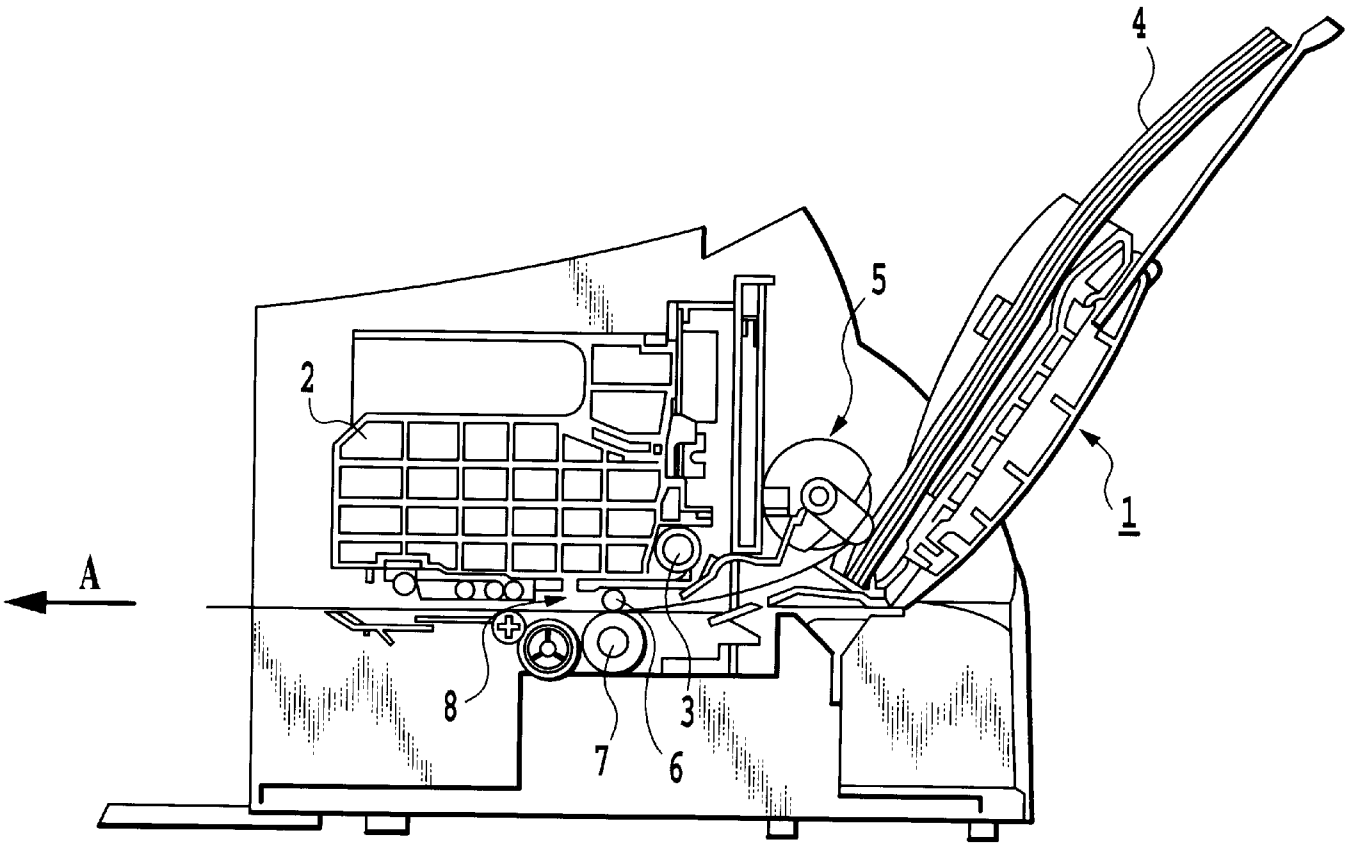
FIG. 2 is a sectional view showing an integral part of a sheet conveying section of the printer shown in FIG. 1.

FIG. 1 is a schematic perspective view showing an ink jet printer that is one embodiment of a printing apparatus comprising an example of a sheet supplying device according to the present invention. FIG. 2 is a sectional view of an integral part of the printer shown in FIG. 1, principally showing a sheet feeding mechanism from a side of the printer.

As shown in FIG. 1, an ink jet printer according to this embodiment can use a pack 20 (hereafter also referred to as an "ink media pack") comprising an ink housing section and a printing media housing section integrated therewith for housing printing media such as paper, the pack being removably installed in the printer. That is, the ink media pack 20 is removably installed in an automatic sheet feeding device (hereafter also simply referred to as an "ASF") 1 installed in the printer main body. When the pack is installed, its printing media housing section 210 lie along the position of the ASF 1, while an ink housing section 211 is separated from the printing media housing section 210 in response to the installation operation as described later and maintains a horizontal position. Printing media housed in the ink media pack 20 are those selected in connection with a small pore diameter of an ink receiving layer or textiles used for textile printing as described above, and are used for relatively special applications. Correspondingly, inks housed in the ink media pack 20 can appropriately dye fine pores or fibrous materials constituting the textiles. In this manner, the ink media pack 20 is used to appropriately combine printing media with inks. To print an image on an paper, paper inks (inks for use on a paper) housed in the printer main body are used for a paper installed in the ASF 1.

FIG. 2 shows how the paper 4 is installed in the ASF 1 in the above case, wherein the paper 4 is directly installed in the ASF 1 with the ink media pack 20 removed from the printer. Additionally, the inks are housed in a paper ink refilling unit 30 previously installed in the printer main body and arranged in parallel with the ink media pack 20 as installed as shown in FIG. 1, and from which inks for paper are supplied.

A carriage 2 is provided so as to be movable along a guide shaft 3 (see FIG. 2) provided in such a fashion substantially traversing the printer main body. The carriage 2 has four printing heads (not shown) for ejecting inks, which are mounted thereunder depending on the types of inks that can be simultaneously supplied. The printing heads can thus execute scanning by moving in a sheet width direction of printing media conveyed in a printing area 8 (see FIG. 2), while ejecting inks depending on printing information.

The carriage 2 of this embodiment has ink supply ports 2A at its top as shown in FIG. 1. That is, the ink supply ports 2A comprise four such ports (2ABk, 2AC, 2AM, 2AY) so as to correspond to the four printing heads, and are each in communication with a sub-tank (not shown) formed adjacent to the corresponding each printing head, via an ink and air input port, as described later. The carriage 2 moves with predetermined timings as described later to move the ink supply ports to a position corresponding to a supply section 21*a* of the ink media pack 20 or a supply section 30*a* of the paper ink refilling unit 30. Additionally, at this corresponding position, an ink ejection port in the printing head also faces a cap 41 or a cap 40 corresponding to the paper 4. Thus, operations of supplying the ink to the sub-tank for each printing head, replacing the ink, and recovering ejection can be performed as described later. For this ink supply and replacement, a pressure mechanism (not shown) provided in the printer main body and comprising a cam, a push-in pin, and others and which engages with a pressure section 221*a* of the ink media pack 20 or a pressure section 301*a* of the paper ink refilling unit 30 can perform predetermined operations to supply or replace the inks.

Specifically, for the ink supply and replacement as above, the carriage 2 moves to cause its ink supply port 2A to reach a position corresponding to the supply section 21*a* or 30*a*, and a carriage elevating mechanism (not shown) with a cam rotates the entire carriage 2 using a guide shaft 3 (see FIG. 2) as a rotation axis. An ink leakage preventing member of the ink supply port 2A is brought into tight contact with a joint section of the ink housing section of the ink media pack 20 or a joint section of the paper ink refilling unit 30. Subsequently, the cap 41 or 40 elevates to come into abutment with the printing head or the like mounted under the carriage 2, thereby enabling the ink supplying or replacing operation.

Still, for the ejection recovering process, of course the carriage elevating mechanism does not operate but the cap 41 or 40 only elevate to come into abutment with the printing head. In addition, the tight contact between the ink supply port 2A and each of the above described joint sections can be canceled by performing an operation reverse to the above described one performed by the carriage elevating mechanism. Furthermore, this operation of,a cam in the elevating mechanism is achieved by a driving force of a motor; driving control of the motor for elevating or lowering the carriage is performed and to move the carriage 2, driving control of the motor is performed for allowing the cam to retreat to a position where it does not engage with the carriage 2.

Additionally, for the ink supply and replacement as above, the pressure mechanism (not shown) provided in the printer main body and comprising the cam, the push-in pin, and others performs predetermined operations. The operation for the ink supply or replacement is accomplished when the push-in pin engages with a predetermined member of the pressure section 221*a* of the ink media pack 20 or of the pressure section 301*a* of the paper ink refilling unit 30. Further, a recovery mechanism 42 is provided substantially under the caps 40 and 41. The recovery mechanism 42 comprises a suction pump or the like used for the above described ink supplying and replacing operations and ejection recovering operation.

With the above configuration, for printing, first, a sheet-feeding roller unit 5 (see FIG. 2) provided in the ASF 1 supplies printing media directly from the ink media pack 20 or the ASF 1 to the printing area 8. Then, as shown in FIG. 2, for each scanning by the printing head installed in the carriage 2, the sheet-feeding roller 7 and the pressure roller 6 cooperate with each other in feeding a printing medium in a direction shown by an arrow A in the figure, by a predetermined amount for each feeding operation, so that images are sequentially printed on a printing surface of the printing medium, which is then discharged as shown by a chain double-dashed line in FIG. 1.

As is apparent from the arrangement of each of the elements chiefly shown in FIGS. 1 and 2, the printing media housing section 210 and ink housing section of the ink media pack 20 has an arrangement relationship that is appropriate particularly for installation in a printer. That is, the ink housing section 211 is opened and closed relative to the printing media housing section 210 and is arranged so as to overlap the part of the printing media housing section. When installed, the ink housing section 211 can be partly located over the movement area of the carriage (the printing head).

This arrangement contributes to downsizing the printer. For example, if the ink media pack is configured such that the ink housing section is arranged at a side of the printing media housing section in parallel therewith, the dimension of the ink media pack in this lateral direction increases, thereby requiring the printer to be enlarged. In addition, if the ink media pack is configured such that the ink housing section is arranged in a fashion overlapping the rear side of the printing media housing section, the dimension of the printer in this thickness direction, thereby making it relatively difficult to provide a ink supply passage. Contrary to this, in this embodiment, the ink media pack is configured such that the ink housing section 211 can be opened and closed relative to the printing media housing section and can be partly located over the movement area of the carriage as described above, the size of the printer need not be increased as described above.

In addition, according to the above arrangement of this embodiment, the distance between the carriage 2 (printing head) and the ink housing section 211 can be reduced, thereby reducing the size of the ink supplying passage relative to the printing head and simplifying the configuration of the ink supplying passage.

Figure 3:
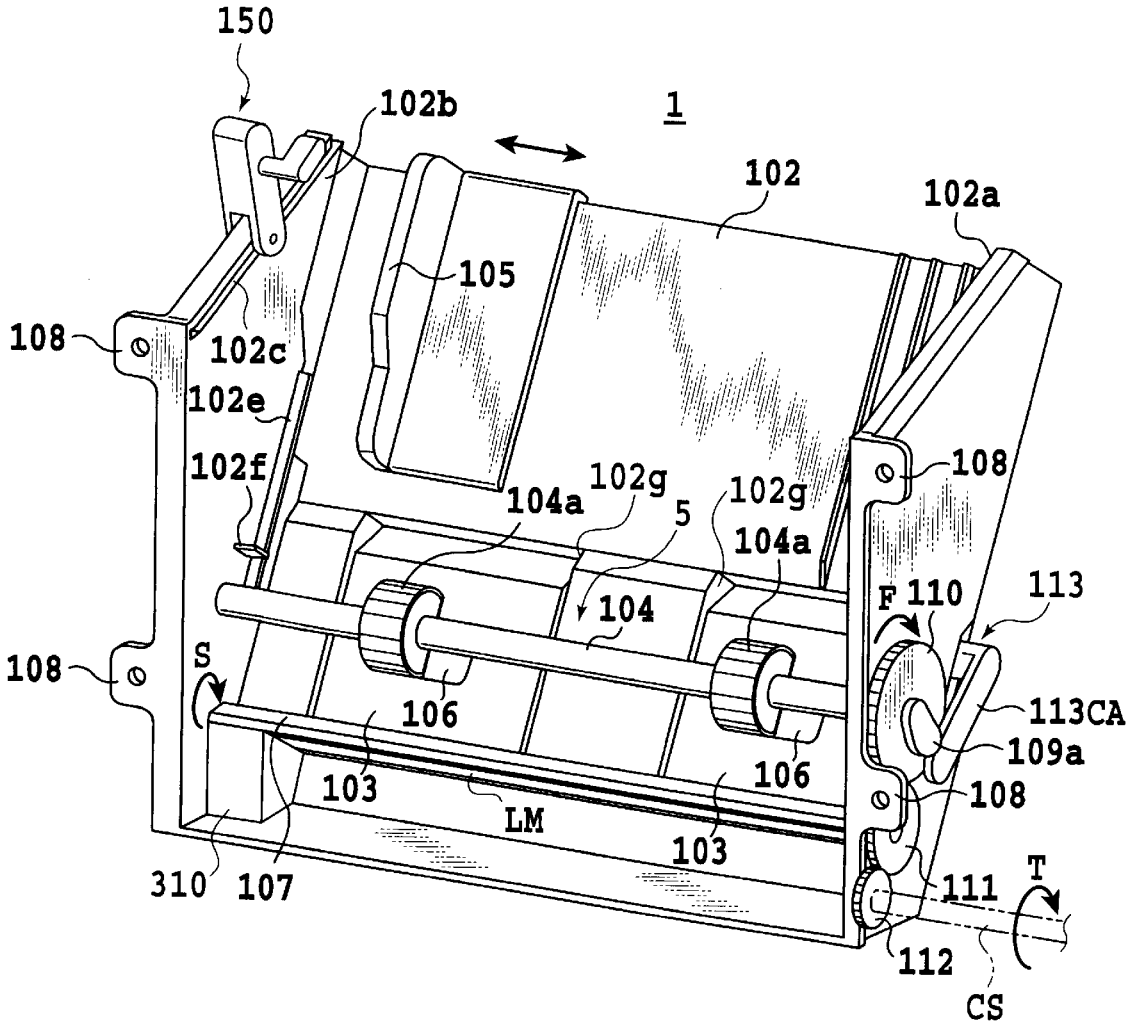
FIG. 3 is a perspective view of an automatic sheet feeding device (ASF) in the example shown in FIG. 1.

FIG. 3 is a perspective view showing the detailed configuration of the ASF 1.

As shown in this figure, the ASF 1 comprises a base 102 having a base left-hand plate 102*b* and a base right-hand plate 102*a* provided at opposite ends thereof and opposite to each other, a sheet feeding roller unit 5 disposed in a base 102, pressure plates 103 each disposed in a corresponding one of two recesses 102*g* formed in the base 102 opposite to the sheet feeding roller unit 5, a movable side guide 105 disposed so as to enable to slide on a flat portion of the base 102, and other components.

Figure 5:
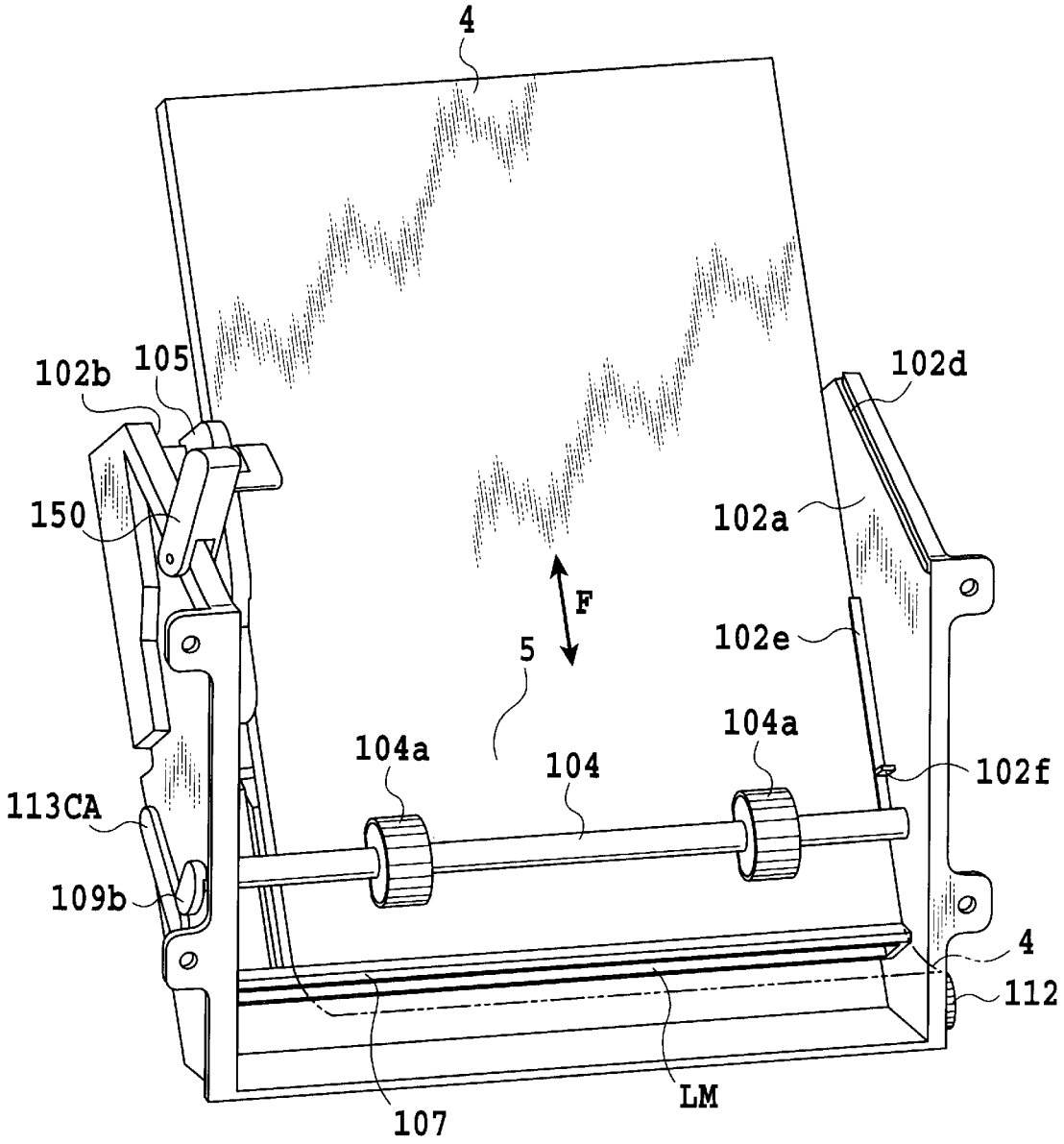
FIG. 5 is a perspective view showing how paper is loaded in the automatic sheet feeding device shown in FIG. 3.
Figure 10:
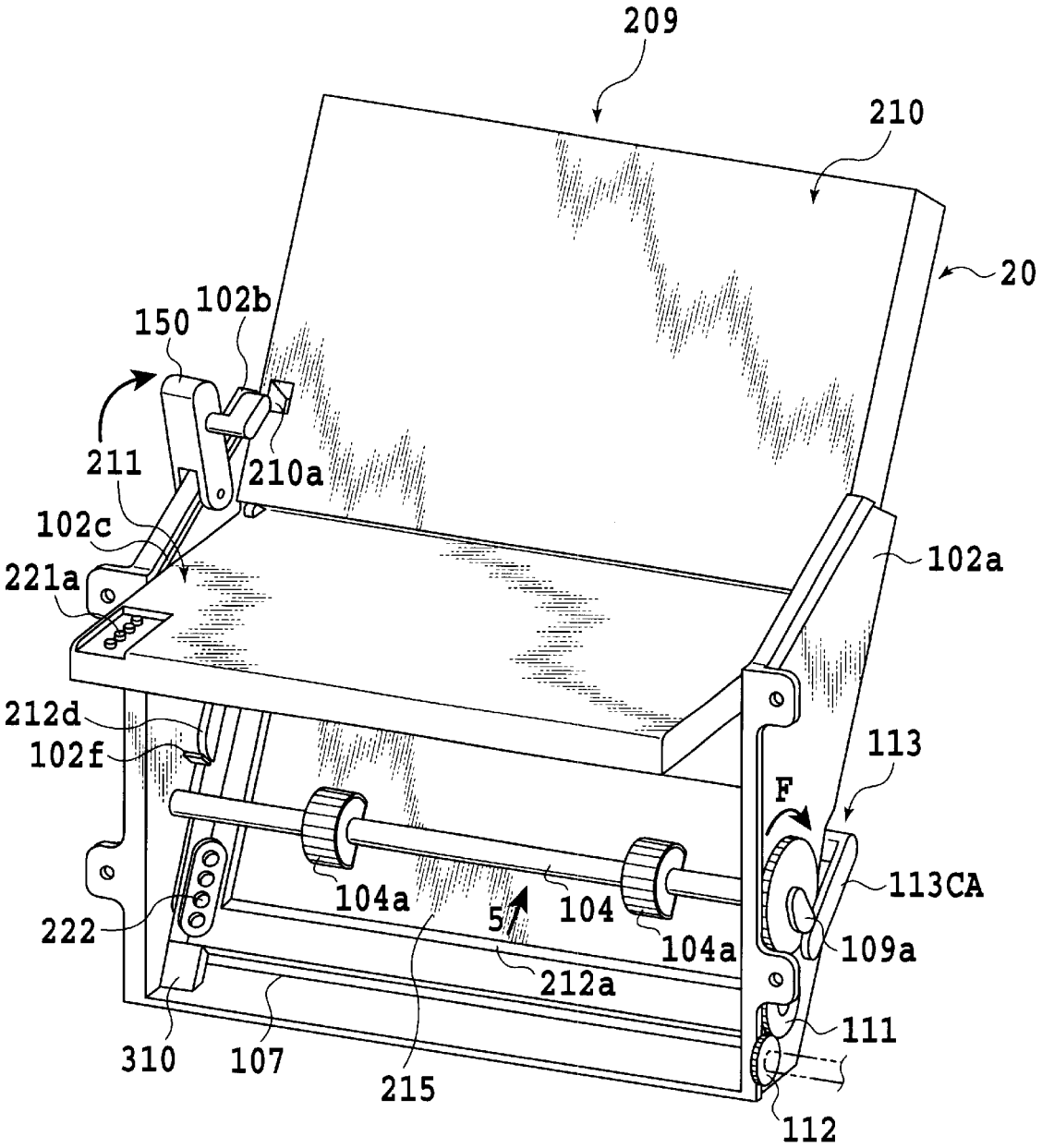
FIG. 10 is a perspective view showing how the ink media pack shown in FIG. 6 is installed in the automatic sheet feeding device shown in FIG. 3.

An accommodation section of the base 102 is inclined from the printer main body through 30 to 60° to support paper 4, if used, as shown in FIG. 5. On the other hand, if the printing media 200 housed in the ink media pack are used, the accommodation section of the base 102 support the installed pack in itself, as shown in FIG. 10.

The base 102 is fixed to the printer main body by supporting, on the printer main body, a fixed portion 108 provided at one end surface of each of the base left-hand plate 102*b* and the base right-hand plate 102*a*. The fixed portion 108 forms a periphery of an opening portion through which the printing medium 200 or paper 4 passes. Thus, a space surrounded by the base left-hand plate 102*b*, the base right-hand plate 102*a*, and the fixed portions 108 is open frontward and upward.

The base left-hand plate 102*b* and the base right-hand plate 102*a* have guide grooves 102*c* and 102*d*, respectively, formed in their inner side surfaces and with which guide bosees 218*b* of the ink media pack 20, described later, are engaged. The guide grooves 102*c* and 102*d*, the upper end side of which is open, extend in parallel toward the fixed portions 108 along top surfaces of the base left-hand plate 102*b* and the base right-hand plate 102*a*, respectively, over a predetermined length. In addition, an introduction guide 102*e* for guiding a media case 212 of the ink media pack 20 is provided in a portion where the flat surface portion of the base 102 crosses the inner side surface of the base left-hand plate 102*b* and base right-hand plate 102*a*. Each introduction guide 102*e* has a stopper 102*f* on its lower end side for limiting the media case 212 to a predetermined position.

Figure 11:
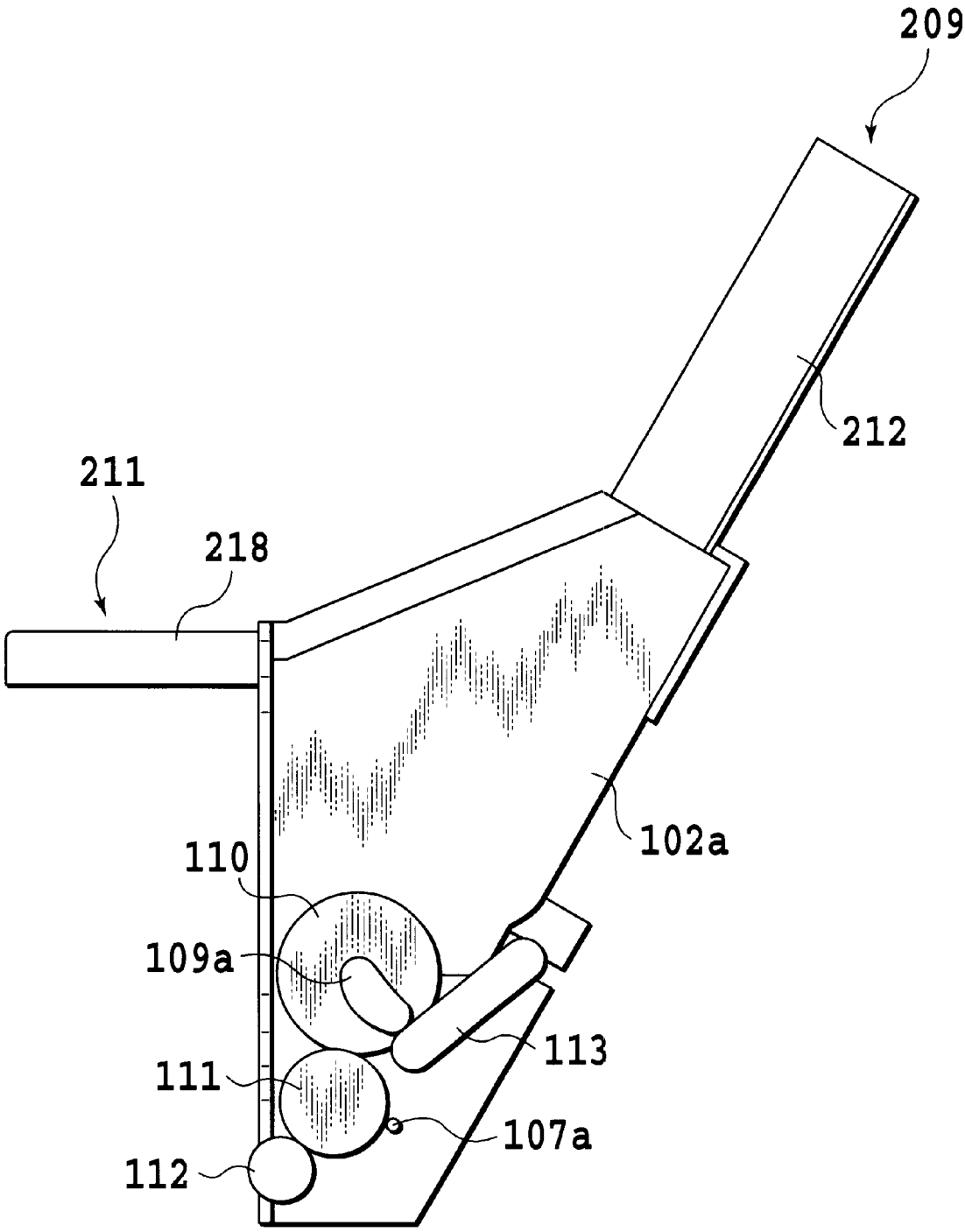
FIG. 11 is a side view of the state shown in FIG. 10.

A position limiting member LM having a separating surface 107 is provided in such a manner as to be rotationaly moved below the flat surface portion of the base 102. Opposite ends of the position limiting member LM are supported by the base left-hand plate 102*b* and the base right-hand plate 102*a* via a rotation axis 107*a* so as to be rotationally moved, as shown in FIG. 11. The position limiting member LM is urged by a spring (not shown) in the direction shown by an arrow S in FIG. 3. Thus, the position limiting member LM can maintain a predetermined position for supporting the above described paper 4 as shown in FIG. 5.

The separating surface 107 provides a basic function of applying a predetermined resistance to a tip of paper 4 fed by the sheet feeding roller unit 5 when paper 4 has been directly mounted in the ASF 1, as shown in FIG. 5, thereby restricting the tip of paper 4 to separate the sheets one by one. The separating surface 107 also provides a function of supporting lower ends of plural laminated sheets of paper 4 in such a manner that the ends are flush with one another.

Figure 12:
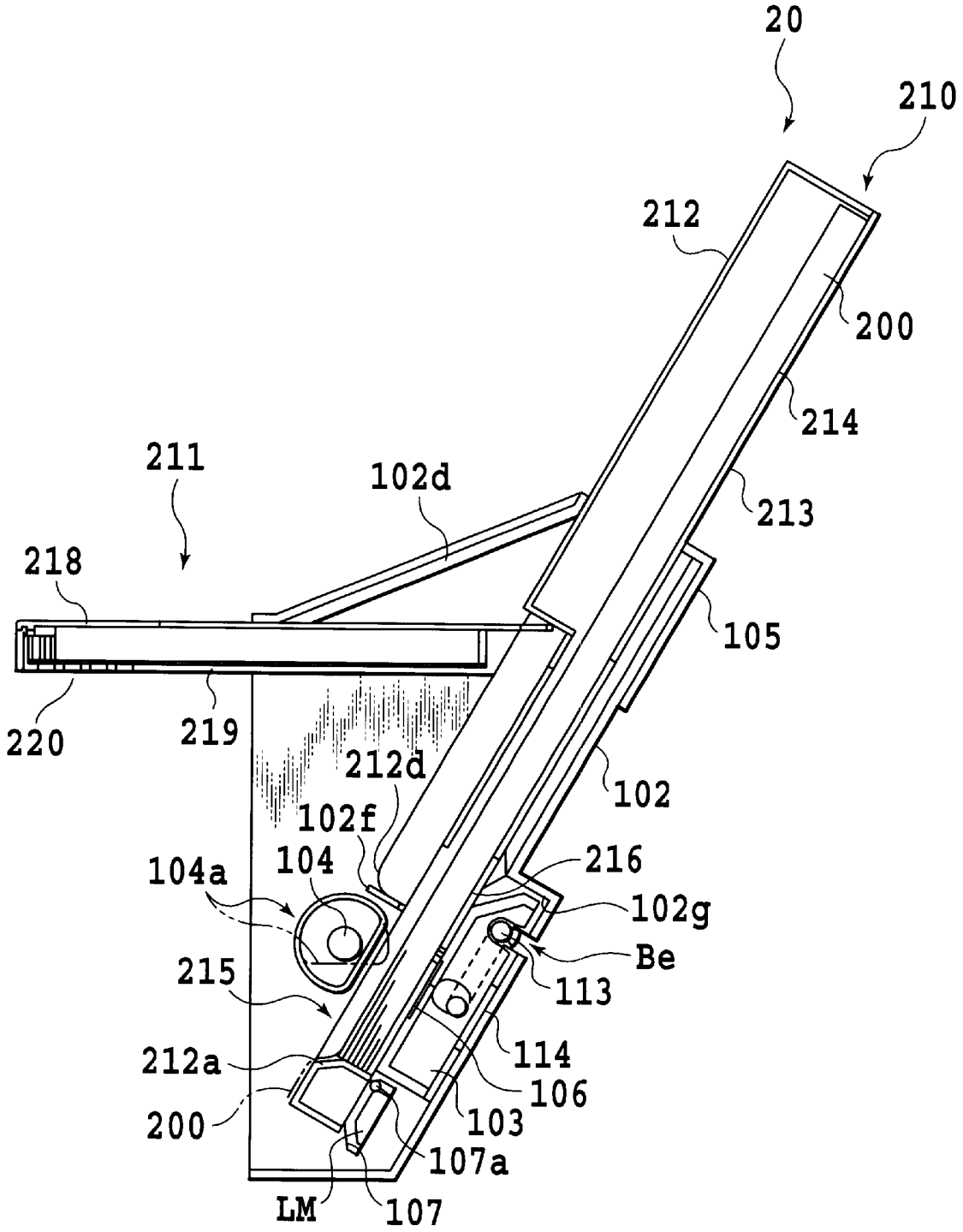
FIG. 12 is a partial sectional view of the state shown in FIG. 10, as seen from a side surface side.

On the other hand, when the ink media 20 pack is installed in the ASF 1, the separating surface 107 is pressed by the lower end of the ink media pack 20 in connection with the installation operation as shown in FIG. 12 and is thus rotated against an urging force of the above mentioned spring to recede in a direction opposite to that shown by the arrow S.

A side guide 105 is provided so as to slide in a width direction of paper 4 installed on the flat surface portion of the base 102, that is, in the direction shown by the arrow in FIG. 3 so that when paper 4 is set in the ASF 1, a width-wise position of paper 4 can be restricted depending on its size. That is, in setting paper 4 in the ASF 1, the width direction of paper 4 can be restricted by using the base right-hand plate 102*a* as a referential plane to abut one side end of paper 4 on the base right-hand plate 102*a*, while abutting the side guide 105 on the other side end of paper 4.

On the flat surface of the base 102, the two recesses 102*g*, in each of which the pressure plate 103 is provided, are formed above the position limiting member LM and adjacent to each other and separated from each other by a predetermined distance, as shown in FIGS. 3 and 12.

Figure 4:
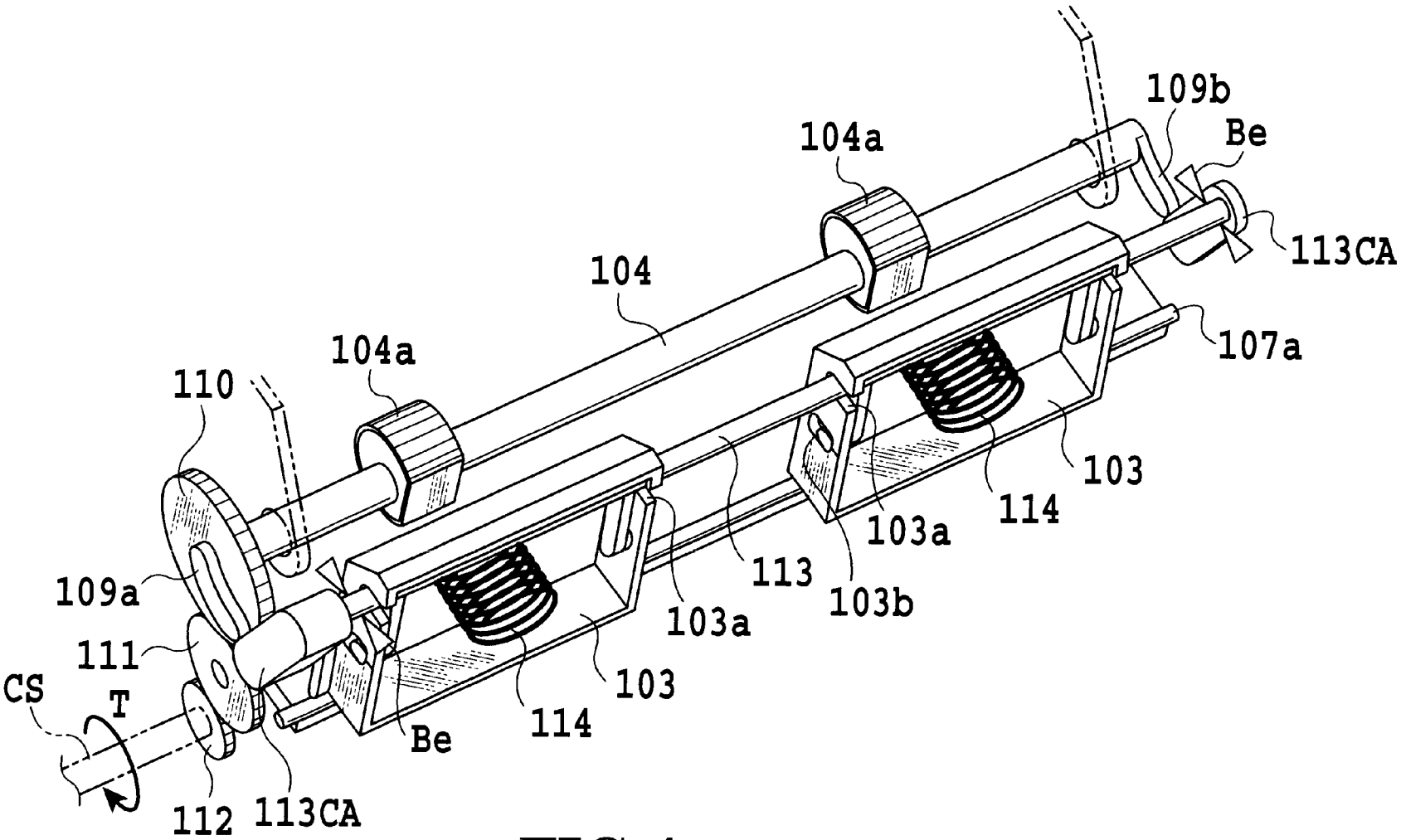
FIG. 4 is a perspective view showing an integral part of a drive mechanism provided in the automatic sheet feeding device shown in FIG. 3.

The two pressure plates 103 are connected together by fixing a shaft portion of a pressure plate releasing lever 113 to a pair of notches 103*a* as shown in FIG. 4. Additionally, arm portions provided on the shaft portion are connected to a pair of slits 103*b* formed near the notches 103*a* in the pressure plates 103. The shaft portion has cam surface portions 113CA integrally formed at opposite ends thereof in such a manner as to extend perpendicularly to an axis thereof.

Thus, the cam surface portions 113CA and the shaft portion are fixed relative to the pressure plates 103 in a predetermined angular relationship.

At the same time, the cam surface portions 113CA located at the both ends of the pressure releasing. lever 113 are abutted, due to urging forces of pressure plate springs 114, on pressure plate cams R109*a* and R109*b* provided in the sheet feeding roller unit 5, described later. Additionally, inner portions of the cam surface portions 113CA located at opposite ends of the shaft portion are movably supported by bearing portions Be formed on the base left-hand plate 102*b* and the base right-hand plate 102*a*.

The pressure plate spring 114 is provided between an inside of each pressure plate 103 and a bottom portion of the corresponding recess 102*g*, as shown in FIGS. 4 and 12, to urge the pressure plate 103 toward the sheet feeding roller unit 5. The pressure plates 103 and the pressure plate springs 114 are provided behind the corresponding pressure plates 103 at positions substantially corresponding to roller portions 104*a* of the sheet feeding roller unit 5.

Thus, the pressure plates 103 each have its outer peripheral surface guided by a wall surface forming the recess 102*g*, so as to slide altogether perpendicularly to the flat surface portion of the base 102.

Thus, if the pressure plate cams R109*a* and L109*b* are rotationally moved through a predetermined rotational angle to press the cam surface portions 113CA located at the opposite ends of the pressure releasing lever 113, the pressure plates 103 are pressed against the urging forces of the pressure plate springs 114 to recede until they and housed in the corresponding recesses 102*g*, as shown in FIG. 12. When the pressure plate cams R109*a* and L109*b* are further rotationally moved after the rotational movement through the predetermined rotational angle, the top of each pressure plate 103 is projected from the recess 102*g* due to the urging force of the pressure plate spring 114 and come into abutment with paper 4 or the ink media pack 20. FIGS. 3 and 4 show that the pressure plates 103 have been fully pushed in the recesses 102*g*.

Paper 4 or printing media 200 housed in the ink media pack 20 due to the urging forces of the pressure springs 114 are urged against the sheet feeding roller unit 5. The pressure plates 103 located opposite the corresponding roller portions 104*a* of the sheet feeding roller unit 5 each have a separating pad 106 on its top surface, which is composed of a material such as an artificial leather which has a relatively large friction coefficient, in order to prevent overlapping feeding or the like which may occur when there are little paper 4 placed in that.

The sheet feeding roller unit 5 is an integral molding of plastics or the like which comprises the shaft portion 104 rotatably supported by the right-hand plate 102*a* and left-hand plate 102*b* integrally provided at the opposite ends of the plate 102, and the two roller portions 104*a* fixed around the shaft portion 104 at a predetermined interval.

The opposite ends of the shaft portion 104, extending in a direction substantially orthogonal to the sheet feeding direction shown by an arrow F in FIG. 5, are supported by the base left-hand plate 102*b* and the base right-hand plate 102*a* so as to be rotationally moved. The shaft portion 104 has the pressure plate cam L109*b* provided at one end thereof and brought into sliding contact. with the cam surface portion 113CA, as shown in FIGS. 4 and 5. The pressure plate cam L109*b*, as an eccentric cam, has a rotating center corresponding to a center of an axis of the shaft portion 104 of the sheet feeding roller unit 5, described later, and the contour of the pressure plate cam L109*b* is formed to be subjected to a maximum displacement at one end thereof which is decentered from the rotating center by a predetermined distance. Additionally, the shaft portion 104 has at the other end, a sheet feeding roller gear A110 and the pressure plate cam R109*a* installed outside it. The pressure plate cam L109*a* has a rotating center corresponding to a center of the axis of the shaft portion 104 of the sheet feeding roller unit 5, and the contour of the pressure plate cam L109*a* is formed to be subjected, synchronously with the pressure plate cam L109*b*, to a maximum displacement at one end thereof which is decentered from the rotating center by a predetermined distance. The pressure plate cams R109*a* and L109*b* are always in abutment with the cam surface portions 113CA without leaving them, the cam surface portions 113CA being urged by the urging forces of the above described pressure plate springs 114.

The sheet feeding roller gear A110 is meshed with a sheet feeding roller gear B111 supported on an outer plane portion of the base right-hand plate 102*a* so as to be rotationally moved. The sheet feeding roller gear B111 is meshed with a sheet feeding roller gear C112 supported on the same plane so as to be rotationally moved. The sheet feeding roller gear C112 is connected via a connecting shaft CS to a predetermined drive source provided in the apparatus main body.

Thus, as shown in FIG. 3, when a clockwise rotational moving force T is transmitted to the sheet feeding roller gear C112 via the connecting shaft CS, the pressure plate cams R109*a* and L109*b* are rotationally moved in the direction shown by the arrow F via the sheet feeding roller gear B111 together with the roller portion 104*a* and the shaft portion 104.

In this case, the pressure cams R109*a* and L109*b* have their phases set relative to the rotational angle of the shaft portion 104 so that when paper 4 or the ink media pack 20 is set and when former-period rotations of the pressure plate cams R109*a* and L109*b* subject their contours to the maximum displacement, that is, the pressure plates 103 are fully pushed in the recesses 102*g*, the flat surface portions of the roller portions 104*a*, which constitute chords of their sectional shapes, are located opposite the corresponding pressure plates 103, as shown in FIG. 3. This forms a fixed space between the sheet feeding roller unit 5 and the pressure plates 103 (initial state) to enable paper 4 or the ink media pack 20 to be set.

Additionally, the roller portion 104*a* has a roller rubber attached to its outer peripheral surface constituting its circumferential portion, to generate a larger conveying force when the printing media including paper 4 are fed. Specifically, the outer peripheral surface of the roller portion 104*a* has a generally D-shaped (or half-moon-shaped) cross section. This enables the stacked printing media to be appropriately fed sheet by sheet. In addition, the two roller portions 104*a* are located on the shaft portion 104 about 40 and 170 mm away from a referential position for paper 4 on the base right-hand plate 102*a* (on the inner surface of the base right-hand plate 102*a*).

Accordingly, if printing media such as those of an A4 size which are relatively wide are used, the two roller 104*a* are used for sheet feeding. If, for example, those which have a width corresponding to postcards or the like are used, one of the roller portions 104*a* which is closer to the base right-hand plate 102*a* is used for a sheet feeding operation.

In addition, the sheet feeding roller unit 5 has a roller sensor (not shown) to detect rotational phases of the roller portions 104*a* of the sheet feeding roller unit 5 as well as slide positions of the pressure plates 103, moving synchronously with the sheet feeding roller unit 5 by matching their phases with that of the sheet feeding roller unit 5, thereby determining control timings for a sheet feeding sequence for paper 4 and the printing media 200 in the ink media pack 20.

For example, as shown in FIG. 5, while paper 4 is being fed, predetermined latter-period rotations of the above mentioned pressure plate cams R109*a* and L109*b* cause the pressure plates 103 to approach the sheet feeding roller unit 5 due to the urging forces of the pressure plate springs 114.

This causes an arc-shaped portions of the roller portions 104*a* of the sheet feeding roller unit 5 to come in abutment with the top surface of the top sheet of paper 4.

As the arc-shaped portions of the roller portions 104*a* are further rotated, frictional force is applied to paper 4 in the sheet feeding direction (the direction shown by the arrow F in the figure). At this time, the second sheet of paper 4 from the top and the subsequent sheets undergo a relatively weak frictional force generated between the sheets, paper 4 is hindered from moving in the sheet feeding direction due to resistance from the separating surface 107. Thus, only the top sheet of paper 4 rides on the separating surface 107 and is thus separated from the other sheets; it is then fed beyond the separating surface 107 as shown by a chain double-dashed line.

Subsequently, the separated and fed paper 4 is fed to printing paper feeding section. The sheet feeding roller 5 is rotated until all paper 4 is fed to the printing media feeding section, and the pressure plates 103 then enters the above described initial state relative to the sheet feeding roller unit 5. In this case, the rotational driving forces of the roller portions 104*a* of the sheet feeding roller unit 5 which are applied to paper 4 are blocked and this state is maintained.

After the paper placed on the pressure plate 103 of the ASF 1 or the paper 4 composed of a synthetic resin or the like has thus been fed by the sheet feeding roller unit 5, the sheet feeding roller 7 (see FIG. 2) conveys the paper 4 to the printing position opposite to the printing head in order to print.

Next, the configuration of the ink media pack 20 removably installed in the ASF 1, described above, will be described.

Figure 6:
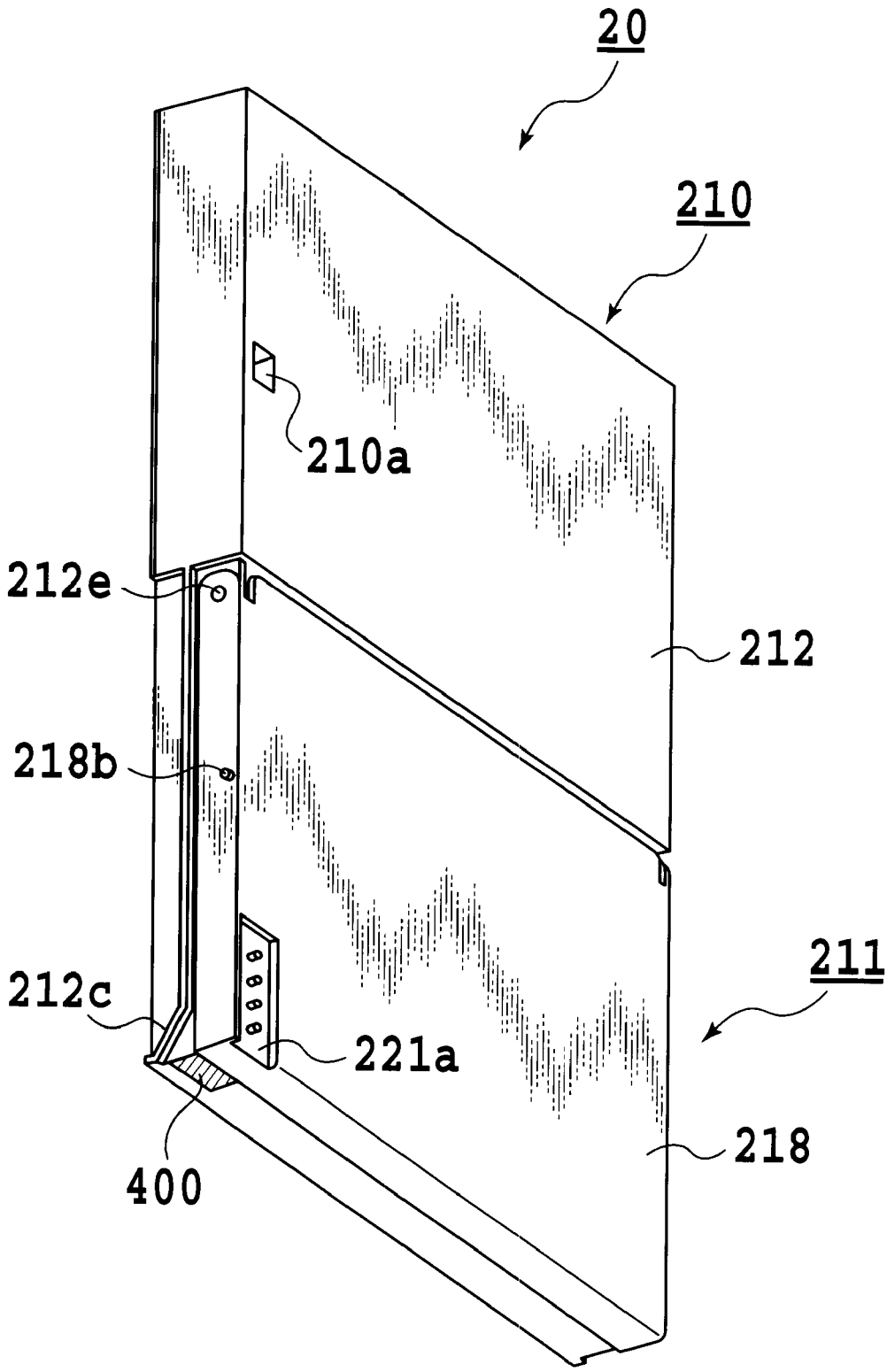
FIG. 6 is a perspective view showing how an ink media pack appears which is used for the example of the sheet supplying device and the printing apparatus comprising the same according to the present invention.
Figure 7:
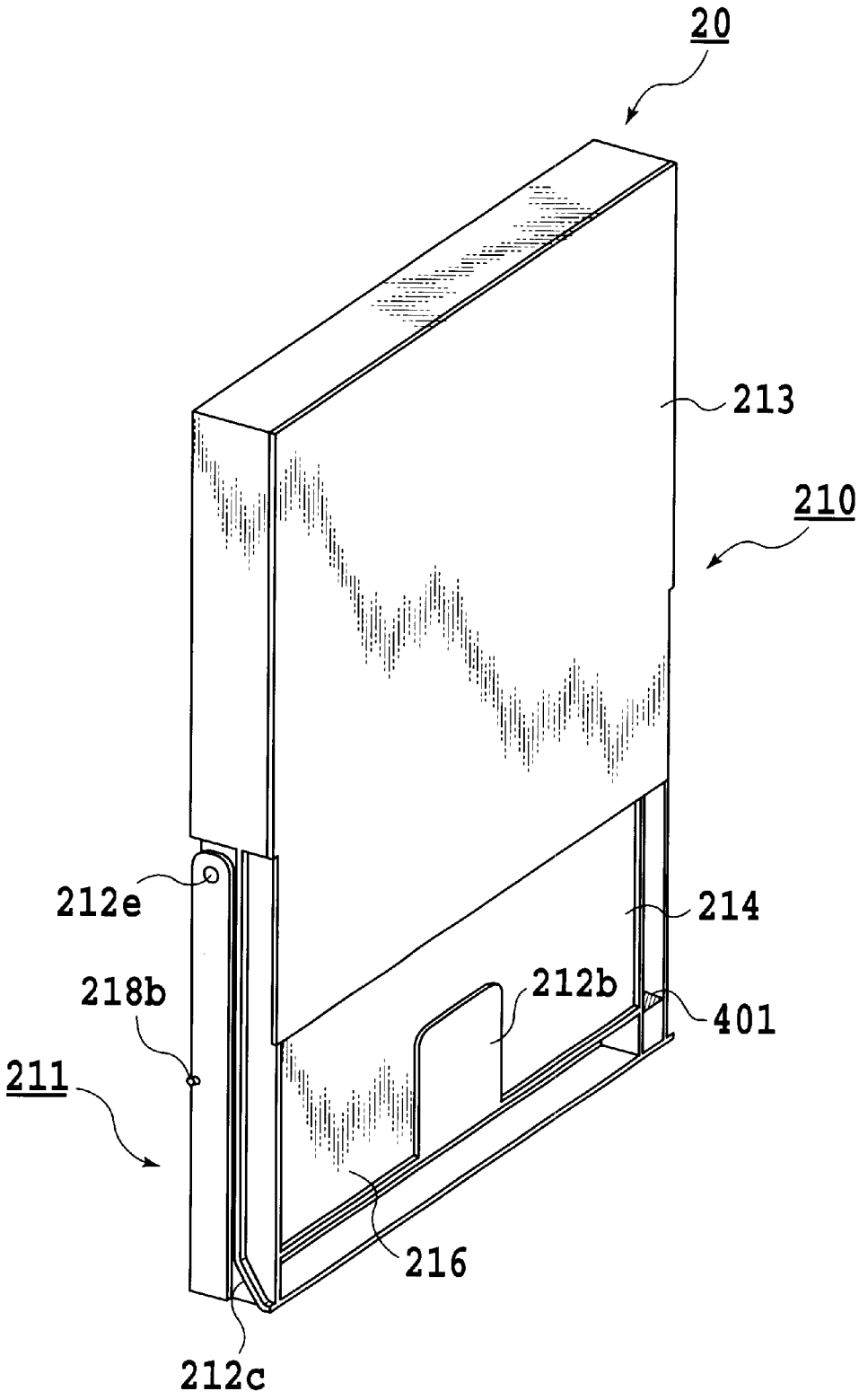
FIG. 7 is a perspective view showing a rear side of the ink media pack shown in FIG. 6.
Figure 8:
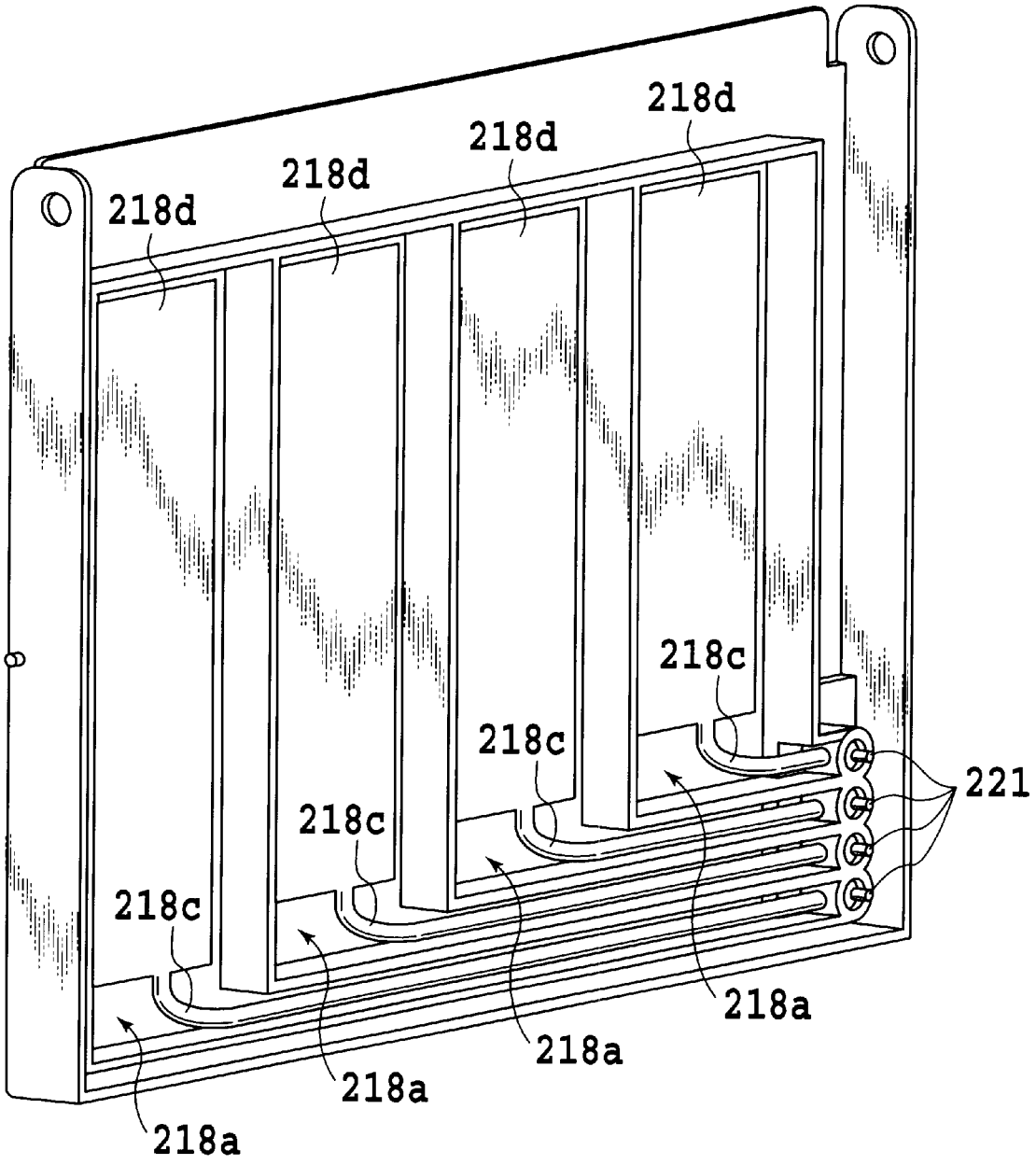
FIG. 8 is a perspective view showing the internal configuration of an ink housing section of the ink media pack shown in FIG. 6.
Figure 9:
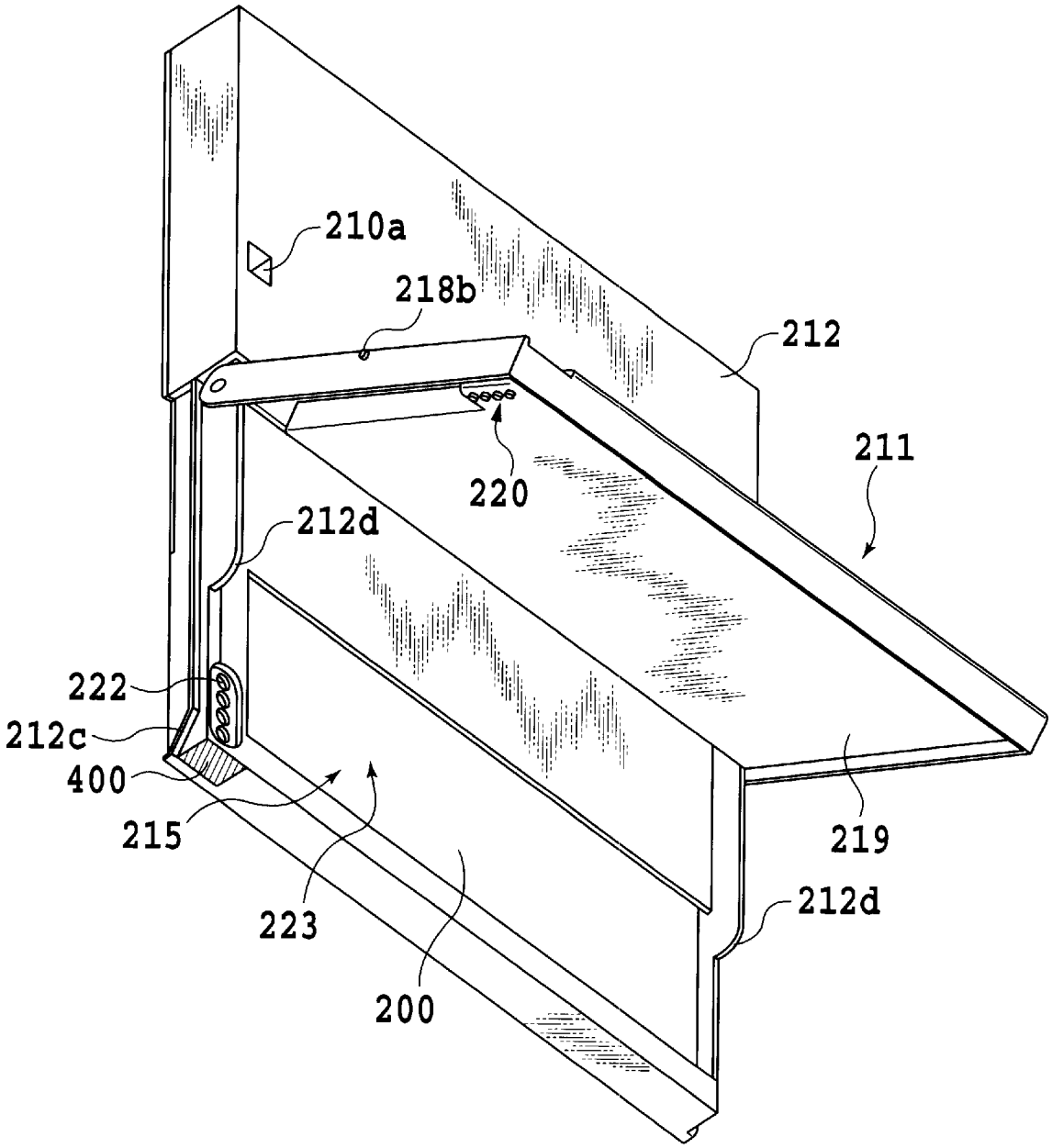
FIG. 9 is a perspective view showing how the ink housing section of the ink media pack shown in FIG. 6 is open relative to a printing media housing section.

FIGS. 6 to 9 show the configuration of the ink media pack 20. FIG. 6 is a perspective view of the ink media pack 20 as seen from its front side, FIG. 7 is a perspective view thereof as seen from its rear side, FIG. 8 is a perspective view showing the interior of the ink housing section of the ink media pack 20, and FIG. 9 is a perspective view showing how the ink housing section on the front side of the ink media pack 20 is separated from a main body side thereof so as to be opened.

The ink media pack 20 houses an optimal combination of printing media and inks corresponding to various printing characteristics and enables the printing mode to be automatically set by means of its installation, as described previously. That is, this embodiment prevents a user from mistakenly determining a combination of printing media and inks in principle if optimal types of inks in terms of the printing characteristics vary with the material or composition of printing media even if the latter appear the same to the user, and also enables a printing mode suitable for the combination of installed printing media and inks to be automatically executed when the user installs the selected ink media pack in the printer.

For a printing characteristic for images contained a high density of color, for example, if the printing media depend on the permeability of the inks, then the optimal types of inks vary correspondingly, so that it is generally difficult for the user to select the optimal inks for the printing media. In addition, if textiles are used as the printing media, the optimal inks depend on the type of fibers constituting the textiles vary in respect to dyeing properties, even if the latter appear the same because the different fibers have different dyeing properties. The combination of the printing media and inks in the ink media pack 20 may be, for example, inks containing reactive dyes and textiles that are dyed by means of covalent binding with the reactive dyes. In addition, textiles that are dyed by means of hydrogen or ionic bonding are combined with inks containing acid or direct dyes.

In FIGS. 6, 7, and 8, the ink media pack 20 generally comprises the printing media housing section 210 and the ink housing section 211, which house printing media and inks of an optimal combination as described above, respectively. A plurality of such ink media packs 20 are provided for different combinations so that one of them can be installed in the ASF 1 of the printer depending on a selection by the user.

The ink housing section 211 is structured to be entirely enclosed by an ink case 218. The ink housing section 211 internally has ink chambers 218*a* each corresponding to one of a plurality of inks housed therein, the chambers each having an ink tube that stores an ink, as will be seen in FIG. 8. Additionally, the ink housing section 211, acting as a lid member, is provided so as to be opened and closed relative to the printing media housing section 210 (see FIG. 9). That is, the ink case 218, acting as a lid member, is supported for free rotational movement by means of rotational movement axis 212*e* provided on opposite sides of the printing media housing section 210, so that when the ink media pack 20 is installed in the printer, the ink case 20 moves rotationally in response to the installation operation to occupy a predetermined position (see FIG. 1).

The ink case 218 has the pressure section 221*a* (see FIG. 6) in a corner portion in a rectangular top surface thereof, and a joint section 220 (see FIG. 9) in an opposite bottom surface. These sections are used for ink replacement and supply as described later.

On the other hand, the printing media housing section 210 has printing media 200 housed therein and substantially entirely covered by a media case 212 forming a front surface side of the housing section 210 and a rear cover 213 on a rear side thereof, as shown in FIGS. 6 and 7. The printing media housing section 210 has an opening portion formed in a portion of a lower part thereof. That is, the printing media housing section 210 has a front opening 215 formed in a lower portion of the front side as shown in FIG. 9. This chiefly enables the housed printing media 200 to be fed by causing the roller section 104*a* (see FIG. 3) of the sheet feeding roller unit 5 to contact with a surface of the printing media 200 via the front opening 215 as shown by a chain double-dashed line in FIG. 12, when the ink media pack 20 is installed in the ASF 1.

In this manner, the printing media housing section 210 requires the opening through which the roller of the sheet feeding roller unit acting as the sheet feeding means come into contact with the printing media, but such an opening may allow dusts to enter the printing media housing section while the ink media pack 20 is not used and is removed from the printer.

In contrast, in this embodiment, when the ink media pack 20 is removed from the printer, the ink housing section 211 can cover this opening as shown in FIG. 4 and other figures, thereby obtaining the printing media feeding opening, while preventing dusts or the like from entering the printing media housing section to adhere to the printing media.

On the other hand, the printing media housing section 210 has, as shown in FIG. 7, a rear opening 216 formed in a rear side thereof adjacent to the rear cover 213 and covered by a protective sheet 214, described later. The rear opening 216 chiefly enables the pressure plate 103 of the ASF 1 and the printing media 200 to be engaged with each other via the protective sheet 214 when the ink media pack 20 is installed in the ASF 1.

The plurality of printing media 200 stacked and housed in the printing media housing section 210 are housed via the protective sheet 214 on the rear side. At least one side (preferably a longer side) of the protective sheet 214 is fixed to the interior of the printing media housing section 210, while a portion of the protective sheet 214 which corresponds to the rear opening 216 can be moved toward the inside of the ink housing section 211 so that the rear opening 216 shifts from a closed state to a substantially open state.

Thus, even if the housed printing media 200 are sequentially discharged, the top one of the remaining printing media 200 is selectively pressed against the ink housing section 211 (sheet feeding roller unit 5) via the protective sheet 214 by means of the pressure plates 103.

The protective sheet 214 is formed of the same material as the housed printing media so as to have an appropriate friction coefficient for its relationship with the printing media 200. This restrains a phenomenon where the bottom one of the stacked and housed printing media 200, that is, the one that is in direct contact with the protective sheet 104 cannot be appropriately fed or a phenomenon where one of the printing media 200 is prematurely fed together with another stacked thereon (overlapping feeding).

The friction coefficient RF of the outer peripheral portion of the roller portion 104*a*, the friction coefficient PF of the surface (contact surface) of the protective sheet 214, and the friction coefficient SF of the surface of the printing media 200 are each set, for example, based on mutual relationships between these members. For these members, the friction coefficient RF of the outer peripheral portion of the roller portion 104*a* is set to be largest, the friction coefficient SF of the surface of the printing media 200 is set be smallest, and the friction coefficient PF of the surface (contact surface) of the protective sheet 214 is set to be between the friction coefficient RF of the outer peripheral portion of the roller portion 104*a* and the friction coefficient SF of the surface of the printing media 200 ($SF \leqq PF < RF$).

In this case, for example, the friction coefficient PF of the protective sheet 214 and the friction coefficient SF of the surface of the printing media 200 have the same value.

Additionally, the rear opening 124 has a lock 212*b* integrally formed in a substantially central portion of a periphery thereof. The protective sheet 214 and the lock 212*b* can preclude the housed printing media 200 from slipping out toward the rear side, while preventing dusts or the like from entering the housing section through the rear opening 216.

Further, the printing media housing section 210 has a connector 400 provided in part of the lower end surface thereof and which is electrically connected to a connector 310 (see FIGS. 3 and 10) provided an introducing open end of the ASF 1. This enables the printer main body to read out various information stored in a predetermined memory of the ink media pack 20. The connector 40 is mounted on a printer circuit board 401 (see FIG. 7). In addition, the media case 212 has a lock hole 210*a*, described later, formed in a top surface thereof.

Further, as shown in FIG. 12, a pack separating surface 212*a* is formed in one of the sides of the printing media housing section 210 which define the front opening 1215 thereof. In feeding the printing media 200 housed in the ink media pack 20, the pack separating surface 212*a* separates the printing media 200 one by one as with paper 4 as described previously in FIG. 5. Specifically, the pack separating surface 212*a* is formed as a plane on which the lower ends of those of the printing media 200 laminated and housed in the printing media housing section 210 which are near the top recorded medium are abutted during their feeding operation, and has an appropriate butting angle (abutting angle $\alpha$) for the separation.

Figure 13A:
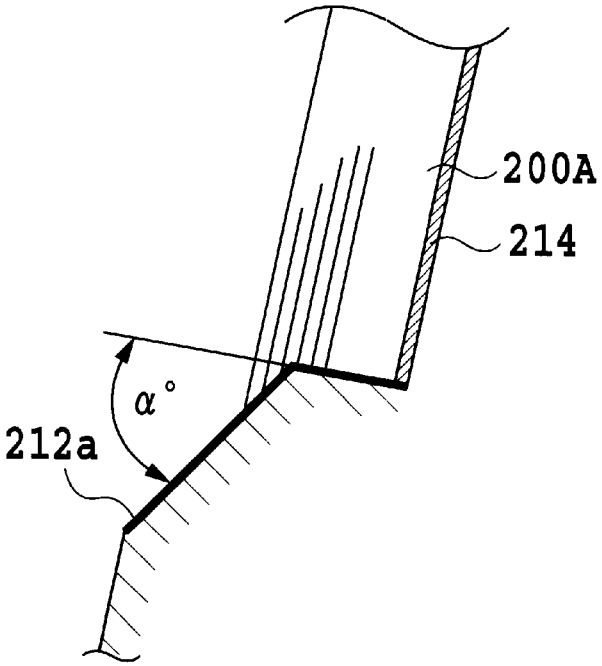
FIGS. 13A and 13B are views useful in explaining the operation of a separating surface of the ink media pack shown in FIG. 6.
Figure 13B:
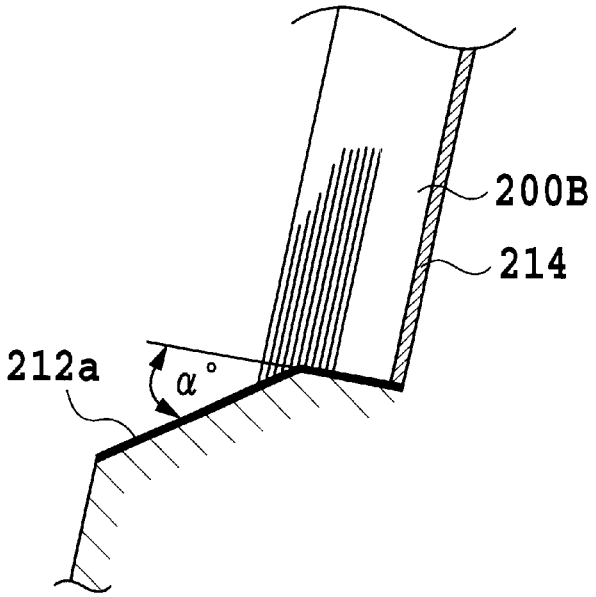

The abutting angle $\alpha$, that is, the angle between the separating surface 212*a* and the inner surface of the peripheral portion of the front opening 215 on which the lower ends of the printing media 200 abut is set, for example, depending on the rigidity of the printing media 200, as shown in FIGS. 13A and 13B.

For example, for printing media 200A having a relatively high rigidity, the abutting angle $\alpha$ is set to be relatively large as shown in FIG. 13A. Additionally, for printing media 200B having a relatively low rigidity, the abutting angle $\alpha$ is set to be relatively small as shown in FIG. 13B.

In this embodiment, the separating surface 107 shown in FIG. 3 and the above described separating surface 212*a* are used as a separating means. The ASF 1 using separating claws as the separating means, however, requires a method for allowing the separating claws of the ASF to recede when the pack is installed, and in this case, the printing media housing section may have another separating claw or a totally different separating means. The separating means is not limited to the above described separating surfaces for both the ASF 1 and the inks and printing media pack, but a combination of optimal separating means can be employed.

Furthermore, as shown in FIG. 9, arc-shaped butting ribs 212*d* abutted against the corresponding stoppers 102*f* are formed in peripheral portions of the front opening 215 which connect to opposite sidewall portions.

A plurality of rubber caps 222, described later, are provided in a line and adjacent to one of the two butting ribs 212*d*. A guide rib 212*c*, described later, is provided outside each butting rib 212*d* along the corresponding sidewall portion.

FIG. 8 is a view showing the internal structure of the ink housing section 211, wherein the ink case cover 219 (see FIG. 9) of the ink case 218 constituting the ink housing section 211 has been removed.

The ink case 218 has four ink chambers 218*a* formed inside depending on the colors of inks used for printing. The four ink chambers 218*a* store, for example, a yellow, cyan, magenta, and black inks. Of course, appropriate inks may be stored depending on the conditions of printing and the embodiment is not limited to the above inks. Each of the ink chambers 218*a* has an ink bag 218*d* arranged therein. The ink bag is formed of a flexible material and is partly bonded to a bottom surface of the ink chamber for fixation. The ink can be supplied from each of the ink bags 218*d* by connecting an ink supply tube 218*c* attached to one end of the ink bag 218*d*, to each corresponding joint valve 221. The joint valve 221 is in communication with the joint section 220, shown in FIG. 9, so that the carriage moves to dispose its ink supply port opposite to this joint section to be in a state of enabling the ink to be supplied to the printing head, as described previously in FIG. 1.

As described above, when the ink media pack 20 of the configuration shown in FIGS. 6 to 9 is not installed in the printer, the ink housing section 211 of the ink media pack 20 is closed relative to the printing media housing section 210 to allow the ink housing section 211 to function as a lid for the printing media housing section 210. That is, the ink housing section 211 prevents the printing media 200 housed via the front opening 215 of the printing media housing section 210 from being exposed to air.

Furthermore, a plurality of rubber caps 222 are provided at a position adjacent to the front opening 215 of the printing media housing section 210 and corresponding to the joint section 220 of the ink housing section 211. Thus, when the ink housing section 211 is closed relative to the printing media housing section 210, the rubber caps 222 encloses the joint section 220 to prevent the ink from leaking from the ink bag in each ink chamber 218*a*.

On the other hand, when the ink media pack 20 is installed in the ASF 1 of the printer, the ink housing section 211 is open relative to the printing media housing section 210 (see FIG. 10). That is, the ink housing section 211 is supported for free rotational movement by means of the rotational movement axis 212*e* so as to be automatically opened relative to the printing media housing section 211 with installation operation, thereby enabling the ink to be supplied to the above described printing head.

Consequently, the operator can installed the ink media pack 20 in a predetermined position without the need to force the ink housing section 211 open; the operator can handle the ink media pack 20 easily during the installation.

Although in this embodiment, the inks optimally combined with the printing media are housed in the ink housing section, otherwise, washing inks may be housed therein to wash the printing head and the interior of an ink supply passage to the printing head when the ink is replaced. Additionally, if an ejection energy generating element for the printing head comprises an electrothermal converter and if the inks optimal for the printing media may scorch the electrothermal converter, scorch-removing liquids or kogation-removing liquids may be housed which removes kogation from the electrothermal converter.

Next, an operation of installing the ink media pack in the ASF 1 will be described principally with reference to FIGS. 10 to 12.

The ink media pack 20 is configured so as to be installed in and removed from the ASF 1 of the ink jet printer, and configurations required for the installation and removal are provided in the ASF 1 and the ink media pack 20.

In the ASF 1 shown in FIG. 3, the introduction guides 102*e* engage with the corresponding guide ribs 212*c* provided at the opposite ends of the printing media housing section of the ink media pack 20 when the latter is installed, thereby allowing the operation of installing the ink media pack 20 to be guided. That is, the guide ribs 212*c* of the ink media pack 20 guide the printing media housing section 210 into the ASF 1. The guide ribs 212*c* engage with the corresponding introduction guides 102*e* and slide along them to enable the installation of the printing media housing section 210 to be guided. The guide ribs 212*c* continue sliding until the butting ribs 212*d* (see FIGS. 10 and 12) formed at the opposite side portions of the printing media housing section 210 butt against the stoppers 102*f* (see FIGS. 10 and 12) provided on the base right-hand plate 102*a* and the base left-hand plate 102*b*. This determines a position of the printing media housing section 210 relative to the base 102 for installation and arrangement.

When the above described printing media housing section 210 is installed, the connector 310 (see FIG. 10) for the printer provided in the ASF 1 and the connector 400 provided on the lower end surface of the printing media housing section 210 are connected together, thereby allowing the printer to recognize that the ink media pack 20 has been installed. In addition, after this installation, the ink media pack 20 can be fixed to the ASF 1 by rotating, as shown in FIG. 10, a lock lever 150 in the direction shown by the arrow, the lock lever 150 being provided on the left-hand plate 102*b* of the ASF 1 and supported for free rotational movement by means of a lever shaft 150*a*, so that a projection 150*b* of the lever 150 is inserted into a lock hole 210*a* formed in the ink media pack 210. This fixation enables the above described connectors to be reliably connected together.

The input guide 102*e* is configured to leave a gap between itself and the uppermost sheet of paper 4 during maximum stacking so that when the paper 4 is directly mounted in the ASF 1, an operation of loading or feeding the paper will not be obstructed. When the side guide 105 is moved to the leftmost position in FIG. 5, it is housed in a side guide housing section (not shown) provided on the base left-hand plate 102*b*.

On the other hand, the operation of installing the ink housing section 211 of the ink media pack 20 is guided through the engagement between the guide grooves 102*d* formed in the base right- and left-hand plates 102*a* and 102*b* of the ASF 1 and guide bosses 218*b* provided on the opposite side portions of the ink case 218 of the ink housing section. That is, during the above described operation of installing the printing media housing section 210, the two guide bosses 218*b* of the ink housing section 211 are engaged with the open ends of the two corresponding guide grooves 102*d* of the ASF 1 before sliding, as shown in FIG. 12. Then, in response to the above described operation of inserting the printing media housing section 210, the ink housing section 211 start to be opened as the guide bosses 218*b* are guided, and are automatically rotated around the rotation axis 212*e*. Once the insertion operation has been ended, the ink housing section 211 assumes a substantially horizontal determined position, shown in FIGS. 1, 11, and 12, to complete the installation.

As described above, the operation of installing the ink media pack 20 in the printer can be essentially performed with one action. That is, when the printing media housing section 210 of the ink media pack 20 is pushed in along the guides, the above described rotational movement allows the ink housing section 211 to simultaneously reach the installation position, which is the substantially horizontal position in the printer.

FIG. 12 is a view showing how the ink media pack 20 is installed in the ASF 1 by means of the above described installation operation.

As shown in this figure, in the installed state, the ink housing section 211 is open relative to the printing media housing section 210 and the front opening 215 of the printing media housing section 210 is opposite to the roller section 104*a* of the sheet feeding roller unit 5. Additionally, in this state, the rear opening 216 is opposite to the pressure plate 103. That is, since the opening area of the rear opening 216 is larger than that of the pressure plate 103, when the pressure plate 103 enters a pressing state, it presses the rear surface of the housed printing media 200 housed via the protective sheet 214, thereby enabling the surface of the housed printing media 200 to be connected with the roller section 104*a* compressibly without displacing the ink media pack 20.

The ink housing section 211 is guided as described previously and then held in a substantially horizontal direction, so that a tip portion of the ink housing section 211 which includes the joint section 220 and the pressure section 221*a* can assume a position for entering the ink jet printer main body. That is, the tip portion can be located above a moving range of the carrier 2. Furthermore, as described later, a cam mechanism (not shown) provided in the printer main body presses the pressure section 221*a*, to activate the joint section 220 to thereby enable the ink to be supplied via the ink supply port 2A on the carriage 2.

For remove the ink media pack 20 from the ASF 1, the above described operation is reversed.

Figure 14:
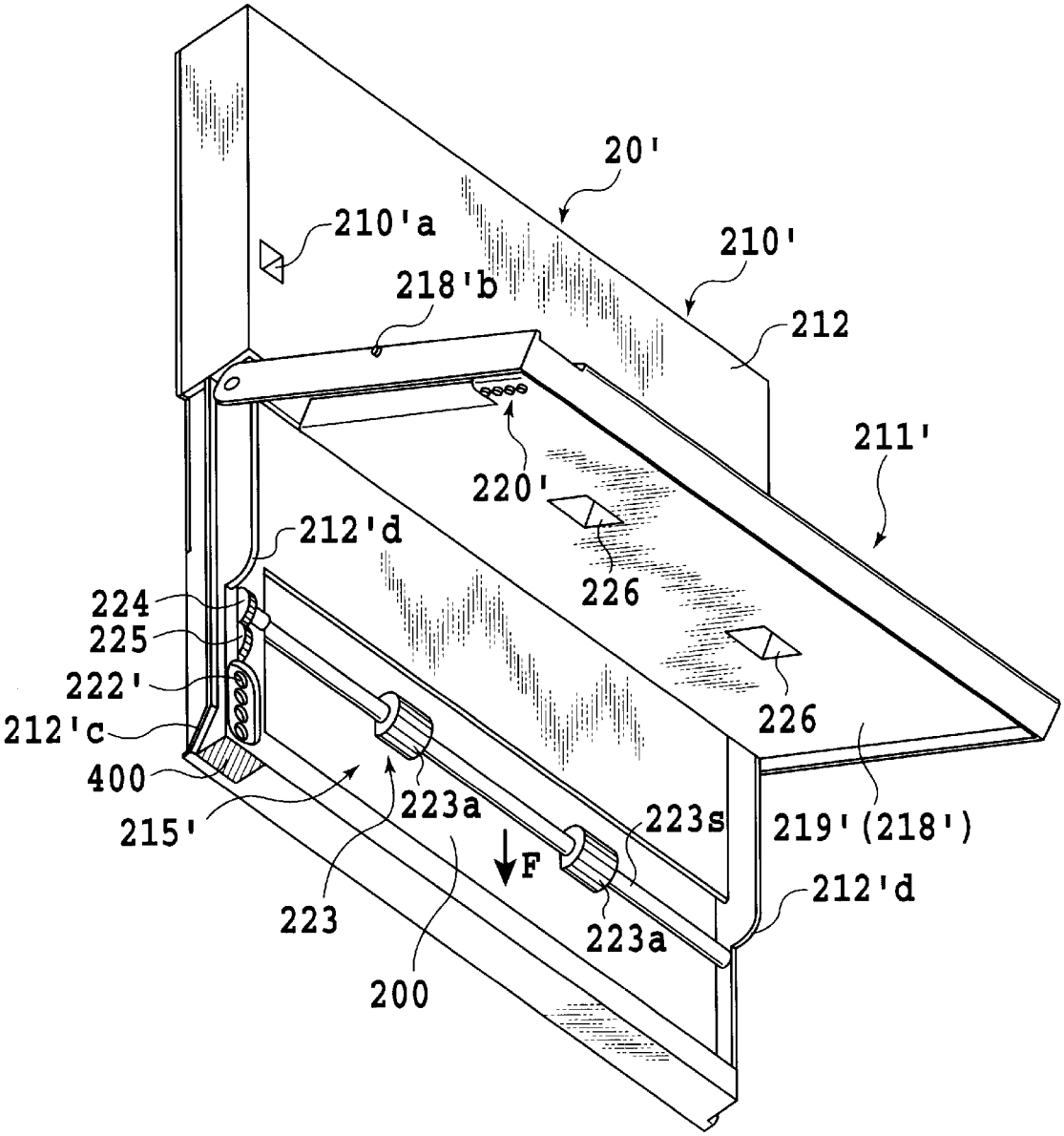
FIG. 14 is a perspective view showing how the ink housing section of a ink media pack that is another example of a printing liquids and sheets container according to the present invention is open relative to the printing media housing section.
Figure 15:
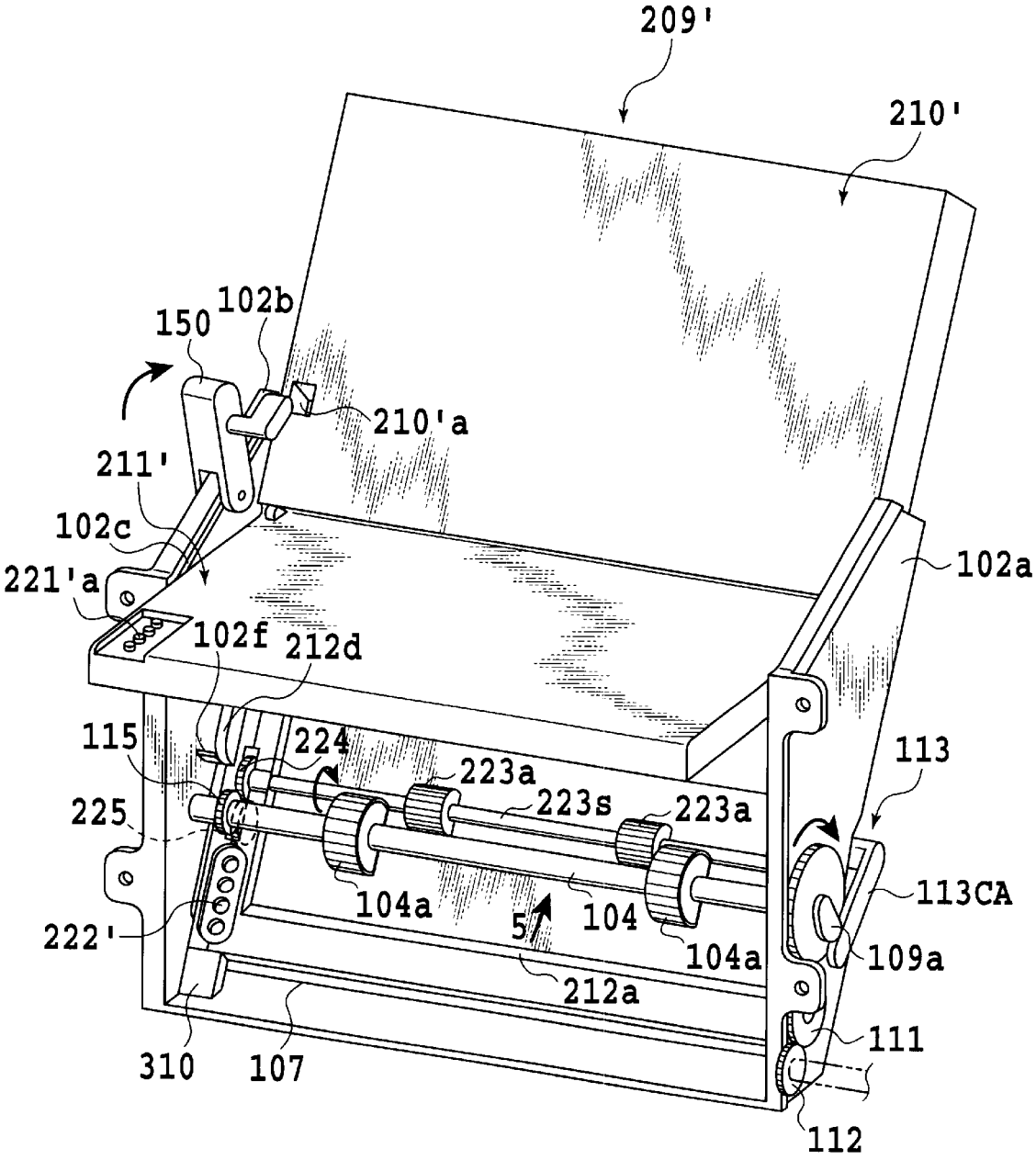
FIG. 15 is a perspective view showing how the ink media pack shown in FIG. 14 is installed in the automatic sheet feeding device shown in FIG. 3.
Figure 16:
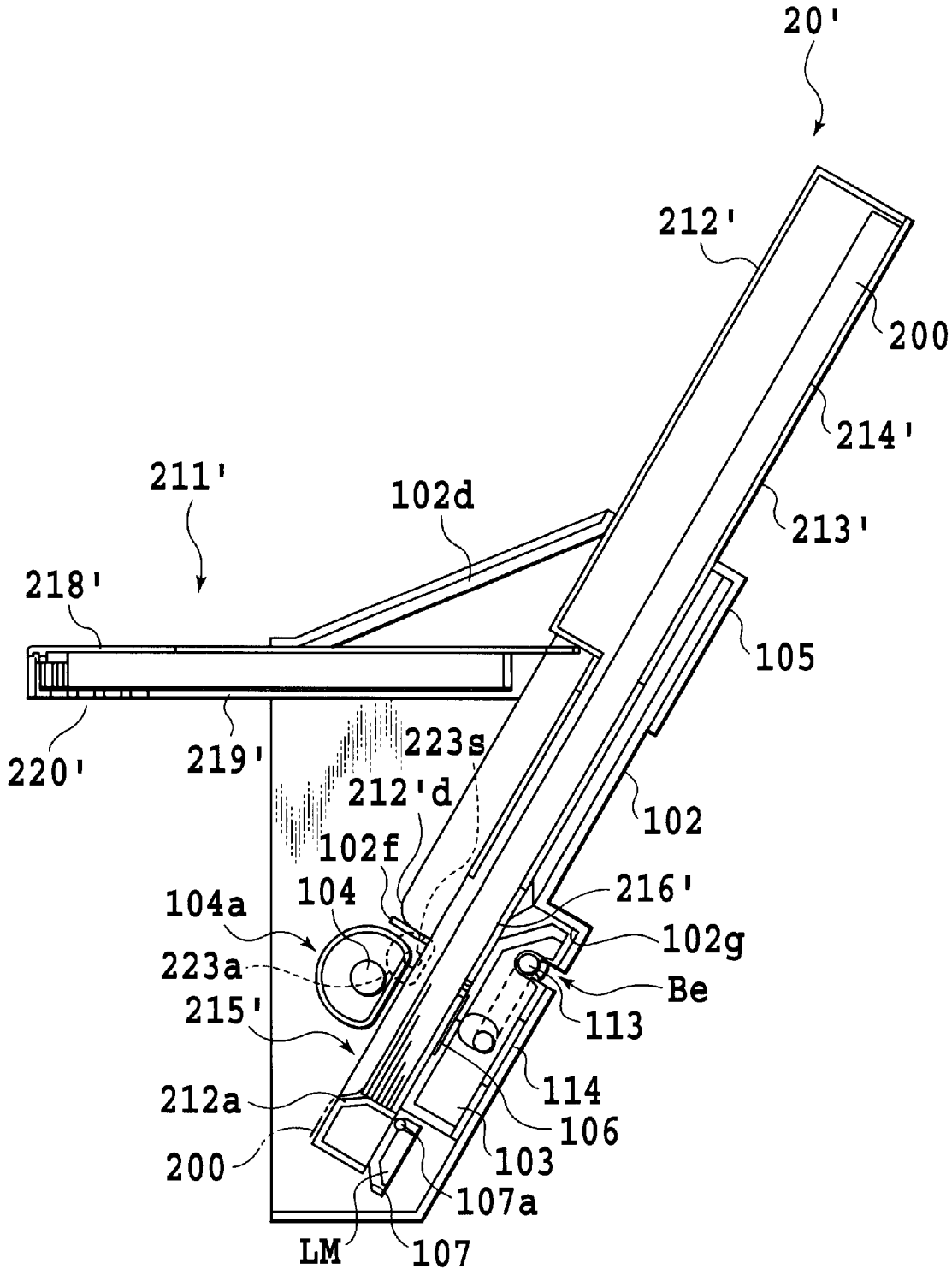
FIG. 16 is a partial sectional view of the state shown in FIG. 10, as seen from a side surface side.

FIGS. 14, 15, and 16 show a sheet supplying device to which an another example of a printing liquids and sheets container according to the present invention is applied.

In FIGS. 14, 15, and 16, the same components as those in FIGS. 9, 10, and 12 are denoted by the same reference numerals to omit duplicate description thereof.

In FIG. 14, a pack sheet-feeding roller unit 223 is provided over a front opening 215' in a printing media housing section 210' of an ink media pack 20'. Additionally, as shown in FIG. 15, the shaft portion 104 has a gear 115 fixed to one end thereof and meshed with a pack sheet-feeding gear 225, described later.

The pack sheet-feeding roller unit 223 comprises a shaft portion 223*s* disposed to traverse the front opening 215' along a direction orthogonal to the feeding direction shown by the arrow F in FIG. 14, and two roller portions 223*a* fixed to the shaft portion 223*s* and spaced by a predetermined distance. Opposite ends of the shaft portion 223 are supported on sidewall portions formed opposite longitudinal opposite side ends of the printing media 200 so that the shaft portion 223 can be rotationally moved. In addition, the shaft portion 223*s* has a pack sheet-feeding gear A224 fixed at one end thereof between the shaft portion and the corresponding sidewall portion. The pack sheet-feeding gear A224 is meshed with a pack sheet-feeding gear B225 supported inside the sidewall portion and under the gear A224 so as to be rotationally moved. The pack sheet-feeding gear B225 is arranged to mesh with the gear 115, disposed over it when the ink media pack 20' is installed as described later.

The distance between the D-shaped roller portions 223*a* disposed at equal intervals from a central portion of the shaft portion 223*s* is set smaller than the distance between the roller portions 104*a*. An outer peripheral portion of each of the D-shaped roller portions 223*a* is formed of a material having a friction coefficient and a chemical structure that are optimal for the friction coefficient of the unique printing media housed in the printing media housing section 210' of each ink media pack 20'. The diameter of the roller portion 223*a* is relatively small and is set such that the amount of feeding achieved by two rotations of the roller portion 223*a* equals the amount of feeding achieved by one rotation of the roller portion 104*a*.

When the ink media pack 20' is installed as described later, flat portions of the D-shaped roller portions 223*a* extend substantially parallel with the flat portions of the roller portions 104*a*.

Further, as shown in FIG. 14, arc-shaped butting ribs 212'*d* abutted against the corresponding stoppers 102*f* are formed in peripheral portions of the front opening 215' which connect to opposite sidewall portions. An ink case cover 219' located opposite the pack sheet-feeding roller unit 223 has recesses 226 formed therein correspondingly to the roller portions 223*a* and into which the corresponding roller portions 223*a* are partly inserted when an ink housing section 211' covers the front opening 215'.

A plurality of rubber caps 222', described later, are provided in a line and adjacent to one of the two butting ribs 212'*d*. A guide rib 212'*c*, described later, is provided outside each butting rib 212'*d* along the corresponding sidewall portion.

Next, the operation of installing the ink media pack 20 in the ASF 1 will be described chiefly with reference to FIGS. 14 to 16.

The ink media cap 20' is configured so as to be installed in and removed from the ASF 1 of an ink jet printer, and configurations required for the installation and removal are provided in the ASF 1 and the ink media cap 20'.

The guide ribs 212'*c* of the ink media cap 20' are principally used to guide the insertion of the printing media housing section 210' into the ASF 1; the guide ribs 212'*c* engage with the introduction guides 102*e* and slides along them to enable the installation of the printing media housing section 210' to be guided. The guide ribs 212'*c* continue sliding until butting ribs 212'*d* (see FIGS. 14 and 15) formed at the opposite side portions of the printing media housing section 210' butt against the stoppers 102*f* (see FIGS. 15 and 16) provided on the base right-hand plate 102*a* and the base left-hand plate 102*b*. This determines a position of the printing media housing section 210 relative to the base 102 for installation and arrangement and allows the pack sheet-feeding gear B225 and the gear 115 to be appropriately meshed with each other. In this case, flat portions of the rollers 223*a* are located substantially parallel with the flat portions of the roller portions 104*a*.

When the above printing media housing section 210' is installed, the printer-side connector 310 (see FIG. 10) provided in the ASF and the connector 400 provided on the lower end surface of the printing media housing section 210' are connected together to allow the printer to know that the ink media pack 20' is installed. In addition, after the installation, a lock lever 150 provided on the left-hand plate 102*b* of the ASF 1 and supported by a lever shaft 150*a* so as to be rotationally moved is rotated in the direction shown by the arrow, as shown in FIG. 10, to insert a projecting portion 150*b* of the lever 150 into a lock hole 210' formed in the ink media pack 20', thereby enabling the ink media pack 20' to be fixed to the ASF 1. This fixation ensures that the connectors are connected together while the pack sheet-feeding gear B225 and the gear 115 are meshed with each other as described above.

On the other hand, the operation of installing the ink housing section 211' of the ink media pack 20' is guided through the engagement between the guide grooves 102*d* formed in the base right- and left-hand plates 102*a* and 102*b* of the ASF 1 and guide bosses 218'*b* provided on the opposite side portions of the ink case 218' of the ink housing section. That is, during the above described operation of installing the printing media housing section 210', the two guide bosses 218'*b* of the ink housing section 211' are engaged with the two corresponding guide grooves 102*d* of the ASF 1 via their open ends, as shown in FIG. 16. Then, in response to the above described operation of inserting the printing media housing section 210', the ink housing section 211' are rotated around the rotation axis 212*e*. Once the insertion operation has been ended, the ink housing section 211 assumes a substantially horizontal predetermined position, shown in FIGS. 15 and 16, to complete the installation.

FIG. 16 is a view showing how the ink media pack 20' is installed in the ASF 1 by means of the above described installation operation.

As shown in FIG. 16, in the installed state, the ink housing section 211' is open relative to the printing media housing section 210', with the front opening 215' of the printing media housing section 210' opposite to the roller portions 104*a* of the sheet feeding roller unit 5. At this time, a rear opening 216' is opposite to the pressure plates 103. That is, since the opening area of the rear opening 216' is larger than that of the pressure plates 103, when the latter are pressed, the rear surface of the printing media 200 can be pressed via a protective sheet 214' to bring the front surface of the housed printing media 200 into pressure contact with the roller portions 223*a* without displacing the ink media pack 20'. The rollers 104*a* are located above the roller portions 223*a*, so that the surface of the printing media 200 is not in contact with the roller portions 104*a*.

The ink housing section 211' is guided and held in a substantially horizontal direction as described previously, and a tip portion of the ink housing section 211' which includes joint section 220' and a pressurizing section 221' can be located so as to enter the ink jet printer main body. That is, this tip portion can be located above the movement range of the carriage 2. Further, as described later, a cam mechanism (not shown) provided in the printer main body presses the pressurizing section 221'*a* to actuate the joint section 220' to allow the ink to be supplied via the ink supply port 2A on the carriage 2.

To remove the ink media pack 20' from the ASF 1, the above described operation is preformed in the reverse order.

Figure 17:
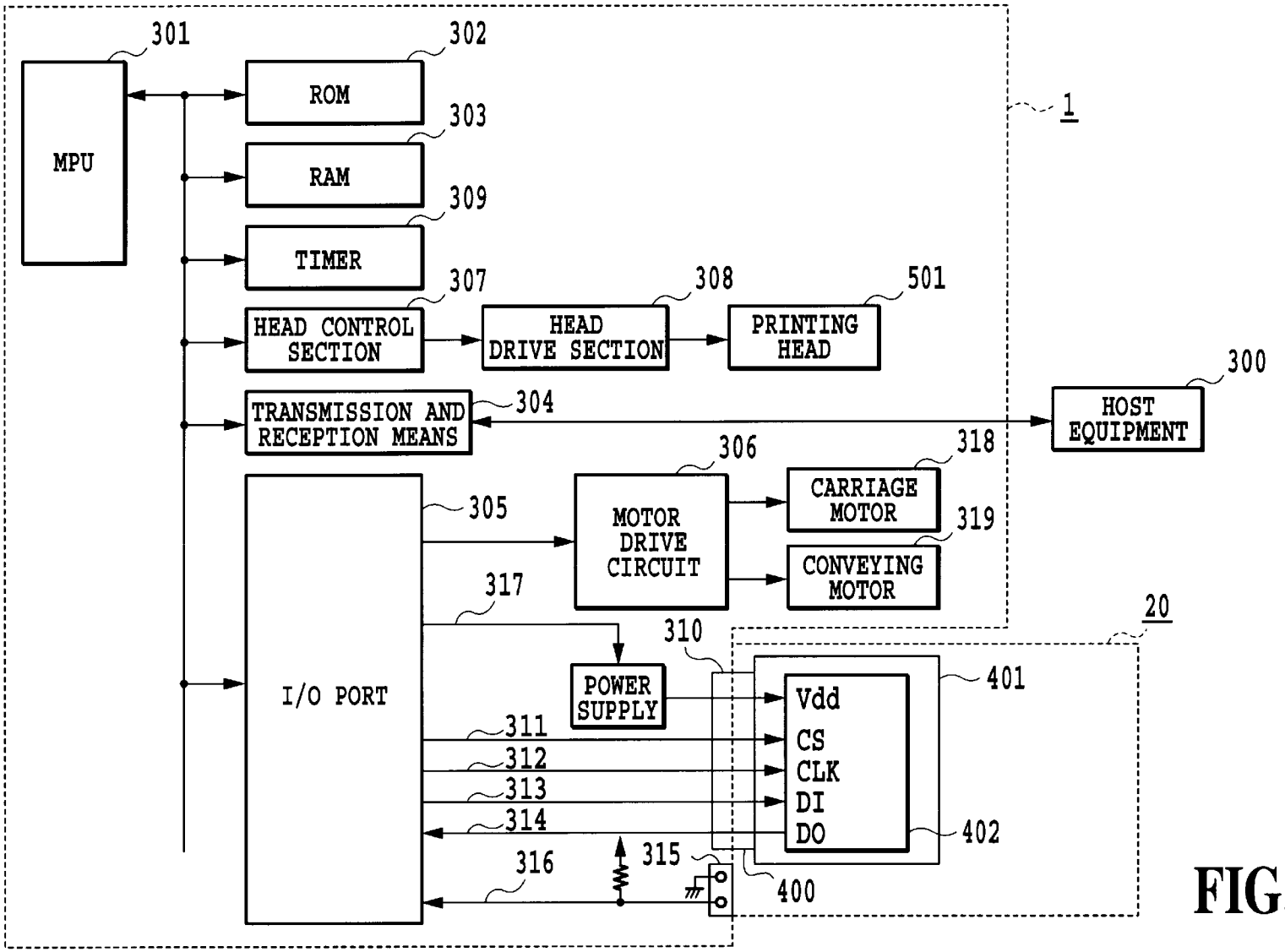
FIG. 17 is a block diagram schematically showing the entire configuration of a printing system provided in the ink jet printer shown in FIG. 1.

FIG. 17 is a block diagram of a system comprising an ink media pack and an ink jet printing apparatus including an example of a sheet supplying device according to the present invention, principally showing a control configuration of the system.

In the ink jet printer, a microprocessor (MPU 301) controls the entire ink jet printer in accordance with a control program stored in a ROM 302. A RAM 303 includes a receive data buffer saving printing data transferred from a host apparatus 300 and is used as a work area in which the MPU 301 performs its processes.

The RAM 303 also has areas that can store ink information indicating the types of inks used for the last printing operation and ink information indicating the types of inks to be used for the next printing operation. If a pack is installed, the ink information to be used for the next printing operation is read out from a memory for that pack. If the pack is removed, that information is stored in a memory of the printer. Each piece of this ink information is stored as distinguished from each corresponding tank section that stores the ink. This information serves to prevent the same ink from being wastefully replaced before and after the pack is installed and removed.

The MPU 301 controls rotation of a carriage motor,and of a conveyance motor for also supplying a rotational movement force to the sheet feeding roller gear C112, via an I/O port 305 and a motor driving circuit 306, based on command and printing data transferred from the host computer (host apparatus) 300 via a transmission and reception means 304 comprising a well-known centronics interface or the like, in accordance with the procedure of the program stored in the ROM 302. The MPU 301 also outputs the printing data to a printing head 501 via a head control section 307 and a head driving section 308 to control a printing operation of the printing head. In addition, a timer 309 is provided for producing a drive pulse width for the printing head and controlling the rotation speed of each motor.

On the other hand, in the system of the ink media pack connected to the above described ink jet printer to work, an EEPRPOM 402 is mounted which enables electric reads and writes when mounted on a printed circuit board 401 (see FIG. 5) and which can retain data even while no voltage is being applied thereto. The EEPROM 402 of this embodiment is of a general serial type that is operative hen a CS signal is at an "H" level. That is, when the S signal is at the "H" level, a CLK signal 312 rises, a ommand (write, read, delete, or the like) on a DI input signal 313 or write data is written to the EEPROM 402, and read data are output onto a DO output signal 314, from which they can then be read. Signal lines 311 to 314 are each connected to the I/O port 305 in the main body via the connector 310 of the main body to accomplish a data read and write under the control of the MPU 301. The serial EEPROM 402 has a capacity of about several-K bits and can be rewritten about $10^5$ to $10^7$ times; it is thus suitable as a rewritable storage element for storing information on the printer of this embodiment.

Furthermore, the ink jet printer has a switch 315 for detecting that the ink media pack 20 is installed, the switch 315 being activated when the ink media pack 20 is installed. An output signal 316 from the switch 315 is input to the I/O port 305. The MPU 301 reads this signal to detect the installation or removal of the ink media pack 20.

At the time of detecting the installation of the pack 20, the MPU 301 uses an output signal 317 from the I/O port 305 to supply power to the EEPROM 402 in the pack 20 to enable a read from or a write to the EEPROM 402.

The information stored in the EEPROM 402 in the ink media pack 20 is roughly divided into that written thereto in a factory when the pack is manufactured and which is subsequently simply read out by the ink jet printer, and that rewritten by the ink jet printer after the pack has been installed in the ink jet printer. The former information is represented by the types of printing media and inks set in the pack.

Figure 18:
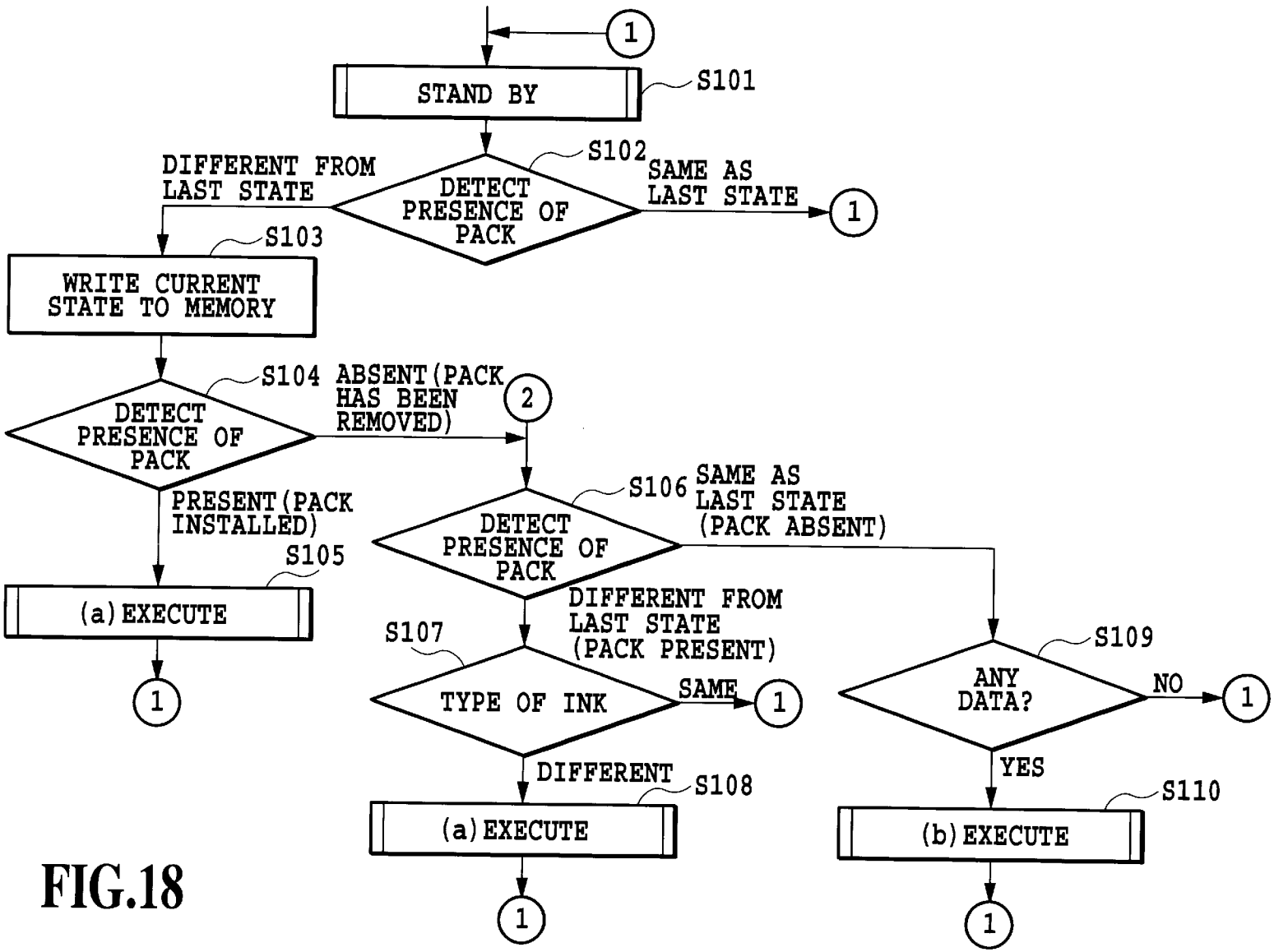
FIG. 18 is a flow chart useful in explaining a program executed if the control section shown in FIG. 17 comprises, for example, a microcomputer.
Figure 19A:
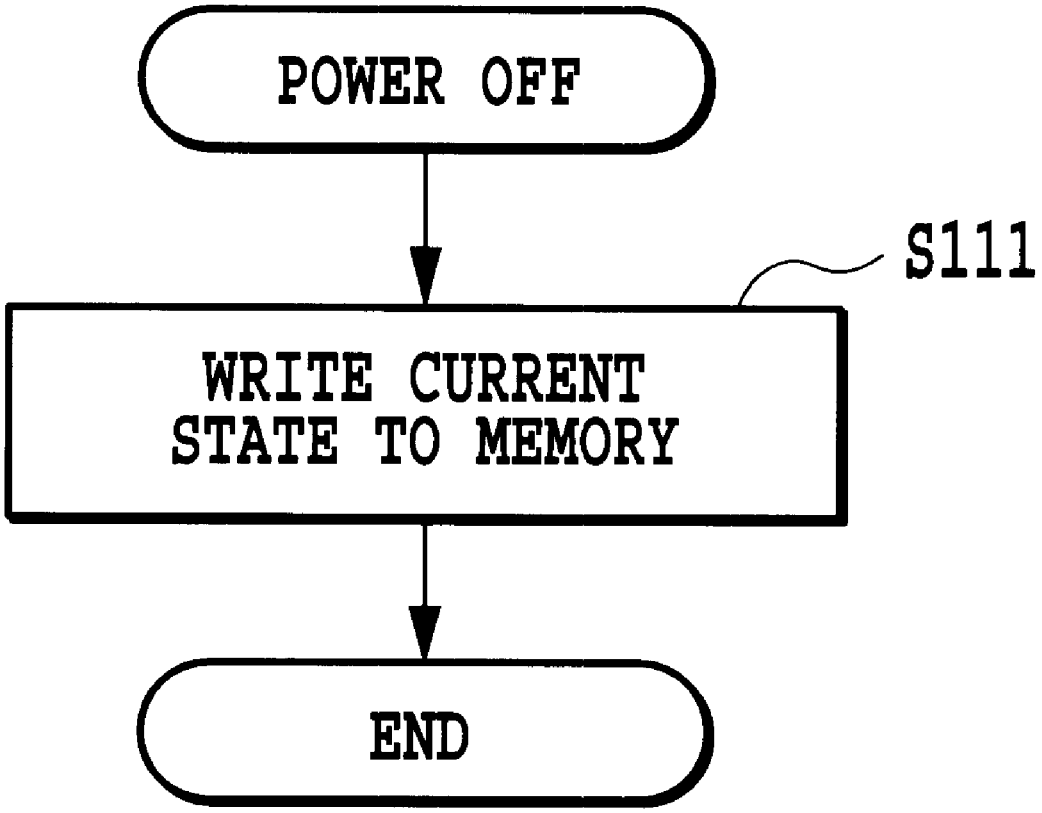
FIG. 19A and FIG. 19B are flow charts useful in explaining a program executed if the control section shown in FIG. 17 comprises, for example, a microcomputer.
Figure 19B:
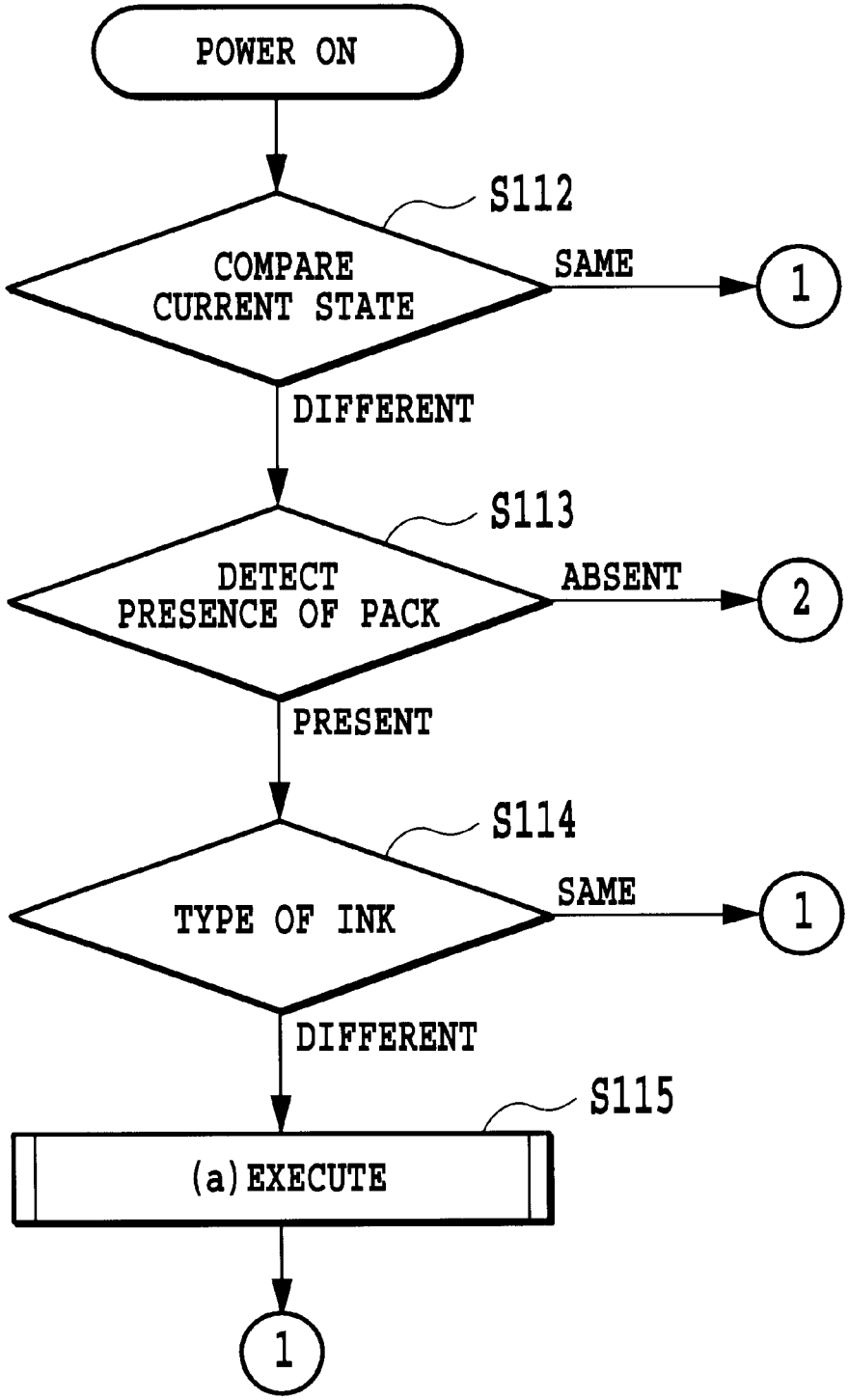

FIGS. 18 and 19 are flow charts showing processes executed by the printer in connection with the installation of the above described ink media pack 20 or the like. FIG. 18 shows a process executed when the installation of the ink media pack 20 or the like is carried out while the power to the printer is on. FIGS. 19A and 19B show a process procedure executed when the installation of the ink media pack 20 or the like is carried out while the power to the printer is off. These processes can be executed by electrically connecting a connector 400 provided in the ink media pack 20 to the connector 310 of the printer.

As shown in FIG. 18, if the installation of the ink media pack 20 or the like is carried out while the power is on, it is executed as part of a printer printing standby process (step S101). That is, this process is activated at predetermined time intervals during printing standby to first determine whether or not the ink media pack 20 has been installed in the printer (S102). This determination process is executed using data on installation/non-installation which are written to a predetermined memory of the printer together with data such as the ID of the ink media pack and the types of the inks and printed media. If it is determined that these data are different from the last ones, the current state, including the ID of the ink media pack 20 (if installed), is written to the above memory (S103). The above described memory is then referenced to determine whether or not the ink media pack 20 is currently installed (S104). The determination of the installation/non-installation of the ink media pack 20 may be based on the state of the switch 315 for detecting the installation.

If it is then determined that the ink media pack 20 is installed, it is determined that the state where the ink media pack 20 is not installed has been changed to the state where it is installed and a process A, described below, is executed and the standby process at step S101 is continued.

On the other hand, if it is determined at step S104 that the ink media pack 20 has been removed, two cases are possible: ① the paper 4 has been installed and ② an operation of changing the ink media pack 20 to a different type is being performed. Thus, step S106 and subsequent steps are executed.

That is, to distinguish the cases ① and ② from each other, the presence of the ink media pack 20 and the presence of the printing data are monitored (S106 and S109). When whether or not the ink media pack 20 is present is detected at step S106 and if it is determined that the state is the same as the last one, that is, the ink media pack 20 has been removed and it is further determined that the printing data has been transmitted from the host (S109), then it is determined that the paper 4 is installed and a process (b), described below, is executed.

In addition, if the presence of the ink media pack is detected at step S106 before the printing data are transmitted, then it is determined that the ink media pack 20 has been installed. It is then determined at step S107 whether or not the types of the inks in the ink media pack are the same as those in the previously installed ink media pack. Then, the process (a) is executed only if the types of the inks are different. If the types of the inks remain unchanged, since the inks in the printing head need not be replaced, and the standby process is thus continued.

Next, the process executed when the installation of the ink media pack 20 or the like is carried out while powering off the printer will be described with reference to FIGS. 19A and B.

As shown in FIG. 19A, when a power-off operation is performed, data on the current installation state of the ink media pack 20 is written to the above described memory (S111) and the power is then shut off. The ink media pack 20 may be installed or removed while the power is off.

Then, when a power-on operation is performed, the process shown in FIG. 19B is activated to compare the current installation state of the ink media pack 20 with the installation state written at the above step S111, at step S112. At that time, if the installation state of the ink media pack 20 is the same, the inks in the head need not be replaced and the procedure shifts directly to the standby process shown in FIG. 18 to end the present process.

On the other hand, if the installation state of the ink media pack 20 is different, it is determined whether or not the ink media pack 20 is present (S113). At this time ,if the absence of the ink media pack 20 is detected, it is considered that two cases are possible: ① the paper 4 has been installed and ② the operation of changing the ink media pack 20 to a different type is being performed. Thus, the procedure shifts to the processing at step S106 shown in FIG. 18, as described in FIG. 18.

If the presence of the ink media pack 20 is detected, then the information on the types of the inks in the ink media pack 20 are compared with the information on the ink types written at step S111 (S114). At this time, if the ink types are the same, the inks in the printing head need not be replaced and the procedure shifts to the standby process to end the present process.

On the other hand, if the ink types are different, after the process (a), described below, is executed and the procedure then proceeds to the standby process in order to replace the inks in the printing head.

Next, the above mentioned processes (a) and (b) will be explained mainly with reference to FIG. 1.

Process (a)

This process is executed if the ink media pack has been replaced with a different type. First, the carriage 2 moves to the positions of the cap 41 and recovery system 42 for the media pack. While moving for each ink color, the carriage 2 sucks the ink from the printing head side to empty the printing head and the sub-tank and then supplies each color ink at the same ink supply position, as described later. Once each color ink supply has sufficiently finished, the carriage 2 moves to its home position to execute the above mentioned standby process for the printing command.

During the standby process at the above described step S101, when the printing command is issued, the printed media 200 are fed from the ink media pack 20 and printing is then carried out. After the printing has been completed, the media are discharged. During the printing, if the ink must be supplied to the sub-tank, then the carriage moves to the ink supplying position to supply each color ink as described above.

Process (b)

This process is executed if the paper 4 is directly installed in the ASF 1 and if images or the like are printed on the paper. First, the carriage 2 moves to the positions of the cap 41 and recovery system 42 for the paper. While moving for each ink color, the carriage 2 sucks the ink from the printing head side to empty the printing head and the sub-tank and then supplies each color ink at the same ink supply position, as described later. Once each color ink supply has sufficiently been finished, the carriage 2 moves to its home position to execute the above mentioned standby process for the printing command.

Figure 20:
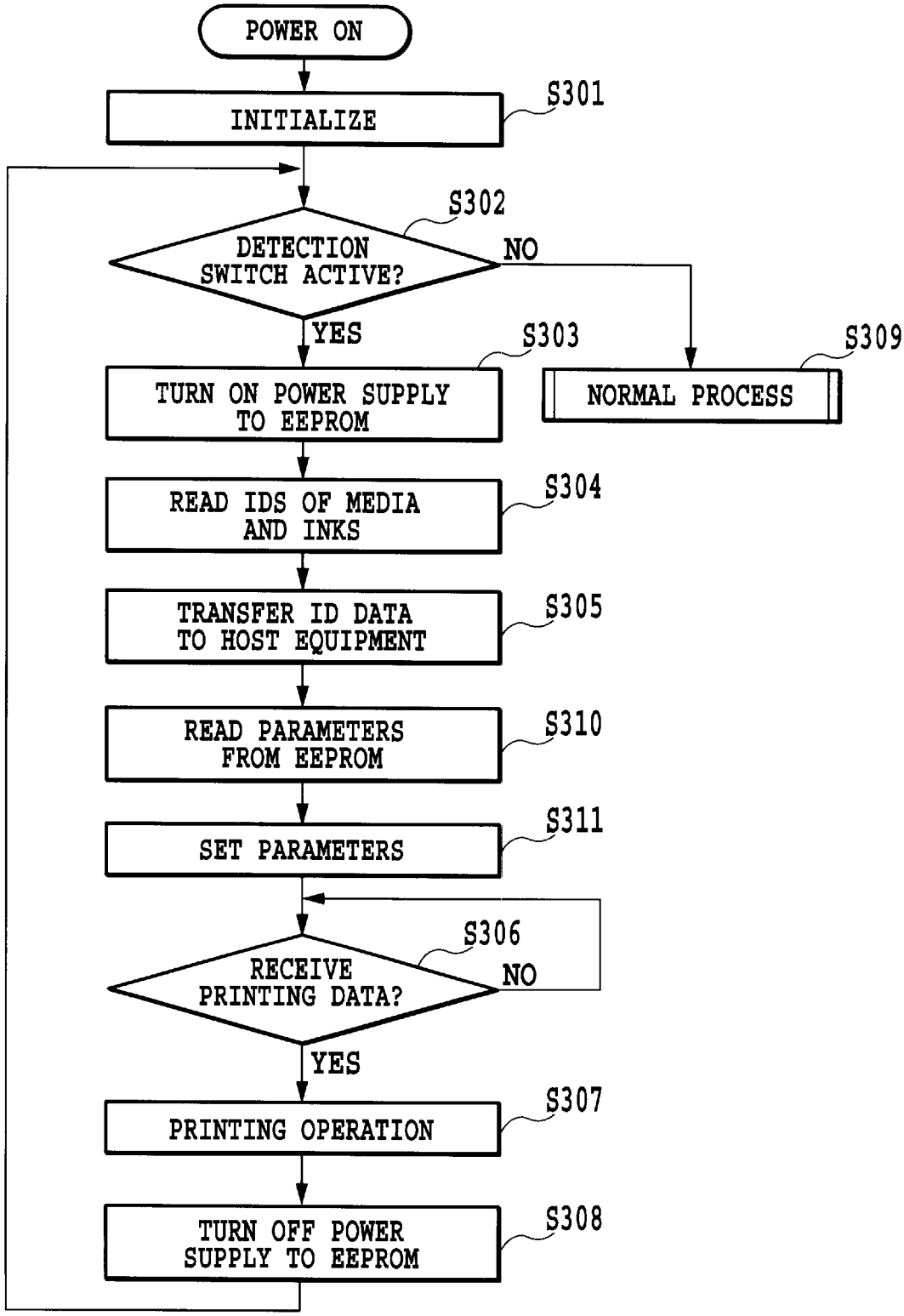
FIG. 20 is a flow chart useful in explaining a program executed if the control section shown in FIG. 17 comprises, for example, a microcomputer.

FIG. 20 is a flow chart schematically showing a printing process executed by the ink jet printer of this embodiment and showing a control procedure executed by the MPU 301. The process shown in this figure relates mainly to setting of a printing mode prior to printing and is executed substantially parallel with the process for printing standby described above in FIGS. 18 and 19.

After the power supply to the ink jet printer has been turned on, the MPU 301 initializes the apparatus (S302). Then, the MPU reads state of the pack installation detecting switch 315 via the input port 305 (S302). When the switch 315 is active, the MPU determines that the pack 20 is installed and supplies power to the EEPROM 402 (S303) to read various data stored in the EEPROM 402 (S304). The EEPROM 402 has various data such as the IDs of the types of printing media and inks accommodated in the ink media pack 20 and printing control parameters stored before shipment. The MPU transfers the data read from the EEPROM 402 to the host equipment 300 via the transmission and reception means 304 such as a centronics interface (S305).

The maximum value of the amount of ink placed by the ink jet printer per unit area is usually determined for each type of printing media; the maximum amount of placed ink which is permitted by each recorded medium is used to record images in order to improve color reproducibility. If, for example, the amount of ink required to fill up a 600-dpi printing area is defined to be 1, this value is about 2.0 for paper, about 2.3 for glossy paper, about 2.7 for coated paper, and about 1.8 for OHP. An ideal value is 3, with which three color inks can be placed in such a manner as to overlap one another, and the amount of ink that can be placed on paper increases in the order of OHP, paper (copy paper), glossy paper, and coat paper. Additionally, the amount of placed ink varies slightly depending on the composition of the ink. Further, depending on the type of printing media varies how the ink is fixed to the printing media and permeates therethrough varies and how significant irregular colors, streaks, or the like are. For example, coat or glossy paper has more significant irregular colors, streaks, or the like than paper or OHP, so that the number of printing passes is generally increased for coat or glossy paper rather than for paper or OHP in order to obtain high-grade printing results. The number of passes refers to the number of scans executed by the printing head to complete one line of printing; a method for completing one line of printing with multiple scans is referred to as a "multipass method".

Taking these circumstances into account, a printer driver in the host equipment 300 automatically creates optical printing data without the user's selections, based on the ID information stored in the EEPROM 402 before shipment and including the types of printing media and inks in the pack 20, and then transfers the data to the ink jet printer. That is, the host equipment 300 creates optimal printing data and transfers then to the ink jet printer, taking into consideration optimal image processing for a combination of printing media and inks in the pack 20 installed in the ink jet printer, the amount of placed ink, and the number of print passes (the number of passes for the multipass method). In addition to or as alternatives to the above described IDs of the types of printing media and inks, image processing parameters such as the amount of placed ink and the number of print passes may be transmitted to the host equipment 300 and stored in the EEPROM 402.

Next, the MPU reads various parameters on the printing operation of the ink jet printer (S310). These parameters were stored in the EEPROM 402 before shipment and include, for example, a drive pulse width for the printing head, the number of dots for auxiliary ejection which is used when an auxiliary amount of ink is ejected to prevent the printing head from failing to eject the ink, time intervals for the auxiliary ejection, time intervals for recovery and suction operations required to keep the printing head normal. The MPU sets these parameters in aprinting control circuit 307 of the ink jet printer (S311). This, in combination with the optimization executed by the printer driver, enables more optimal control.

Subsequently, the MPU waits for the printing data to be received from the host equipment 300 (S306), and upon receiving the printing data, executes a printing operation based thereon (S307). Once printing for one page has been completed, the power supply to the EEPROM 402 is turned off (S308). Subsequently, the process returns to step S302 to read the state of the pack installation detecting switch 315 via the I/O port 305.

On the other hand, when the pack installation detecting switch 315 is inactive at step S302, the MPU determines that the pack 20 is not installed and executes a normal printing operation (S309). That is, the ink jet printer is set to be able to record the printing data with the print grade and speed designated by the user via the printer driver of the host equipment 300 and then executes printing using the ink from the paper and ink refilling unit 30 of the ink jet printer and the printing media set in the ASF 1.

The above control sets the ink jet printer to be able to record, without the user's designations, the printing data optimized depending on the combination of the inks and printing media set in the ink media pack, thereby enabling printing with high-grade image quality. Additionally, since the various parameters on the printing operation of the ink jet printer are read from the EEPROM 402 of the ink media pack and then set in the printing control circuit 307 of the ink jet printer, even if, for example, a pack for a combination of printing media and inks that is not assumed before the sale of the ink jet printer is additionally sold, printing is possible with optimal printing control for that combination of printing media and inks.

Other Embodiments

The pack 20 may contain the above described information written thereto before shipment, information written or rewritten in recycling the pack (the number of times that the pack has been recycled, and other information), or information written or rewritten by the ink jet printer. The information rewritten by the ink jet printer with the pack 20 installed therein includes, for example, the number of printing media remaining in the pack 20 and the amount of ink remaining in the pack 20.

In embodiments other than those described above, the information rewritten by the ink jet printer with the pack 20 installed therein includes the number of printing media in the pack 20 and the amount of ink remaining in the pack 20.

Figure 21:
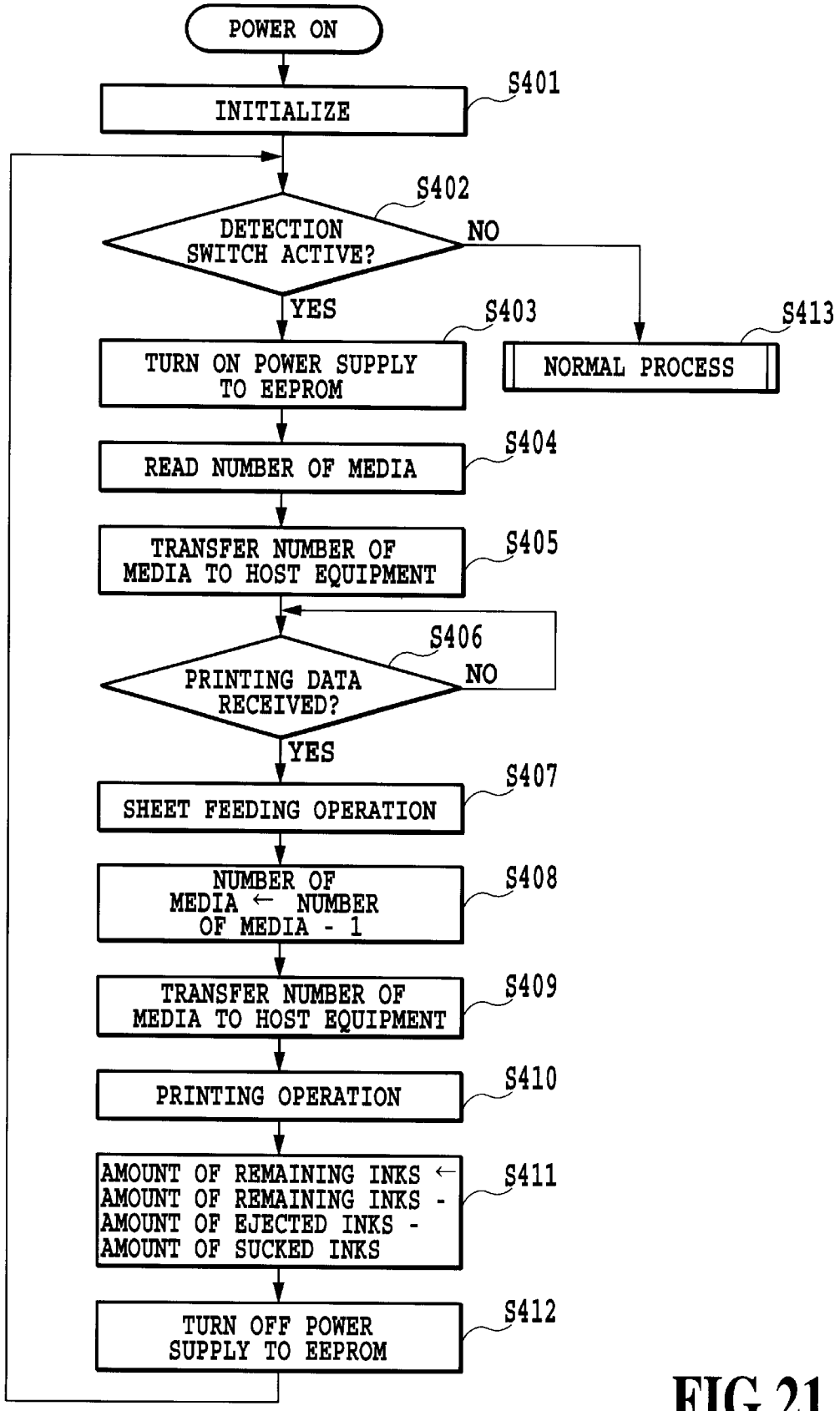
FIG. 21 is a flow chart useful in explaining a program executed if the control section shown in FIG. 17 comprises, for example, a microcomputer.

FIG. 21 is a flow chart showing an example of another control provided by the MPU 301.

In FIG. 21, after the ink jet printer has been powered up, the MPU 301 initializes the apparatus at step S401. Next, at step S402, the state of the installation detecting switch 315 for the ink media pack 20 is read via the I/O port 305. At this time, if the switch 315 is active, then it is determined that the ink media pack 20 is installed. At step S403, the power is supplied to the EEPROM 402 to read the number of remaining printing media stored in the EEPROM 402 (step S404). At step S405, the read data are transferred to the host equipment 300 via the above mentioned transmission and reception means 304 such as an centronics interface.

A status monitor of the host equipment displays the current number of remaining printing media housed in the ink media pack 20 on the monitor. Then, when it is determined at step S406 that the printing data have been received from the host equipment, the printing media in the ink media pack 20 are fed at step S407. Then, at step S408, the data on new value equal to the number of currently remaining printing media minus one is written to the EEPROM 402 and transferred to the host equipment 300. The number of remaining printing media displayed on the monitor is changed (S409) and the printing operation is performed at step S410. Once printing has been completed for one sheet, then at step S411, the data on value of the amount of remaining ink is read from the EEPROM 402 for each color. Then, the amount of ink ejected for the printing for this sheet and the amount of preliminary ejection are subtracted from the read value or the amount of sucked ink is subtracted from the read value if a suction operation has been performed, and the data on the result is written to the EEPROM 402. Subsequently, at step S412, assuming that the ink media pack 20 is to be removed, the process shifts to step S402 to repeat the above mentioned process. Precisely speaking, the amount of ink remaining in the ink housing section is calculated based on the amount of ink supplied from the ink housing section to the sub-tank in the carriage. Since, however, a small amount of ink is housed in the sub-tank and the ink is thus frequently supplied from the ink housing section to the sub-tank, the amount of ink ejected for printing, the amount of ink for preliminary ejection, and the like can be directly used to calculate the amount of ink remaining in the ink housing section.

The EEPROM 402 stores information of initial values such as the number of printed media remaining in the pack 20 and the amount of remaining ink stored therein:before shipment and during recycling. In addition, during the printing operation at step S410, a locking mechanism (not shown) can be used to lock the pack 20 at a specified position to prevent the user from removing the pack 20 during a write to the EEPROM 402, thereby improving the safety of the system.

The above process enables the current number of printing media in the ink media pack 20 to be determined so that this data can be transmitted to the host equipment 300, where it can be displayed on a CRT of the host equipment 300, thereby improving the user interface. Additionally, the latest state of the interior of the ink media pack 20 can always be determined so that this information can be read and used for a process of determining the amount of inks injected for recycling or other processes.

Precisely speaking, the amount of ink remaining in the ink housing section is calculated based on the amount of ink supplied from the ink housing section to the sub-tank in the carriage. If, however, a small amount of ink is housed in the sub-tank and the ink is thus frequently supplied from the ink housing section to the sub-tank, the amount of ink ejected for printing, the amount of ink for preliminary ejection, and the like can be directly used to calculate the amount of ink remaining in the ink housing section, as described above. That is, when the printing has been completed for one sheet, the data on the value of the amount of remaining ink is read from the EEPROM 402 for each color. Then, the amount of ink ejected for the printing for this sheet and the amount of preliminary ejection are subtracted from the read value or the amount of sucked ink is subtracted from the read value if a suction operation has been performed, and the data on the result is written to the EEPROM 402 as the new amount of remaining ink.

In addition, the information that can be rewritten by the ink jet printer includes the number of remaining printing media in the pack and the amount of remaining ink, as well as information on the recycling of the pack such as the number of times that the pack has been installed and removed, the number fed sheets, the number of recycles, and a manufacturing date. The information on the pack recycling can be rewritten from the ink jet printer or during the pack recycling. The resulting information can be used during the pack recycling to make determinations for replacing only parts the lifetimes of which are over, thereby improving eco-friendliness and allowing the pack to be appropriately recycled.

(Other) printing heads capable of ejecting inks may include ink jet printing heads comprising an electrothermal converter for generating thermal energy as ink ejecting energy, that is, those that generate bubbles in an ink and that use the bubbling energy to eject the ink. In addition to the above described serial-type printing apparatus, the present invention is applicable as what is called a full-line type printing apparatus that executes printing using a printing head extending a long distance in a width direction of printed media.

Next, an ink replacing system and an ink supplying method included in this embodiment will be described.

The ink replacing system of this embodiment supplies the ink from each ink tank housing section of the above described ink media pack, which is an ink source, to the corresponding sub-tank mounted in the carriage of the printer apparatus main body. It principally comprises sub-tanks, printing heads, ink-air introducing mechanism ink-air introducing mechanisms, and others.

Figure 22:
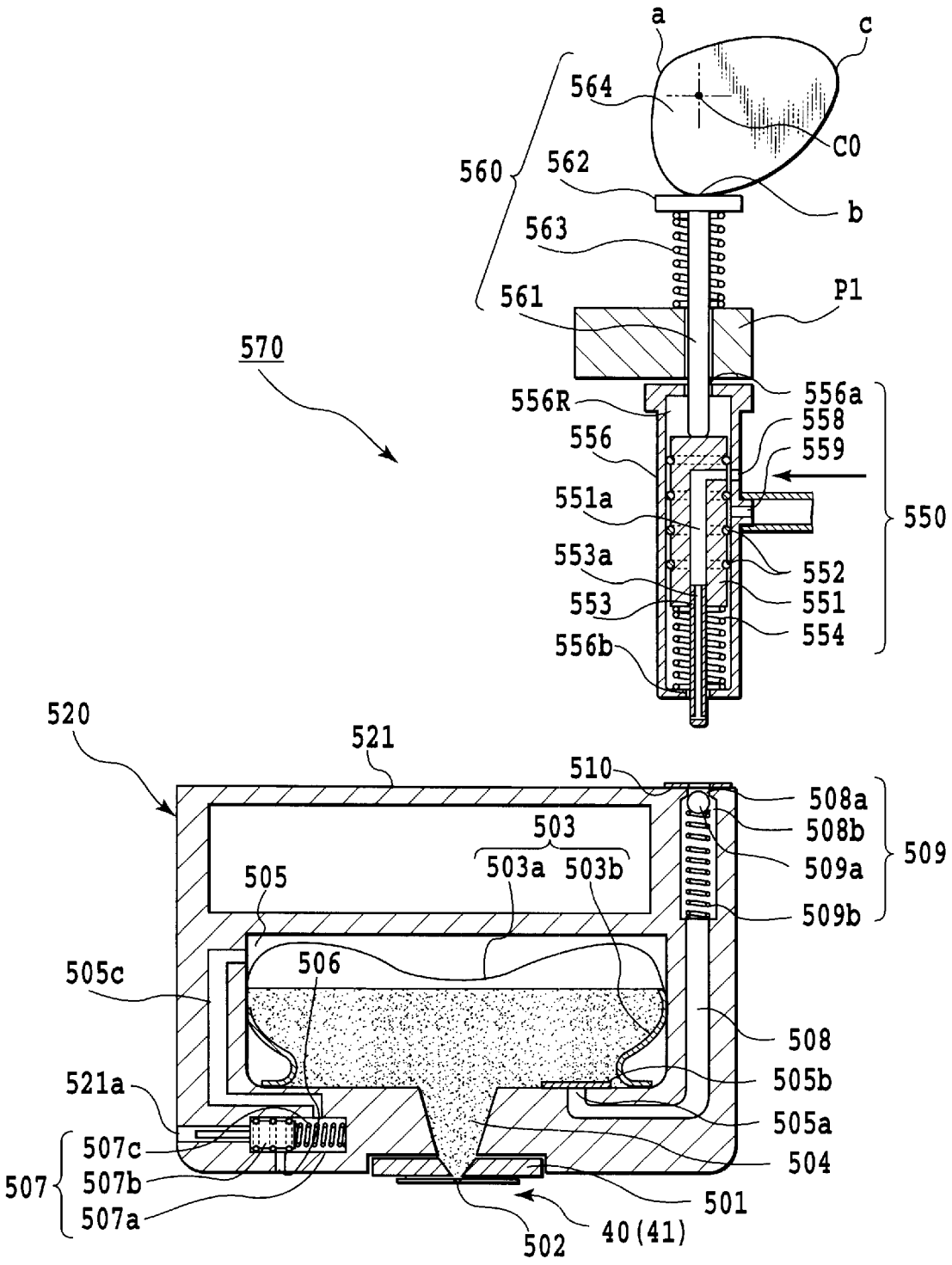
FIG. 22 is a vertical cross sectional side view showing a sub-tank, a printing head, and an ink air supplying mechanism in an ink replacing system of the above printer and showing how these components operate during a printing operation.
Figure 23:
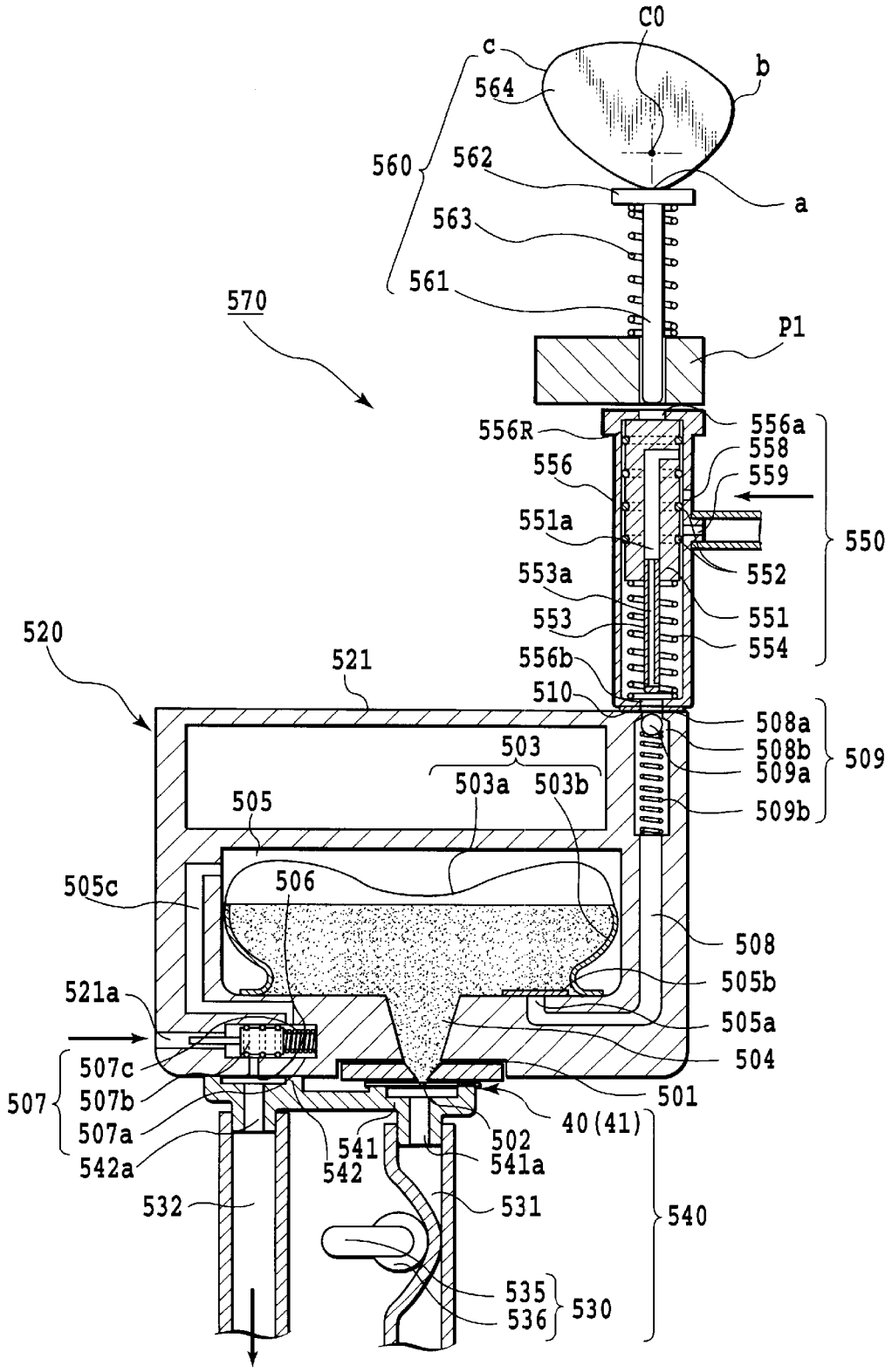
FIG. 23 is a vertical cross sectional side view showing the sub-tank, printing head, and ink air supplying mechanism in the ink replacing system of the above printer and showing how these components operate when the sub-tank has its pressure reduced.
Figure 24:
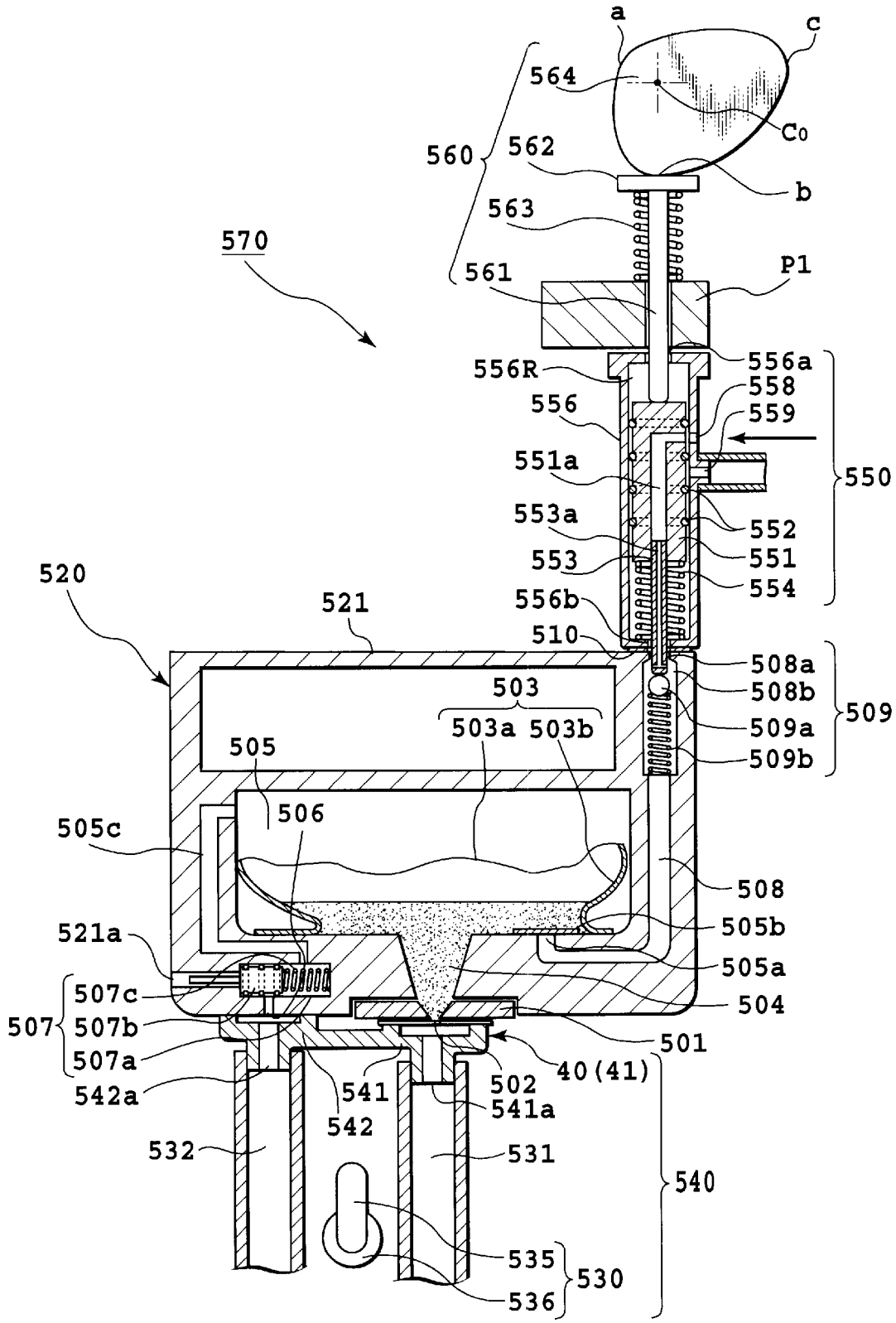
FIG. 24 is a vertical cross sectional side view showing the sub-tank, printing head, and ink air supplying mechanism in the ink replacing system of the above printer and showing how these components operate when air is introduced.
Figure 25:
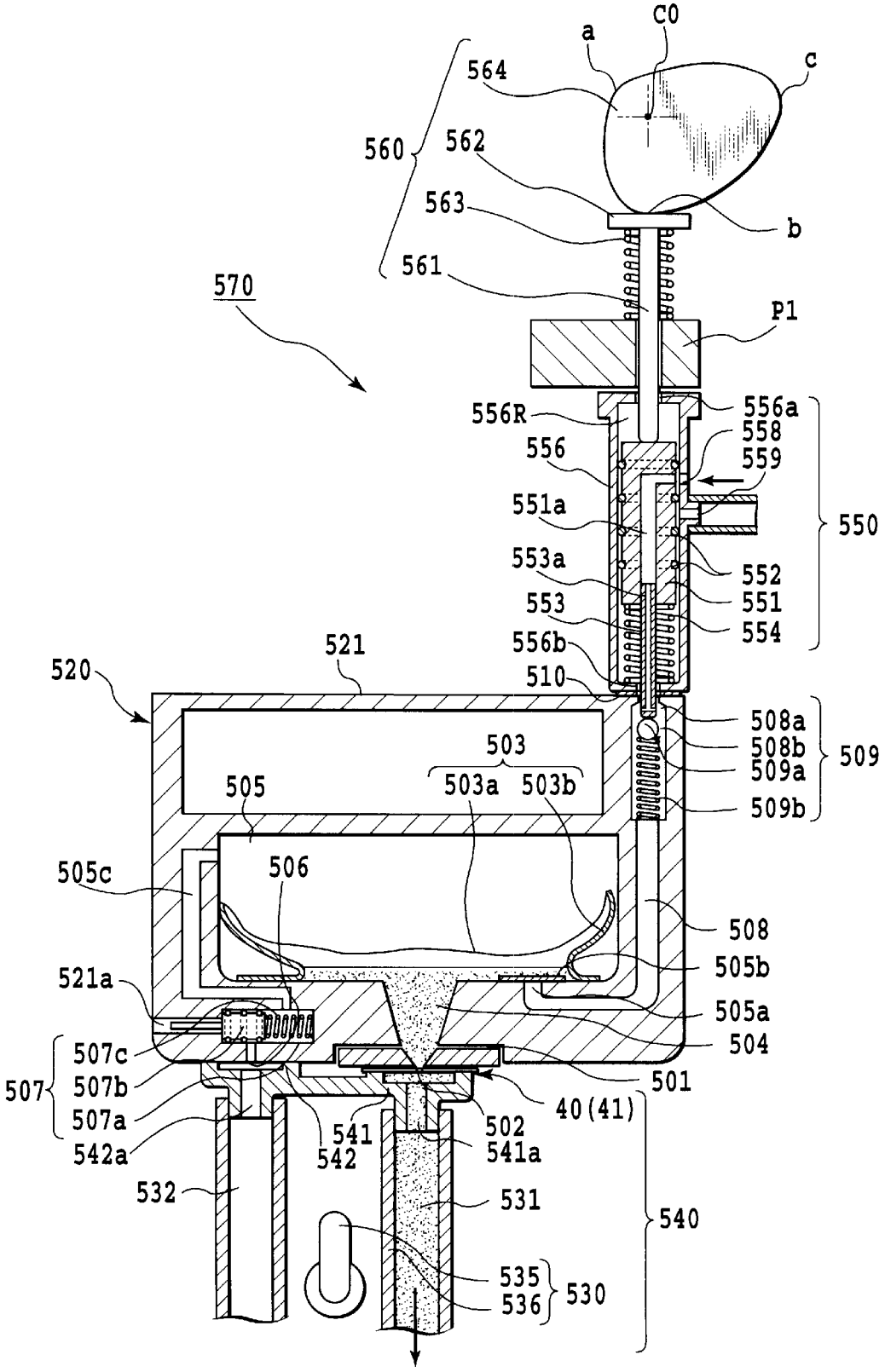
FIG. 25 is a vertical cross sectional side view showing a sub-tank, a printing head, and an ink air supplying mechanism in an ink replacing system of the above printer and showing how these components operate during an ink air discharging operation.
Figure 26:
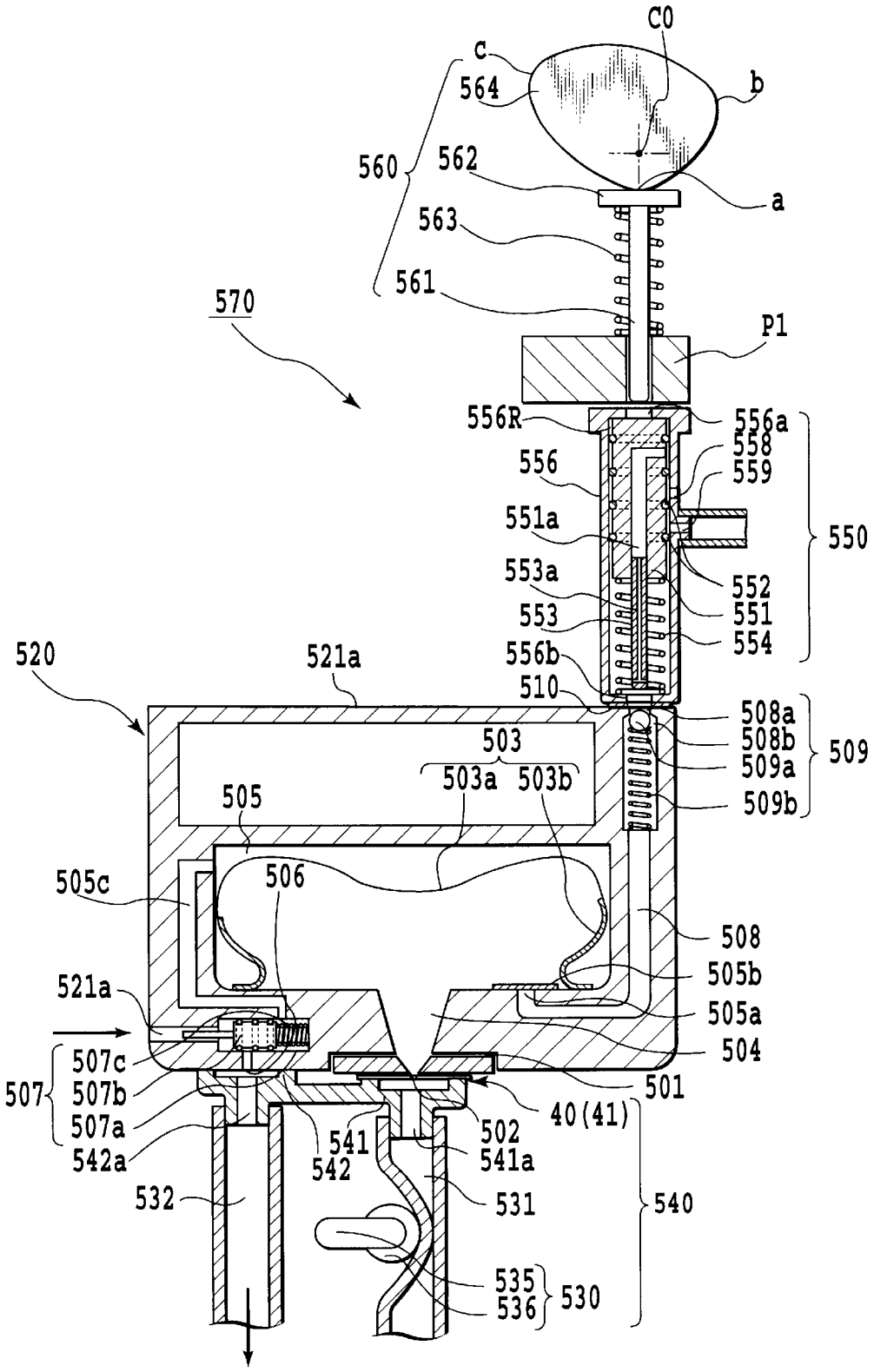
FIG. 26 is a vertical cross sectional side view showing the sub-tank, printing head, and ink air supplying mechanism in the ink replacing system of the above printer and showing how these components operate when the sub-tank has its pressure reduced again.
Figure 27:
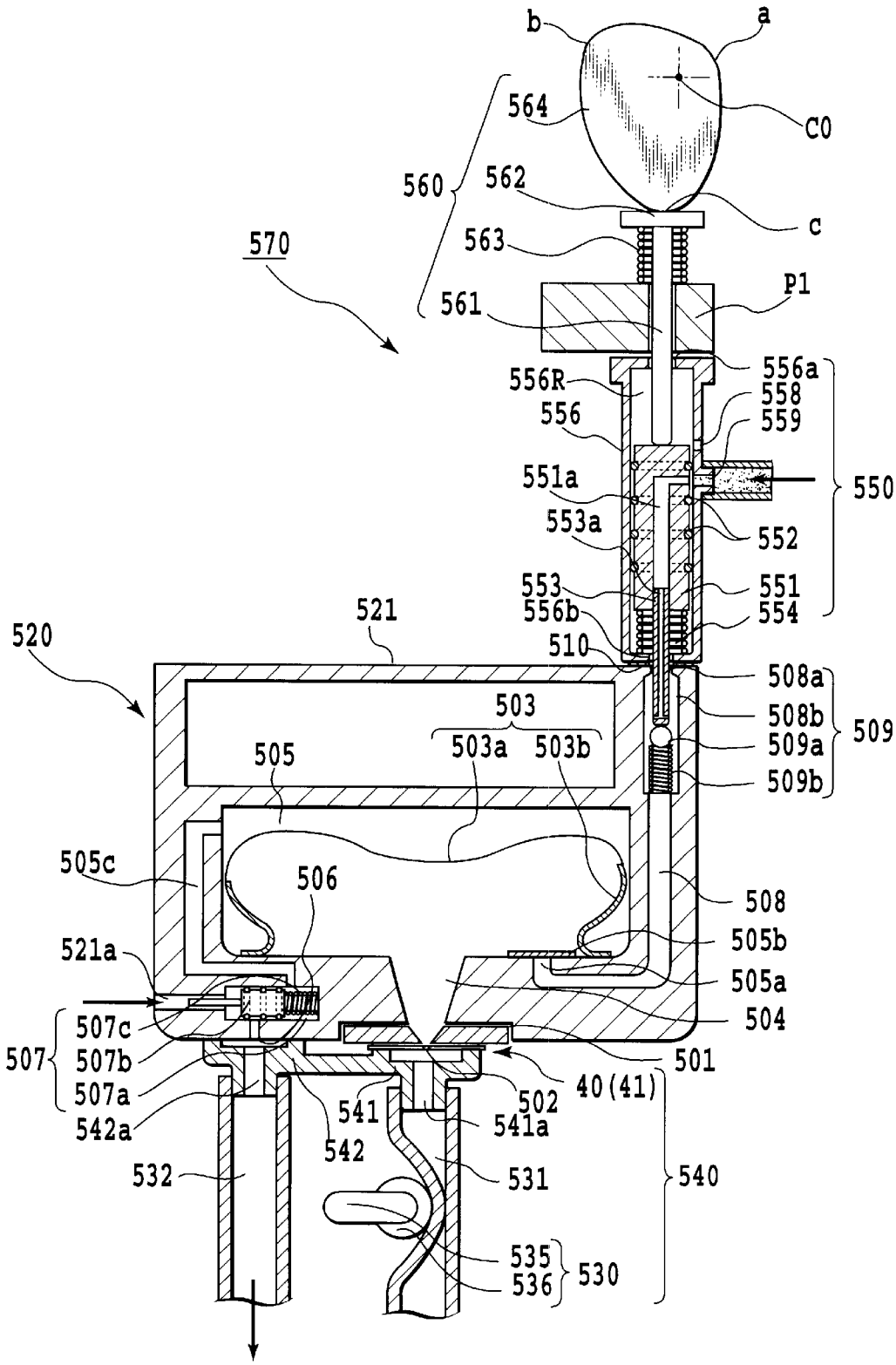
FIG. 27 is a vertical cross sectional side view showing the sub-tank, printing head, and ink air supplying mechanism in the ink replacing system of the above printer and showing how these components operate when an ink is introduced.

FIGS. 22 to 27 are a side vertical sectional views showing the sub-tank, printing head, and ink-air introducing mechanism of the ink replacing system. FIG. 22 shows how these components operate while the printing operation is being performed, FIG. 23 shows how these components operate when the pressure of the sub-tank is reduced, FIG. 24 shows how these components operate while an air is introduced, FIG. 25 shows how these components operate while an ink and air discharging operation is being performed, FIG. 26 shows how these components operate when the pressure of the sub-tank is reduced again, and FIG. 27 shows how these components operate when an ink is introduced.

In each figure, reference numeral 501 denotes a printing head having a large number of electrothermal converters or electrostrictive elements (not shown) arranged therein and acting as a source of ink ejecting pressure, and a large number of nozzle sections also arranged therein and each having an ejection port 502 for ejecting an ink. A source of ink ejecting pressure in each nozzle section is connected with a head driving circuit for supplying a printing signal (not shown) and electricity.

Reference numeral 520 denotes a sub-tank for storing an ink from the ink housing section 211 formed in the ink media pack and acting as an ink source, the sub-tank having the printing head 501 connected integrally with its bottom portion.

In the sub-tank 520, reference numeral 521 denotes a sub-tank main body constituting an outer shell of the sub-tank 520 and having decompression chambers 505 identical to applied ink types in number (in this case, four types). The decompression chambers 505 are each connected to an intake passage 505*c* that is in communication with a pressure reduction adjusting port 506 formed at a bottom of the sub-tank main body 521.

Additionally, each sub-tank main body 521 has four holes H including the above mentioned introduction port 508*a* and formed in a top surface thereof in a line along a vertical direction (that is orthogonal to a main scanning direction) in such a manner as to correspond to one of the decompression chambers 505 as shown in FIG. 20. The entire sub-tank has 16 holes H in the form of a matrix. Of these holes, the four introduction ports 508*a* formed in each decompression chamber 505 are arranged on a line crossing the main scanning direction, corresponding to the moving direction of the carriage. On the other hand, the holes H other than the introduction ports 508*a* are an opening of recesses 508*c* through which introduction needles 553, described later, are passed and each of which has an elastic ink leakage preventing member (not shown) fixed to a bottom surface of the recess 508*c*.

Further, the introduction passage 508 has a sealing mechanism 509 for sealing the introduction port 508*a* formed in an upper end portion of the passage 508 in such a manner that the port can be opened and closed. The sealing mechanism 509 comprises a ball valve 509*a* housed in a valve housing chamber 508*b* formed in the upstream portion of the introduction passage 508, and a spring 509*b* for urging the ball valve 509*a*. An urging force of the spring 509*b* causes the introduction port 508*a* to be normally sealed with the ball valve 509*a*. Reference numeral 510 denotes an ink leakage preventing member comprising an elastic member and fixed to an outside of the introduction port 508*a*. In addition, reference numeral 505*b* denotes a lead-out valve provided in a lead-out port 505*a* to the introduction passage 508 and which enables inks and air to be lead out to the introduction passage 508, while hindering the inks and air from flowing backwards from the introduction passage 508.

Reference numeral 507 denotes a pressure reduction adjusting mechanism inserted into the intake passage 505*c*. The pressure reduction adjusting mechanism 507 comprises a valve housing chamber 507*a* formed in the suction passage 505*c*, a pressure reduction adjusting valve 507*b* inserted into the valve housing chamber 507*a*, and a spring 507*c* for urging the pressure reduction adjusting valve 507*b*.

The pressure reduction adjusting valve 507*b* normally keep communication between the intake passage 505*c* and the pressure reduction adjusting port 506 shut off by means of the urging force of the spring 507*c*. However, when a predetermined pressurizing member (not shown) is inserted through an insertion hole 521*a* formed in a side surface of the sub-tank main body 521 and the pressure reduction adjusting valve 507*b* is moved against the urging force of the spring 507*c*, the pressure reduction adjusting port 506 and the intake passage 505*c* communicate with each other via an intake passage (not shown) formed in the pressure reduction adjusting valve 507*b* to reduce the pressure in the decompression chamber 505.

Thus, the pressure reduction adjusting valve 507*b* is shut off from outside air to maintain a reduced pressure therein because the pressure reduction adjusting port 506 is closed except when the degree of pressure reduction is to be adjusted. When the pressure reduced state is thus formed, the ink in the sub-tank 505 has its pressure reduced to preclude the ink from dropping, while preventing air from being drawn in through the ejection port 502. Consequently, an appropriate ink meniscus can be formed at the ejection port 502 to quest for stabilizing the ink ejection. The adjusting a degree of pressure reduction can be contorolled by providing in the intake passage 505*c* a pressure sensor acting as a pressure reduction measuring means.

Reference numeral 503 denotes an ink liquid chamber housed in the above mentioned decompression chamber 505 and acting as an ink storage section. The ink liquid chamber 503 is shaped like a bag and formed of a flexible member having a lower end portion thereof fixed to a bottom surface portion of the decompression chamber. The ink liquid chamber 503 has its volume varying with a difference between its exterior and interior. In this embodiment, the flexible member comprises a lower half 503*b* formed to be thick and an upper half 503*a* formed to be thin, and the lower half 503*b* is relatively rigid and maintains a constant shape, whereas the upper half 503*a* is not so rigid and has its volume varying depending on a difference between its exterior and interior resulting from:the decompression chamber. This configuration serves to reduce the internal volume during the ink discharging operation to lessen the amount of remaining ink. Thus varying the thickness of ink liquid chamber, however, is not essential to the present invention.

In addition, the ink liquid chamber 503 is in communication with the printing head 501 via the ink supplying passage 504 formed at the bottom of the decompression chamber 505 so that the ink from the ink liquid chamber 503 can be supplied to the printing head 501 via the ink supplying passage 504.

Further, reference numeral 540 denotes a pressure reduction applying mechanism (pressure reducing means) provided in the recovery mechanism 42. The pressure reducing mechanism 540 comprises the above mentioned pair of caps 40 and 41, suction pumps (not shown) each provided correspondingly to one of the caps 40 and 41 and acting as a source of pressure reduction, two sets of pressure reducing paths 531 and 532 that each connect the suction pump and the cap together, an ejection port 502 of the printing head 501, and a switching mechanism 530 for switching a pressure reduction applying state of a pressure reduction adjusting port 506. The caps 40 and 41 each comprise an ejection-port-side sealing section 541 that covers and seals the ejection port 532 and a pressure-reducing-port-side sealing section 542 that covers and seals the pressure reduction adjusting port 506, as shown in FIGS. 1 and 20. The sealing sections 541 and 542 have suction holes 541*a* and 542*a* formed therein, respectively.

Additionally, the above mentioned two pressure reducing paths 531 and 532 are composed of two tubes 531 and 532 connected to suction holes 541*a* and 542*a* in the sealing sections 541 and 542, respectively, and one 531 of the tubes is formed of a flexible member. Further, the pressure reduction switching mechanism 530 comprises a rotational movement arm 535 positioned between the tubes 531 and 532 by a predetermined drive source and rotationally moved by a predetermined drive means, and a compressible connection roller 536 axially attached to one end of the rotational movement arm 535, wherein selecting the position of compressible connection roller 536 by the rotational movement arm 535 allow selection between a communication state and a shut-off state in the tube 531

That is, when the compressible connection roller 536 is brought into connect with the tube 531 compressibly as shown in FIGS. 23, 25, and 27, the tube 531 is collapsed to shut off the communication therein to block the ejection-port-side sealing section 541 off from the suction pump. In contrast, when the compressible connection roller 536 is separated from the tube 531 as shown in FIGS. 24 and 25, the tube 531 recovers to its original shape to make the sealing section 541 in communication with the suction pump.

On the other hand, reference numeral 570 denotes an ink-air introducing mechanism. The ink-air introducing mechanism 570 selectively introduces an ink and outside air into the ink liquid chamber 503 in the sub-tank 521 to function as an ink introducing mechanism or a gas introducing mechanism. Additionally, the ink-air introducing mechanism has two types of ink-air introducing mechanism: paper-side one for introducing an ink and air from the above mentioned ink refilling unit 30 and an ink-media-pack-side one for introducing an ink and air from the interior of the ink media pack 20. Both ink-air introducing mechanism have the same structure and comprise a pressurizing mechanism 560 and an introduction switching mechanism 550.

The pressurizing mechanism 560 of the paper-side ink-air introducing mechanism is installed based on a position where the above mentioned paper-ink refilling cap 40, while the pressurizing mechanism 560 of the pack-side ink-air introducing mechanism is installed based on a position where the special-paper-ink refilling cap 41 housed in the ink media pack 20 is disposed. In addition, pressurizing pins 561 of each pressurizing mechanisms 560 are arranged in a line along a direction (subscanning direction) orthogonal to the moving direction (main scanning direction) of the carriage 2.

Further, one of the introduction switching mechanisms 550 is provided in a supply section 30*a* of the paper-ink refilling unit 30, while the other is provided in a supply section 21*a* of the ink media pack 20.

Additionally, the pressurizing mechanism 560 comprises the plurality of (in this case, four) pressurizing pin 561 penetrating a predetermined support P1 on the printer main body in such a manner as to elevate and lower freely, a spring 563 installed with elasticity between a head 562 of each pressurizing pin 561 and the support P1 to normally apply such a urging force that a lower end portion of the pressurizing pin 561 sinks into the support P1, a single eccentric cam 564 rotationally moved around a rotational movement center Co by means of a predetermined drive source. The eccentric cam 564 is provided where it is always connected with the head 562 of each pressurizing pin 561 compressibly, and allows to move rotationally around the rotational movement center Co to move all the pressurizing pins 561 upward and downward.

That is, when a point a (where the distance from the rotational movement center Co is smallest) on a circumferential surface of the eccentric cam 564 comes into contact with the head 562 of the pressurizing pin 561, a lower end portion of the pressurizing pin 561 is set in its initial position where it sinks into the support P1. When a point c (where the distance from the rotational movement center Co is largest) on the circumferential surface of the eccentric cam 564 comes into contact with the head 562 of the pressurizing pin 561, the lower end portion of the pressurizing pin 561 is set in its maximum projecting position where it projects furthest from a bottom surface of the support P1. Furthermore, when a point b on the circumferential surface of the eccentric cam 564 comes into contact with the head 562, the lower end portion of the pressurizing pin 561 is set in its intermediate position between the initial position and the maximum projecting position.

On the other hand, the introduction switching mechanism 550 comprises an enclosure 556 having a plurality of (in this embodiment, four) housing chambers 556R partitively formed correspondingly to the pressurizing pins 561, switching blocks 551 each accommodated in the corresponding housing chamber 556R of the enclosure 556 in such a manner as to become capable of moving up and down, introduction needles 553 each fixed a lower end of the corresponding switching block 551 and having an introduction passage 553*a* formed in a central portion thereof, and springs 554 each elastically installed between the switching block 551 and the bottom of the enclosure 556.

The enclosure 556 has a plurality of (in this embodiment, four) insertion holes 556*a* formed in a top surface thereof in such a manner as to correspond to the pressurizing pins 561 of the above described pressurizing mechanism and into and from which the corresponding pressurizing pin 561 can be inserted and removed, and has a plurality of (in this embodiment, four) insertion holes 556*b* formed in a bottom surface thereof in such a manner as to correspond to the introduction needles 553, which the introduction needles 553 can be inserted and removed. Furthermore, each housing chamber 556R of the enclosure 556 has an air introducing port 558 and an ink introducing port 559 formed in a side surface thereof. The air introducing port 558 is in communication with outside air, and the ink introducing port 559 is connected via a predetermined communication passage to the paper-ink refilling unit 30, which is a source of inks, or the ink housing section 211 of the ink media pack 20.

Additionally, the switching blocks 551 can each be elevated and lowered through the corresponding housing chamber 556R of the enclosure 556 by means of an O ring 552 fixed to a circumferential surface of the switching block, while maintaining a gas-tight contact with an inner surface of the housing chamber 556R. The switching block 551 has an introduction passage 551*a* bent in the form of the character L in a fashion leading from a side opening formed in one side surface of the passage to a bottom opening formed in the center of a bottom portion of the passage; the introduction passage 551*a* is in communication with the introduction passage 553*a* in the above mentioned introduction needle 553.

Figure 28:
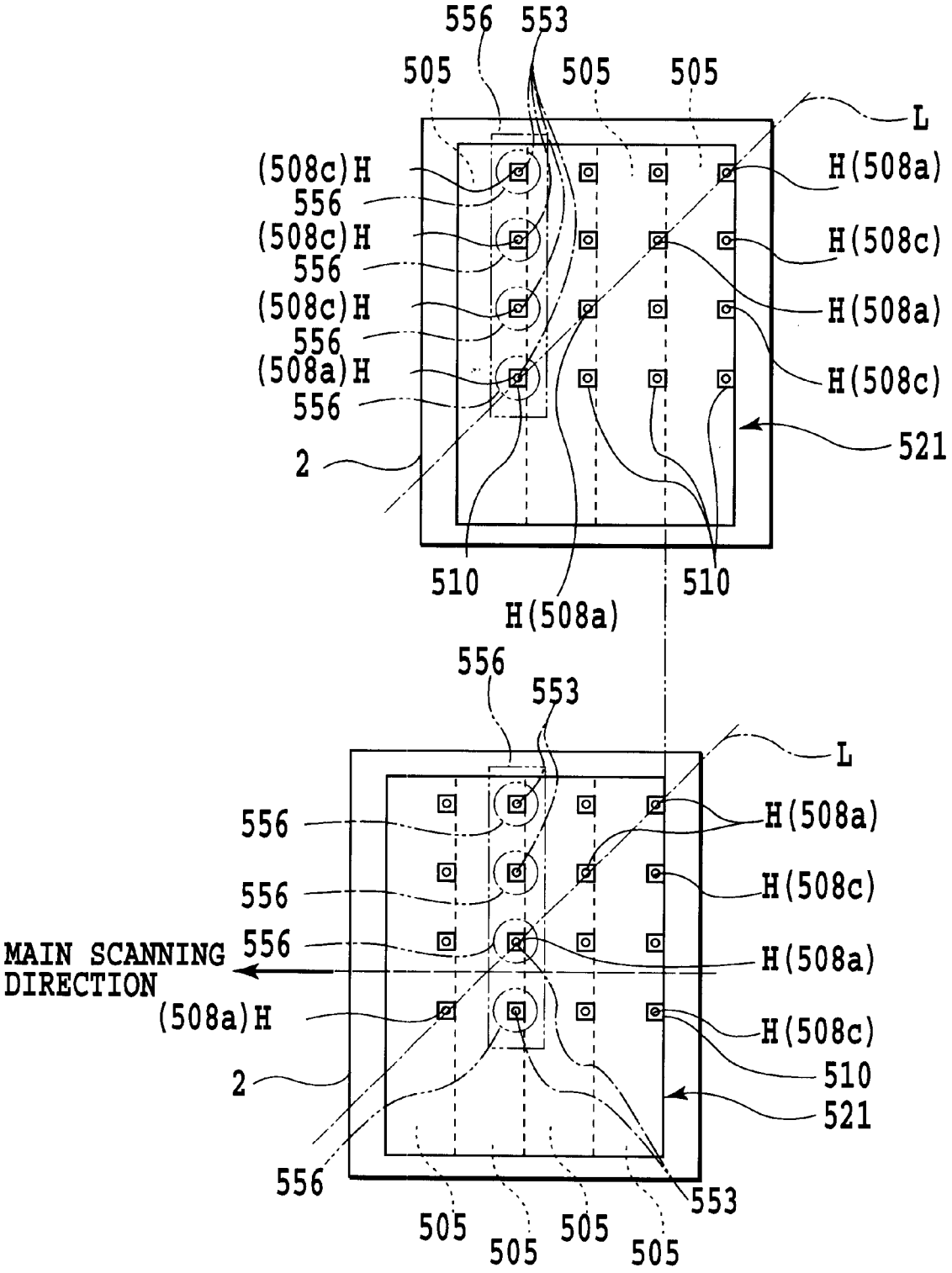
FIG. 28 is an explanatory top view showing an ink introducing hole or the like in the sub-tank.

Moreover, the introduction needles 553 are arranged in the subscanning direction similarly to the pressurizing pins 561 of each pressurizing mechanism 560. Accordingly, the introduction ports 508*a* are arranged in a direction crossing the arranging direction of the introduction needles 553 within the enclosure 556 as shown in FIG. 28. A disposing pitch for the introduction ports 508*a* in the subscanning direction, however, is set the same as that for the introduction needles so that the carriage 2 can be moved in the main scanning direction to sequentially align on a one by one basis among four pieces of the introduction needles 553 with the corresponding introduction ports 508*a* as shown in FIG. 28. This introduction switching mechanism constitutes an ink introduction switching means and a gas introduction switching means.

Next, an ink replacing operation and an ink supplying operation according to this embodiment will be explained.

As described previously, this embodiment performs switching of the printing operation between the one with special paper from the ink media pack 20 or the like and the one with paper from the same, a change in the type of the media pack 20 used, and other operations, so that the types of applied inks must be changed in connection with a change in printing media, thereby requiring stored inks to be replaced with inks to be used for the next printing operation.

This ink replacement is carried out as shown in FIGS. 22 to 27. Description will be made by taking by way of example an operation executed to replace the inks in connection with a change in the type of the ink media pack 20.

When a replacement command is input to replace the ink media pack, the carriage 2 with the sub-tank 520 mounted therein moves to a receding position at a side of the apparatus where it can avoid interfering with the ink media pack 20 (see FIG. 1). Then, the ink media pack 20 being used is removed.

Subsequently, a new ink media pack 20 is installed and the pressurizing mechanism 560 is moved from the receding position to an installation position at a lateral side of the apparatus. Then, the bottom portion of the enclosure 556 in the introduction switching mechanism 550 is located close to the top surface of the sub-tank main body 521, and the pressurizing pins 561 of the pressurizing mechanisms 560 are opposed to the corresponding insertion holes 556*a* formed in the top surface of the enclosure 556.

Then, the information on the ink stored in each ink liquid chamber 503 is read out from the memory 400 for the newly installed ink media pack 20, and when the ink replacing command is input, the MPU determines which inks must be replaced based on the current ink information and the information on the ink used last.

Based on this determination, the carriage 2 moves to oppose the pressure reduction adjusting port 506 formed in the bottom surface of the decompression chamber 505 storing the ink to be replaced as well as the ejection port 502 in the printing head 501, to the sealing sections 541 and 542, respectively, provided in the cap 40 or 41. Subsequently, the cap 40 or 41 elevates to bring the sealing sections 541 and 542 into tight contact with peripheries of the ejection port 502 and the pressure reduction adjusting port 506 (see FIG. 20).

Thereafter, the rotational movement arm 535 of the pressure reduction switching mechanism 530 rotates to bring the compressible connection roller 536 into connection with the tube 531 compressibly to thereby shut off the communication between the ejection port 502 and the suction pump. On the other hand, the pressure reduction switching valve 507*b* is pushed in by a push-in member (not shown) against the urging force of the spring 507*c* and the decompression chamber 505 is allowed to communicate with the suction pump via the pressure reduction adjusting valve 507*b* or the like. In this case, since the introduction passage 508, which can communicate with the decompression chamber 505, is shut off from outside air by the sealing mechanism 509, the interior of the decompression chamber 505 has its pressure reduced by means of an air sucking operation of the suction pump. In addition, the upper half 503*a* of the ink liquid chamber 503 housed in the decompression chamber 505 is formed of a flexible member, so that when the pressure in the decompression chamber 505 is reduced than the atmosphere, the ink liquid chamber 503 has its volume changed correspondingly to have its pressure reduced.

Then, when the decompression chamber 505 reaches a fixed degree of pressure reduction, the pressurizing member (not shown) cancels the pressure on the pressure reduction adjusting valve 507*b*, which thus returns to its initial position due to the urging force of the spring 507*c* to shut off the communication between the intake passage 505*c* and the suction pump to thereby maintain a state of the reduced pressure in the decompression chamber 505 and in the ink liquid chamber 503 (see FIG. 20).

Then, the eccentric cam 564 is rotated around the rotational movement center Co by the drive means (not shown) and then stopped where its circumferential point b comes into contact with the head 562. This causes the pressurizing pin 561 to project from the bottom surface of the support P1 and pass through the insertion hole 556*a* into the enclosure 556 to push the switching block 551 downward, so that the air introducing port (gas introducing port) 558 and the introduction passage 551*a* communicate with each other (see FIG. 24). As a result, outside air is introduced into the ink liquid chamber 503, having its pressure reduced, from the air introducing port 558 through the introduction passages 551*a*, 553*a*, and 508 and the introduction valve 505*b*. This pressure reduction and air introduction causes the ink to be rolled and agitated inside the ink liquid chamber 503 to allow the ink to flow more smoothly.

Then, the suction pump, acting as a source of suction, is activated to discharge the ink used for the last printing operation and remaining in the ink liquid chamber 503, from the ejection port 502 via the tube 531 (see FIG. 25). This discharge step enables the ink in the ink liquid chamber 503 to be completely discharged, but for more reliable discharge, it is also effective to repeat the above described pressure reducing, air introducing, and, discharge steps or reciprocate the carriage 2*a* predetermined distance to roll the internal ink.

After the ink has completely been discharged, the eccentric cam 564 is rotated to bring its circumferential point a into the head 562, as shown in FIG. 26. This causes the pressurizing pin 561 to return to its initial position located above due to the urging force of the spring 563 to exit the enclosure 556 of the introduction switching mechanism 550. Consequently, the introduction needle 553, with the switching block 551, elevates due to the urging force of the spring 554 to exit the introduction port 508*a*. Thus, the urging force of the spring 509*b* causes the ball valve 509*a* to occlude the introduction port 508*a* to the introduction passage 508 to thereby shut off the communication between the introduction port 508*a* and outside air.

At the same time, the pressure reduction adjusting valve 507*b* of the pressure reduction adjusting mechanism 507 is pressed against the force of the spring 507*c* to allow the intake passage 505*c* and the tube 532 to communicate with each other, thereby allowing the decompression chamber 505 to communicate with the suction pump. On the other hand, the compressible connection roller 536 of the pressure reduction switching mechanism 530 is used to shut off the communication between the ejection port 502 and the suction pump, which is then driven. As a result, the ink liquid chamber 503 has its pressure reduced again.

Then, the pressurizing mechanism 560 is driven to rotate the eccentric cam 564 to bring its circumferential point c into connect with the head 562 compressibly (see FIG. 27). This causes the pressurizing pin 561 to project downward to move the switching block 551 to its maximum projecting position to thereby allow the ink introducing port 559 and the introduction passage 551*a* to communicate with each other. This in turn enables communication through the path from the ink media pack 20, which is a source of inks, to the ink liquid chamber 503, that is, the path from the ink media pack 20 through the ink supplying tube 218*c*, ink introducing port 559, and introduction passages 551*a*, 553*a*, and 508 to ink liquid chamber 503.

In this case, during the pressure reducing step shown in FIG. 23, both the ink liquid chamber 503 and the decompression chamber 505 have their pressures reduced, so that the ink stored in the ink media pack 20 is introduced into the ink liquid chamber 503 via the above mentioned path. Once the ink liquid chamber 503 then is filled with the ink , the eccentric cam 564 is rotated to remove the pressurizing pin 561 from the enclosure 556 to remove the introduction needle 553 from the introduction port 508*a* to thereby complete the ink introducing step, thereby completing the ink replacing step for the one ink housing chamber. In this regard, the operation during the ink introducing step is identical to the operation executed to supply the ink, which has been consumed by the printing or recovery operation.

In addition, after the introduction needle 553 has been removed after the ink filling as in FIG. 23, the degree of pressure reduction may further be adjusted in order to make the pressure in the sub-tank 520 suitable for the printing operation.

After the ink liquid chamber 503 in one of the decompression chambers 505 in the sub-tank 520 has been supplied with the ink as described, if another ink liquid chamber 503 must be supplied with the ink, the cap 40 or 41 first lowers to separate from the bottom surface of the sub-tank 505, and the above described elevating and lowering mechanism then lowers the carriage 2 with the sub-tank to separate from the enclosure 565. Subsequently, the carriage 2 moves in the main scanning direction to oppose the pressure reduction adjusting port 506 and ejection port 502 in the another pressure reduction chamber 505 to the cap 40 or 41. Then, the cap 40 or 41 elevates again to seal the pressure reduction adjusting port 506 and the ejection port 502, and then the pressure reducing, air introducing, discharge, pressure reducing, ink introducing, and other steps are subsequently sequentially executed as described above. The above operation is repeated for each decompression chamber 505 for which the ink must be replaced.

The four pressurizing mechanisms 560 provided in this embodiment are structured so that the single eccentric cam 564 simultaneously elevates and lowers equal parts all the pressurizing pins 561. Thus, all the switching blocks 551 and introduction needles 553 of the introduction switching mechanism 550 are simultaneously pressed in response to the pressurizing operation of the pressurizing pins 561.

However, only one of the introduction needles 553 among each introduction needles 553 is inserted into the introduction port 508*a* as described above, with the other introduction needles 553 inserted into those three of the twelve introduction-needle inserting recesses 508*c* formed in the top surface of the sub-tank main body 521*a* which belong to the same row. The recesses 508*c* each have the appropriately elastic ink-leakage preventing member on its bottom surface in such a manner that the lower end of the introduction needle 553 inserted into the recess 508*c* comes into connect with this ink-leakage preventing member compressibly. Thus, unwanted ink leakage can be prevented without damaging the tip of the introduction needle 553. Additionally, since the introduction port 508*a* of the introduction passage 508 not having the introduction needle 553 inserted there into is kept occluded by the ball valve 509, no dust can enter the introduction passage 508.

Although the introduction passages 551*a*, 553*a*, and 508 in this embodiment are used both for inks and for air to allow both of them to flow therethrough, ink introduction passages and an air introduction passage may be separately provided.

In addition, in this embodiment, the ink is discharged from the ink liquid chamber by ejecting it from the ejection port in the printing head 501, but an ink ejecting channel having a relatively large flow area may be formed separately from the ejection port to eject the ink therethrough, thereby increasing ink discharging speed and preventing a decrease in the lifetime of the ejection port caused by the ink discharge.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An integral-type pack configured to be removably installed in an ink-jet printing apparatus which includes printing heads for ejecting inks and conveying means for conveying printing media having images recorded thereon by ejecting inks from the printing heads, said integral-type pack integrally housing the inks to be supplied to the printing heads and the printing media to be conveyed by the conveying means, said integral-type pack comprising:

a first portion and a second portion covering part of said first portion, said first and second portions forming said integral-type pack;

an opening and closing mechanism for opening and closing said second portion relative to the part of said first portion; and an opening portion formed in the part of said first portion covered by said second portion and in which printing media appear when the printing media are housed in said first portion.

2. The integral-type pack according to claim 1, wherein said second portion can house an ink.

3. The integral-type pack according to claim 2, wherein a portion of said second portion which covers the part of said first portion has a joint section for supplying an ink, and the part of said first portion has a cap for capping said joint section at a position corresponding to said joint section.

4. The integral-type pack as claimed in any one of claims 1 to 3, wherein said integral-type pack has memory means mounted therein.

5. A method for installing an integral-type pack in an ink-jet printing apparatus including a section for installing the integral-type pack, the integral-type pack configured to be removably installed in the ink-jet printing apparatus which includes printing heads for ejecting inks and conveying means for conveying printing media having images recorded thereon by ejecting inks from the printing heads, the integral-type pack integrally housing the inks to be supplied to the printing heads and the printing media to be conveyed by the conveying means, the integral-type pack comprising a first portion and a second portion covering part of the first portion, the first and second portions forming the integral-type pack, an opening and closing mechanism for opening and closing the second portion relative to the part of the first portion, and an opening portion formed in the part of the first portion covered by the second portion and in which the printing media appear when the printing media are housed in the first portion, the method comprising the steps of:

engaging the first and second portions of the integral-type pack with corresponding guides of the installation section;

moving the first portion along its corresponding guide to abut the first portion against a predetermined stopper provided in the installation section, and moving the second portion along its corresponding guide to open the second portion relative to the first portion; and fixing the first portion to the installation section using a lock mechanism and electrically connecting the integral-type pack and the ink-jet printing apparatus together.

6. The method for installing an integral-type pack according to claim 5, wherein when the integral-type pack is installed in the ink-jet printing apparatus, part of the second portion spatially overlaps at least part of a printing area for the printing heads.

* * * * *

UNITED STATES PATENT AND TRADEMARK OFFICE

CERTIFICATE OF CORRECTION

PATENT NO. : 6,471,345 B2
DATED : October 29, 2002
INVENTOR(S) : Hiroshi Yoshino et al.

It is certified that error appears in the above-identified patent and that said Letters Patent is hereby corrected as shown below:

Column 3,
Line 33, "is" should read -- are --; and
Line 48, "that" should read -- those --.

Column 5,
Line 5, "the" (first occurrence) should be deleted.

Column 7,
Line 17, "ink-sand-printing" should read -- inks-and-printing --.

Column 10,
Line 16, "lie" should read -- lies --; and
Line 29, "an" should be deleted.

Column 11,
Line 18, "elevate" should read -- elevates --; and
Line 23, "of,a" should read -- of a --.

Column 12,
Line 52, "bosees" should read -- bosses --.

Column 14,
Line 10, "and" should read -- are --; and
Line 28, "are" should read -- is --.

Column 18,
Line 49, "1215" should read -- 215 --; and
Line 58, "butting" should read -- abutting --.

Column 23,
Line 39, "are" should read -- is --.

Column 24,
Line 32, "motor,and" should read -- motor and --; and
Line 53, "hen" should read -- when --.

UNITED STATES PATENT AND TRADEMARK OFFICE

CERTIFICATE OF CORRECTION

PATENT NO. : 6,471,345 B2
DATED : October 29, 2002
INVENTOR(S) : Hiroshi Yoshino et al.

It is certified that error appears in the above-identified patent and that said Letters Patent is hereby corrected as shown below:

Column 28,
Line 17, "aprinting" should read -- a printing --.

Column 29,
Line 10, "an" should read -- a --; and
Line 45, "therein:before" should read -- therein before --.

Column 30,
Line 42, "ink-air introducing mechanism" should be deleted; and
Line 44, "a" should be deleted.

Column 31,
Line 42, "lead" should read -- led --; and
Line 54, "keep" should read -- keeps --.

Column 32,
Line 25, "from:the" should read -- from the --; and
Line 66, "allow" should read -- allows --.

Column 33,
Line 21, "mechanism" should read -- mechanisms --.

Column 35,
Line 60, "reduced" should read -- reduced lower --.

Signed and Sealed this

Eleventh Day of November, 2003

JAMES E. ROGAN
*Director of the United States Patent and Trademark Office*